US005899618A

United States Patent [19]

Kobayashi et al.

[11] Patent Number: 5,899,618

[45] Date of Patent: May 4, 1999

[54] MULTIPLEX WRITING IMPLEMENT

[75] Inventors: Seiichi Kobayashi; Hiroyuki Mutou, both of Yokohama, Japan

[73] Assignee: Mitsubishi Pencil Kabushiki Kaisha, Tokyo, Japan

[21] Appl. No.: 08/693,619

[22] Filed: Aug. 7, 1996

[30] Foreign Application Priority Data

| | | | |
|---|---|---|---|
| Aug. 28, 1995 | [JP] | Japan | 7-240488 |
| Oct. 24, 1995 | [JP] | Japan | 7-298819 |
| Nov. 30, 1995 | [JP] | Japan | 7-334271 |
| Nov. 30, 1995 | [JP] | Japan | 7-334272 |
| Nov. 30, 1995 | [JP] | Japan | 7-334274 |
| Jan. 8, 1996 | [JP] | Japan | 8-017056 |
| Feb. 20, 1996 | [JP] | Japan | 8-055341 |
| Jun. 7, 1996 | [JP] | Japan | 8-146178 |

[51] Int. Cl.[6] ..... B43K 27/00

[52] U.S. Cl. ..... 401/29

[58] Field of Search ..... 401/29–33, 141, 401/219

[56] References Cited

U.S. PATENT DOCUMENTS

| | | | |
|---|---|---|---|
| 1,918,464 | 7/1933 | Furedy | 401/30 |
| 3,056,194 | 10/1962 | Kahn et al. | 401/141 |
| 3,074,380 | 1/1963 | Polishuk | 401/141 |
| 4,202,641 | 5/1980 | Tomura | 401/32 |
| 4,268,183 | 5/1981 | Sekiguchi | 401/30 |
| 4,533,271 | 8/1985 | Sansevero | 401/29 |
| 4,671,691 | 6/1987 | Case et al. | 401/142 |
| 4,686,246 | 8/1987 | Gajria | 401/232 X |
| 4,786,198 | 11/1988 | Zgambo | 401/142 |
| 5,026,190 | 6/1991 | Longarzo | 401/29 X |
| 5,056,947 | 10/1991 | Kubota et al. | 401/29 X |
| 5,306,085 | 4/1994 | Kobayashi | 401/29 |
| 5,655,847 | 8/1997 | Kobayashi et al. | 401/219 |

FOREIGN PATENT DOCUMENTS

| | | | |
|---|---|---|---|
| 997299 | 9/1976 | Canada | 401/219 |
| 3-35589 | 8/1985 | Japan . | |
| 4-52067 | 5/1987 | Japan | 401/219 |
| 6-53185 | 11/1992 | Japan . | |
| 7-33680 | 12/1993 | Japan . | |
| 6171290 | 6/1994 | Japan | 401/219 |
| 6-328891 | 11/1994 | Japan . | |
| 7-214986 | 8/1995 | Japan . | |
| 7-237387 | 9/1995 | Japan . | |
| 7-251593 | 10/1995 | Japan . | |
| 574826 | 3/1976 | Switzerland | 401/219 |

*Primary Examiner*—Linda C. Dvorak
*Attorney, Agent, or Firm*—Darby & Darby

[57] ABSTRACT

A multiplex writing implement of the invention has a multiple number of writing elements, including at least one ball-point pen element which is filled up with a thixotropic water-soluble or low-viscosity oil-based ball-point ink. The ink reserving portion of the ink reservoir of the ball-point pen element is non-flexible and has a relatively large cross-section. A portion for jointing the point assembly with the ink reserving portion is formed so that the element can readily be deflected transversely with respect to the axial direction. The writing tip portions of these writing elements can selectively be projected from and retracted into the barrel front. This multiplex writing implement is able to create line traces with thick line density without causing any blobbing of ink or ink starving. It is also possible to prevent accidental ink leakage. That is, ink can be prevented from staining the barrel cylinder, user's hands, clothes etc., which would be caused by forward leakage of ink or back leakage of ink due to upward writing as well as due to impacts from being dropped or clicked. Still, the multiplex writing implement has a suitable barrel size which meets the demands for portability and high performances of handling.

15 Claims, 43 Drawing Sheets

MULTIPLEX WRITING IMPLEMENT

BACKGROUND OF THE INVENTION (1) Field of the Invention

The present invention relates to a multiplex writing implement, and more detailedly to a multiplex writing implement having a plurality of writing elements selected from any combination of the following writing elements:—normal oil-based ball-point elements; ball-point writing elements which are filled up with so-called thixotropic water-soluble or low-viscosity oil-based ball-point ink; mechanical pencil elements; etc.

(2) Description of the Prior Art

A ball-point pen is typically composed of a point assembly consisting of a ball and a tip holder, an ink reservoir, a pen barrel, etc. In writing with the ball-point pen, when the ball as a writing point is rotated, ink flows out from the point assembly and is transferred to or infiltrated to a recording medium such as paper etc., whereby line traces as well as drawn lines are formed by the transfer.

Since water-type ball-point pens use an ink which has a low viscosity of some mPa S or less, the ball-point pens of this kind offer an advantage to the user, namely the user does not need to press hard and can write comfortably. Ball-point pens of this kind, however, surfer from some drawbacks, such as the forward leakage phenomenon, the back leakage phenomenon, etc. The former phenomenon causes the ink to ooze out from the writing point, whilst the latter phenomenon is caused by air entering the point assembly via writing point, inducing the ink to flow out backwards. These phenomena can be prevented by using a piece of fabric called 'tampon'. On the other hand, if the ball-point pen is left with its cap off, the vapor pressure of the solvent will increase causing the solvent to evaporate. Therefore, there is a concern that the writing point might dry up, causing a lack of ink flow thereby prohibiting writing.

Meanwhile, since conventionally known oil-based ball-point pens use an ink having a viscosity of some thousands mPa S or more, a considerably large friction arises when the ball rolls and the ink flows out from the writing point. Therefore, there is a concern that the conventional oil-based pen can not provide a smooth writing sensation. Further, in the conventional oil-based pen at times an insufficient amount of ink flows from the writing point during writing and at others too much leaks out causing blobbing. Therefore, the conventional oil pen suffers from defects, namely that lines drawn in parts may be irregular, the density of the written trace may be light, or a strong pressure for writing may be needed to be exerted.

For these reasons, recently, a ball-point pen for water-soluble ink which has a viscosity half way between that of the above water-soluble type and the oil type (ranging from some mPa S to some thousands mPa S), has been developed for the improvement of the oil-based ball-point pen. This ball-point pen uses water-soluble ink that presents a relatively low viscosity and has so-called thixotropy. Thixotropy is the characteristic which lowers the viscosity of ink as the tip ball rolls during writing, thus allowing smooth distribution of ink. This type of ball-point pen, however, has the defect that the ink tends to dry up; therefore, it normally needs a cap which is able to seal off the tip part of the writing element. Additionally, since the amount of the ink flowing out will increase, it is also necessary to make the ink reservoir greater in diameter to hold a larger quantity of ink, in order to increase its life of writing.

As the improvement of the oil-based ball-point pen, it is possible to also consider a ball-point pen which uses an oil-based ink which has both a low viscosity and an excellent dryout-resistance. But a ball-point pen of this type, still has the problem that a large amount of ink flows out. Again, in this case, it is necessary to make the ink reservoir greater in diameter to hold a greater quantity of ink, in order to increase its life. Moreover, since the viscosity of the ink is low, when the tip is placed down and a gap is created between the tip ball and the tip holding portion, forward leakage of ink occurs, thus ink oozes out.

That is, since the water-soluble ink having a medium viscosity and the low-viscosity oil-based ink both have a relativity low viscosity, this tends to cause back leakage or forward leakage of ink. If the back or forward leakage of ink occurs, the ink may stain clothes etc. Further, another defect may occur in which, due to impacts from being dropped or clicking, the ink will become clogged causing ink-starving in writing.

For the ball-point pen with a medium-viscosity water-soluble ink, a translucent, nondrying greasy material called 'follower' is usually filled at the rear end of the ink reservoir. Therefore, when trying to prevent ink evaporation, it is enough to consider the reduction of ink due to the evaporation from the gap between the writing point or the ball and its holder. Therefore, if, for example, a solvent having a considerably low vapor pressure is mainly used as in the oil-based ball-point pen, it is not necessary to consider the evaporation of ink. In the case of the water-soluble ink, however, the main component of the solvent is water; therefore the use of a low vapor pressure solvent can not prevent water from evaporating.

Meanwhile, an ink has been known which can be erased by a rubber eraser. This ink uses the difference in solubility of rubber component in the ink solvent. That is, the ink will be a gel inside the ink reservoir while it will become a sol when the tip ball rolls during writing. The ink will again become a gel when the ink is drawn on the writing surface, so that the ink will not be absorbed into the paper.

There is a known writing implement called a multiplex writing implement, which has a plurality of writing elements such as a mechanical pencil and a ball-point pen etc., and which selectively allows either of the elements to come in and out at the front end thereof. Various kinds of the mechanisms for achieving the writing elements to be projected and retracted at the front end of the multiplex writing implement, have been known. Examples of the mechanisms include a clicking type, a slider type in which sliders exposed to the outside from the side of the barrel cylinder of the writing implement should alternately be slid, a cam type in which a cam cylinder having a slope is rotated to achieve the function, etc.

Known examples of the multiplex writing implement of this kind, include a configuration in which a plurality of normal-type oil-based ball-point writing elements are pushed out. This implement is constructed so that the writing elements fixed to corresponding click-operating portions inside the barrel cylinder are slidably provided along corresponding length-wise grooves formed inside the barrel cylinder, and when one of the tip portions of the writing elements is selectively projected out from the front end opening of the barrel cylinder and engaged in place, the engagement of the other writing element is released so that the disengaged writing element is retracted into the inside of the barrel cylinder by the action of the return spring.

In the multiplex writing implement of this kind, when one of the writing elements is selected so that the tip portion of the selected element is projected out from the front end opening of the front barrel, the click-operating portion will be engaged in a flexed state with respect to the axial direction. Therefore, the writing element, if it is non-flexible, will not achieve the necessary function. Particularly, consider a case where a ball-point pen having a water-soluble medium-viscosity ink or oil-based low-viscosity ink is used as a writing element of the multiplex writing implement. In this case, since the ink reservoir needs to be of a greater diameter as stated above, it is impossible to create a sufficiently large margin between the writing elements, unlike in the configuration in which the regular-diametric writing elements were used. Therefore, the tip part of the writing element to be projected can not be guided smoothly to the center of the front end opening of the barrel cylinder. That is, the movement of the writing elements is impeded, and consequently, the tip parts of the writing elements could be disallowed from either projecting or retracting. For the large-diametric writing elements to be projected or retracted, the diameter of the barrel cylinder may be made very large. This, however, gives rise to a problem of deteriorating the portableness and handling performance of the writing implement.

As stated above, since the projecting/retracting mechanism of the conventional multiplex writing implement incorporates return springs for retracting writing elements into the barrel cylinder, it has a complicated structure needing an increased number of parts and resulting in an increased cost. Additionally, the conventional mechanism requires a large space, this means that there is dimensionally little space for the writing elements.

The conventional multiplex implement suffers from other drawbacks such as it will stain clothes if the writing implement is placed in a breast pocket etc. with its writing point projected out.

Publicly known technologies relating to the multiplex writing implement of the invention include those disclosed in Japanese Patent Application Laid-Open Hei 7 No.214,986, Japanese Patent Application Laid-Open Hei 6 No.328,891, Japanese Utility Model Application Laid-Open Hei 6 No.53,185, Japanese Utility Model Application Laid-Open Hei 7 No.33,680 and Japanese Utility Model Publication Hei 3 No.35,589.

SUMMARY OF THE INVENTION

The present invention has been devised to solve the above prior art problems. It is therefore a first object of the present invention to provide a multiplex writing implement in which a plurality of writing elements are incorporated in the barrel cylinder and the writing tip portions can selectively be projected out and retracted into the barrel front even when at least one of the plural writing elements is a ball-point pen which uses a medium-viscosity water-soluble ink or low-viscosity oil-based ink and has a mechanism to prevent the back leaking of ink due to impacts from being dropped or due to upward writing as well as to prevent the forward leakage while the pen point has a resistance to dryout without using any cap and which still has excellence in portability and handling performance and can be manufactured in a reduced cost.

It is a second object of the invention to provide a convenient multiplex writing implement which has a ball-point pen element using an ink that can be erased by a rubber eraser and an eraser delivering mechanism in addition to the feature of the first object.

It is a third object of the invention to provide a multiplex writing implement which has the feature of the first object and still is able to make the user easily recognize that the writing tip portion of a writing element remains projected out by prohibiting the implement from being hooked into user's breast pocket etc. when the implement is in such a situation, thus making it possible to prevent clothes and the like from being stained due to the ball-point pen element as well as to prevent the occurrence of damages to clothes etc. due to the sharp edge of the writing tip portion of a mechanical pencil element etc.

In order to attain the above first to third objects, the present invention is configured as follows:

A multiplex writing implement in accordance with the first aspect of the invention, includes: a barrel cylinder; and a plurality of writing elements incorporated in the barrel cylinder, and is characterized in that, the writing tip portions of the writing elements can selectively be projected from or retracted into the barrel front, at least one of the plurality of writing elements is a ball-point pen element which comprises: a point assembly which is composed of a tip ball held in a tip holding portion at the tip end thereof and a spring which is arranged so as to constantly bring the tip ball into sealing contact with the inner brim of the tip holding portion and release the sealed state during writing; an ink reservoir which is disposed behind the point assembly and is filled up with a thixotropic water-soluble or low-viscosity oil-based ball-point ink whose viscosity decreases as the tip ball rolls during writing so as to allow smooth distribution of ink; and an ink follower which consists of a translucent, nondrying greasy material and is disposed at the rear end of the ink so as to move in contact with the ink surface following the consumption of the ink, the ink reserving portion of the ink reservoir is non-flexible and has a relatively large cross-section, and a portion for jointing the point assembly with the ink reserving portion is formed so that the writing element can readily be deflected transversely with respect to the axial direction.

The second aspect of the invention resides in that in the multiplex writing implement having the first feature, the ball-point pen element has a joint which is integrally formed of: a portion to be press-fitted to the rear end of the point assembly; a portion to be press-fitted to the ink reservoir; and a flexible portion disposed between the portion to be press-fitted to the rear end of the point assembly and the portion to be press-fitted to the ink reservoir.

The third aspect of the invention resides in that in the multiplex writing implement having the first feature, the ball-point pen element comprises: a valve chamber which is disposed facing the rear end of the point assembly and has a ball valve held therein with play; a ball seat which is formed in the rear of valve chamber and which the ball valve comes in sealing contact with to prevent back leaking of ink; and a conduit which extends from the ball seat to the ink reservoir.

The fourth aspect of the invention resides in that in the multiplex writing implement having the first feature, used is an erasable ink which is obtained by adding a cross-linking agent to an ink solvent so that the ink will become a sol when the tip ball rolls during writing and it will again become a gel when it is drawn on the writing surface whereby the ink will not be absorbed into the paper.

The fifth aspect of the invention resides in that in the multiplex writing implement having the first feature, the barrel cylinder is composed of front and rear barrels and a middle barrel provided therebetween, and the multiplex writing implement further comprises: return springs which are engaged with the middle barrel at one end thereof and urges corresponding writing elements rearwards; sliding pieces which are attached to the rear ends of the writing elements and are urged rearwards by the return springs; a cylindrical cam which has a slant cam surface at the front end thereof to push the rear end of any one of the sliding pieces so that one of the writing elements moves forwards, and further has an engaging portion which is engaged with the middle barrel so that the cam can be rotated; and an eraser delivering mechanism which is attached to the rear of the cylindrical cam.

The sixth aspect of the invention resides in that in the multiplex writing implement having the first feature, the barrel cylinder is composed of front and rear barrels, which are connected to one another and the rear barrel has a plurality of longitudinal slots which extend up to the rear end thereof, and which further comprises: a plurality of clicking portions which each are linked with the corresponding writing elements and are projected out through the longitudinal slots and become engaged when the clicking portion is slid forward, so that one of the tip portions of the writing elements is selectively projected from the front opening of the front barrel; and a plurality of flexible joints each of which joins the rear end of the writing element with the front end of the clicking portion so that the connection can deflect approximately perpendicularly to the axial direction.

The seventh aspect of the invention resides in that in the multiplex writing implement having the first feature, the barrel cylinder is composed of front and rear barrels, and the multiplex writing implement further comprises: a rotary shaft which is disposed in the bore of the rear barrel so as to be rotatable within a range of approximately 120° relative to the rear barrel and is provided with a pair of projections in the front part thereof; an operating handle which is fixed to the rear end portion of the rotary shaft which is projected from the rear end of the rear barrel, the operating handle together with the rotary shaft being held just rotatably relative to the rear barrel; and a pair of sliding pieces which are disposed opposite to each other and of which each inner side is formed with a slant cam groove to be engaged with the projection of the rotary shaft so that the sliding pieces are guided by the bore of the rear barrel so as to be moved only back and forth, and is characterized in that the writing elements are provided in front of the sliding pieces so as to be linked with the sliding pieces, and when the rotary shaft rotates as the operating handle is rotated, the sliding pieces alternately move forwards and backwards so that the tip portions of the writing elements can be projected from or retracted into the front end opening of the front barrel.

The eighth aspect of the invention resides in that in the multiplex writing implement having the first feature, further comprises: an operating handle which is disposed in the rear part of the barrel cylinder and is rotated so that the front tip portions of the writing elements are selectively projected from or retracted into the barrel front; a clip which extends toward the barrel front from one peripheral part of the operating handle; and a plurality of raised portions which will become opposite to the front part of the clip are formed on the outer peripheral surface of the barrel cylinder at predetermined positions, wherein whenever either of the tip portions of the writing elements remains to be projected from the barrel front, the front part of the clip and the raised portion will be aligned to each other in the axial direction so that the clip will be impeded from being hooked in a breast pocket etc.

The ninth aspect of the invention resides in that in the multiplex writing implement having the eighth feature, whenever either of the tip portions of the writing elements remains projected from the barrel front, the front part of the clip is concealed by a depressed portion formed in the raised portion so that the clip will be impeded from being hooked in a breast pocket etc.

The tenth aspect of the invention resides in that in the multiplex writing implement having the eighth feature, the clip has a bead in the front part thereof, and whenever either of the tip portions of the writing elements remains projected from the barrel front, the bead of the clip and the raised portion engage one another so that the bead of the clip will not be separated from the peripheral surface of the barrel cylinder.

The eleventh aspect of the invention resides in that in the multiplex writing implement having the tenth feature, the raised portion has an engaging portion in the front side thereof which is composed of projected and recessed portions while the bead of the clip has an engaging portion in the rear side thereof which is composed of projected and recessed portions, so that the projected portion of the raised potion will become engaged with and disengaged from the recessed portion of the bead as the clip is rotated.

The twelfth aspect of the invention resides in that in the multiplex writing implement having the tenth feature, the bead of the clip has a necked portion while a depressed portion into which the bead is fitted is formed on the peripheral surface of the raised portion, and the opening of the depressed portion is formed with an edged portion which narrows the opening so that the edged portion will become engaged with and disengaged from the necked portion of the bead as the clip is rotated.

The thirteen aspect of the invention resides in that in the multiplex writing implement having the tenth feature, the bead of the clip has a depressed portion which is opened facing inwards and a projected portion which narrows the opening is formed in the opening of the depressed portion while a plurality of raised portions each having a necked portion are formed on the outer peripheral surface of the barrel cylinder, so that the depressed portion of the bead will become engaged with and disengaged from the necked portion of the raised portion as the clip is rotated.

The fourteen aspect of the invention resides in that in the multiplex writing implement having the first feature, two type of writing elements, that is, a mechanical pencil element and a ball-point pen element are incorporated, and at least the mechanical pencil element is held movably in the axial direction when the element is projected out.

In accordance with the fifteenth aspect of the invention, in the multiplex writing implement having the first feature, the barrel cylinder is composed of front and rear barrels, and the multiplex writing implement further comprises: a rotary shaft which is disposed in the bore of the rear barrel so as to be rotatable within a range of 120° to 180° relative to the rear barrel and is provided with a cam groove formed on the peripheral surface of the shaft; an operating handle which is fixed to the rear end portion of the rotary shaft which is projected from the rear end of the rear barrel, the operating handle together with the rotary shaft being held just rotatably relative to the rear barrel; and a pair of sliding pieces which are disposed opposite to each other and of which each inner side is formed with a projection to be engaged with the cam groove of the rotary shaft so that the sliding pieces are guided by the bore of the rear barrel so as to be moved only back and forth, and is characterized in that the writing elements are provided in front of the sliding pieces so as to be linked with the sliding pieces, and when the rotary shaft rotates as the operating handle is rotated, the sliding pieces alternately move forwards and backwards so that the tip portions of the writing elements can be projected from or retracted into the front end opening of the front barrel.

DESCRIPTION OF THE PREFERRED EMBODIMENTS

First through seventh embodiments of the multiplex writing implement of the invention will be described with reference to the accompanying drawings.

The multiplex writing implement to be targeted by the invention is one which incorporates at least one ball-point pen element which is filled up with a water-soluble thixotropic ball-point ink or low-viscosity oil-based ball-point ink; a mechanical pencil element or a normal oil-based ball-point pen etc. is used as the other writing element.

Configuration of the First Embodiment

Figure 1:
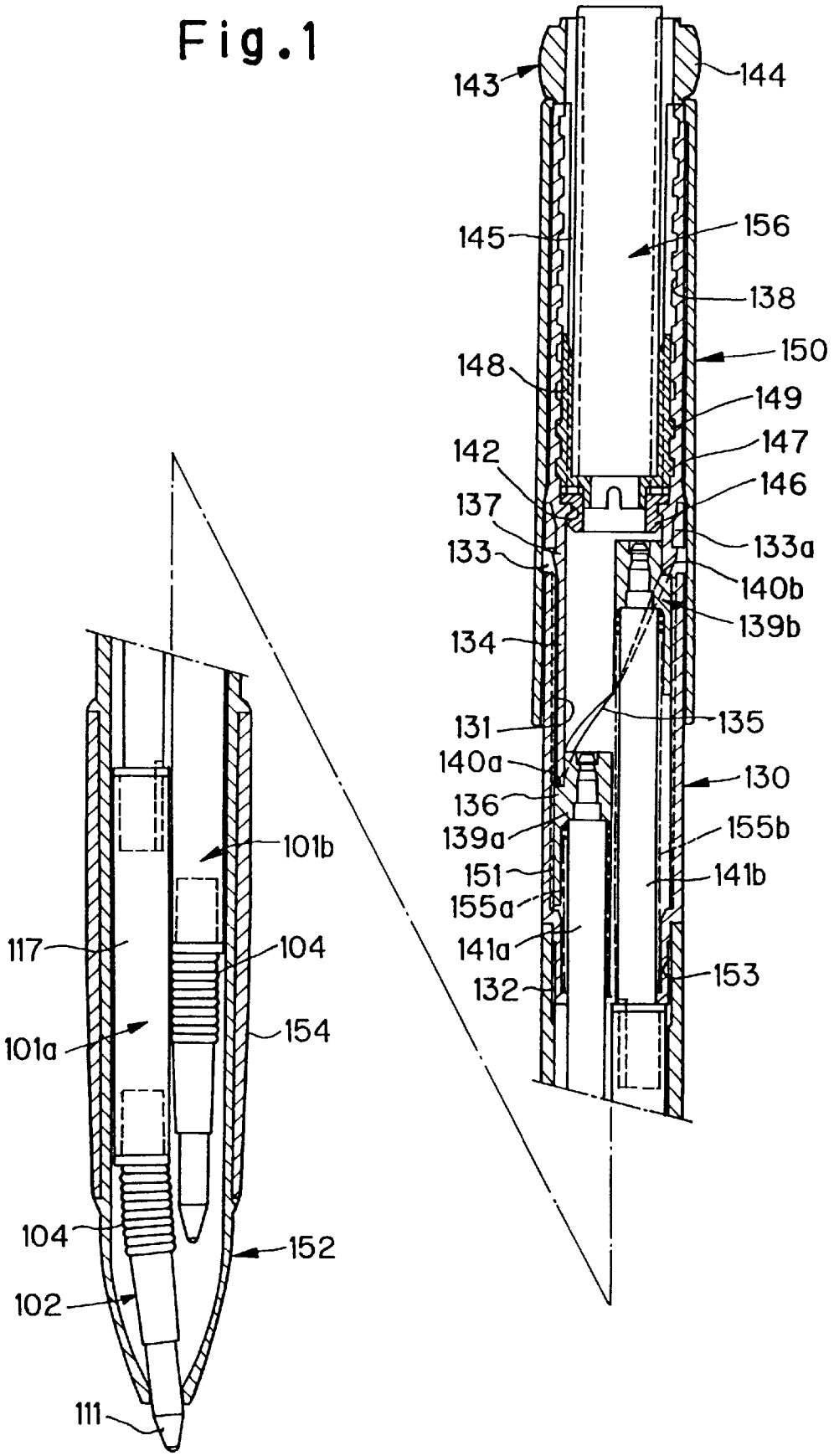
FIG. 1 is a vertical sectional view showing the overall structure of a multiplex writing implement of the first embodiment of the invention where a part of the view is in the non-sectional representation.
Figure 2:
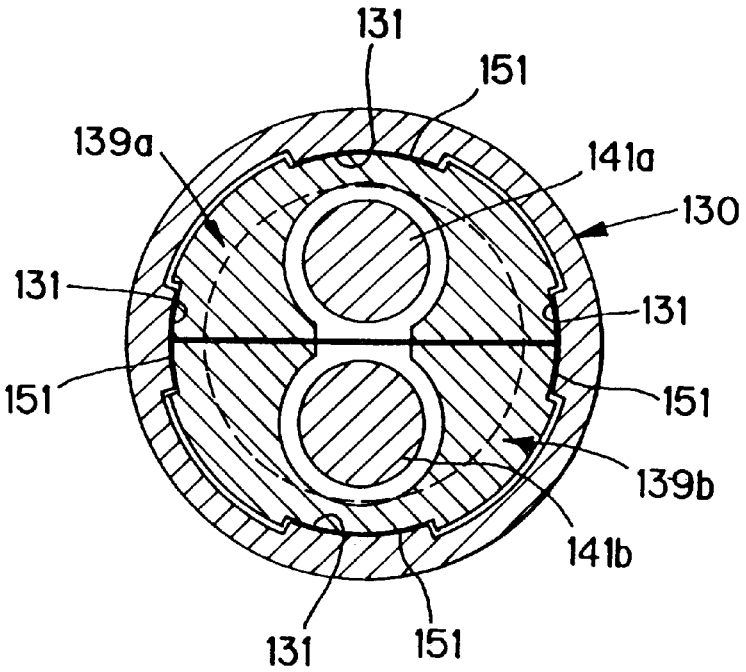
FIG. 2 is a transverse cross sectional view showing a structure around sliding pieces in accordance with the first embodiment.
Figure 3:
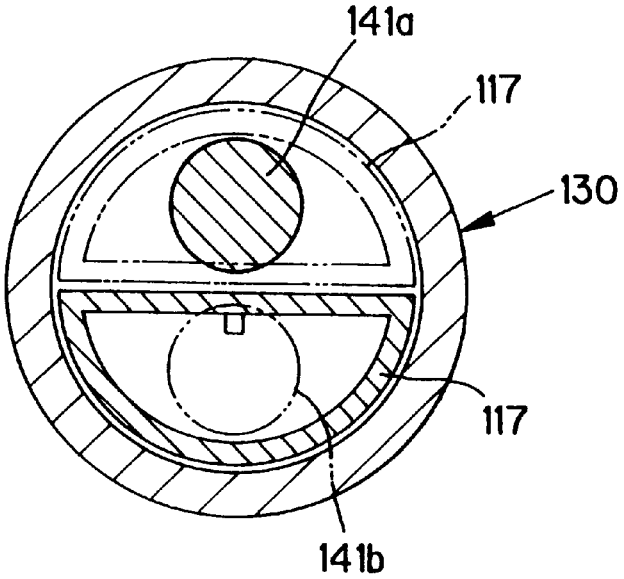
FIG. 3 is a transverse cross sectional view showing a structure around an ink reserving portion of a ball-point pen element in accordance with the first embodiment.

First, FIGS. 1 through 4 show the first embodiment of the invention. A barrel cylinder is composed of a front barrel 152, a rear barrel 150 and a middle barrel 130. In FIG. 1, two ball-point pen elements 101*a* and 101*b* are provided. The implement of the first embodiment incorporates a ball-point pen element which has been filled up with a ball-point pen ink erasable with a rubber eraser, which will be detailed later. The multiplex writing implement of the first embodiment has a writing mechanism at a front end thereof and an eraser delivering mechanism at a rear part thereof. This eraser delivering mechanism can be provided optionally depending upon the assortment of writing implements incorporated and the degree of necessity of the eraser.

The multiplex writing implement of the first embodiment comprises front and middle barrels 152 and 130 for accommodating the part of the writing element mechanism located in the front part of it and rear barrel 150 for accommodating the eraser delivering mechanism located in the rear part of it. Formed on the inner peripheral surface at the rear part of front barrel 152 is a female thread 153. Rear barrel 150 has an opening at the end thereof through which the eraser is delivered.

A small-diametric portion at the front part of middle barrel 130 is formed with a male thread 132, which is screwed into the aforementioned female thread 153 of front barrel 152 so that the front barrel can be detached as required, such as when the writing element should be replaced or when the mechanical-pencil element, if it is incorporated in the implement, should be refilled with some lead. In order to regulate the rotational position, a recessed stopper is formed at the end of middle barrel 130 along the circumference thereof for receiving a rib formed on the outer periphery of a cylindrical cam 134 to be described later. Further, a cutout (not shown) into which the rib is fitted is formed at the end of middle barrel 130 so that cylindrical cam 134 can be clicked.

Moreover, a window 133 is formed on the side surface in the rear portion of the middle barrel 130, whilst four guide ribs 131 extending in the axial direction, are formed 90° apart on the inner peripheral portion of middle axis 130.

Front ends of return springs 155*a* and 155*b* which urge the aforementioned ball-point pen elements 101*a* and 101*b* backwards are engaged at the front part of middle barrel 130. Receiving shafts 141*a* and 141*b* which extend forwards, are passed through the hollows of return springs 155*a* and 155*b* and are fixed to sliding pieces 139*a* and 139*b*. Attached at the front ends of the receiving shafts 141*a* and 141*b* are the rear ends of ball point pen elements 101*a* and 101*b*. The rear ends of return springs 155*a* and 155*b* are abutted against the front faces of the sliding pieces 139*a* and 139*b* so as to urge sliding pieces 139*a* and 139*b* backwards.

Sliding pieces 139*a* and 139*b* each have a projection 140*a* or 140*b* having an angular shape which serves as a slant follower surface abutting a slant cam surface 135 of cylindrical cam 134 (to be detailed later). That is, as the cylindrical cam rotates, slant cam surface 135 presses the slant follower surface forwards.

A grooves 151 are formed on each side surface of the sliding pieces 139*a* and 139*b* so that the aforementioned guide rib 131 formed inside middle barrel 130 will be engaged with this groove. Thus, the sliding pieces 139*a* and 139*b* will become able to smoothly be moved forwards and backwards. Further, sliding pieces 139*a* and 139*b* have a transversally sectional view of almost D-shape. In the prior art configurations, a structure in which a guide cylinder with opposing two guide grooves should be attached, was often used, but the structure of this embodiment will not need such a complicated structure. This is one of the advantages of this embodiment.

Further, cylindrical cam 134 has an annular engaging projection 137 on its outer peripheral surface. This projection is engaged with middle barrel 130 so that cam 134 will be able to rotate. Middle barrel 130 has a pair of thick-wall portions 133*a*, and is formed with window 133. In this arrangement, when the front part of cylindrical cam 134 is squeezed into middle barrel 130, annular engaging projection 137 will forcibly open thick-wall portions 133*a* and be fitted in window 133 so that cylindrical cam 134 will be fitted rotatably and prevented from being pulled out. If cylindrical cam 134 is needed to be advanced (at the case where the mechanical pencil should be clicked, etc.), window 133 is made sufficiently long so as not to impede the movement of the engaging projection 137.

Further, a spiral groove 138 is formed on the inner peripheral surface at the rear part of cylindrical cam 134. Grooves and ribs (not shown) are provided by turns on the outer peripheral surface at the rear part of cylindrical cam 134 so as to front the inner peripheral surface of rear barrel 150. A stepped portion 142 is formed inside cylindrical cam 134 so that an inner cylinder 143 to be described later can be rotated but will be prevented from being pulled out in the axial direction.

Further inner cylinder 143 is rotatably fitted with cylindrical cam 134, and is formed with a pair of long slits 145 opposite to one another. Provided at the front part of inner cylinder 143 is an engaging projection 146 for anti-separation which engages stepped portion 142 that projects inwards inside cylindrical cam 134. Further, at the rear end of inner cylinder 143 is a crown 144 which is exposed from the rear end of rear barrel 150 after assembly and functions as a rotatable handling portion when an eraser is made to come out.

An eraser holder 147 is disposed inside inner cylinder 143 and has projections 149 which engage spiral groove 138 on cylindrical cam 134. This holder holds an eraser 156 and has an elastic element 148 which will be able to be slid along slits 145 of inner cylinder 143.

Although a configuration with two writing elements was illustrated in the above description of the first embodiment, a writing implement which includes three writing elements may be designed.

Next, ball-point pen element 110*a* to be incorporated in the multiplex writing implement of the first embodiment will be described. Here, two ball-point pen elements 101*a* and 101*b* have the same structure, and differ in the color of ink etc. Ball-point pen elements 101*a* and 101*b* are filled with so-called thixotropic water-soluble or low-viscosity oil-based ball-point ink or an erasable ink by the eraser. This erasable ink can be obtained by adding a cross-linking agent to the ink solvent. That is, the ink is modified so that it will become a sol when the tip ball rolls during writing and it will again become a gel when it is drawn on the writing surface whereby the ink will not be absorbed into the paper.

Figure 4:
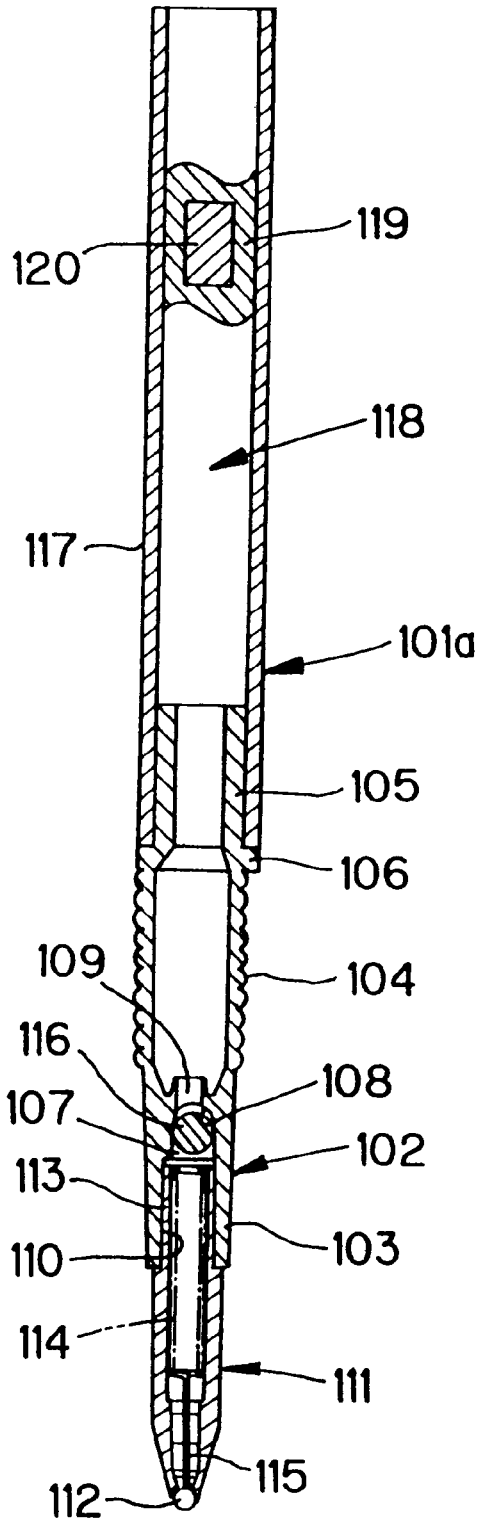
FIG. 4 is a vertical sectional view showing a ball-point pen element of the first embodiment.

As shown in FIG. 4, a point assembly 111 is constructed so that a tip ball 112 is substantially abutted onto a seat having channels which will permit ink to flow in, and is held rotatably by a front press-fitted portion. Further, a spring 114 is inserted into the bore of point assembly 111. The rear end of a pipe portion 113 of point assembly 111 is properly press-fitted so that the rear part of spring 114 will not come out. In order to prevent dryout of the writing point and the forward leakage of ink, it is very important to bring tip ball 112 into sealing contact with the inner surface of the tip holding portion. To achieve this, the surface roughness of the inner surface of point assembly 111 that holds tip ball 112, the ground finish of the inner surface for improving precision of the sealing contact by press-fitting and the secondary plastic process for improving accuracy of press-fitting should be considered. Further, the surface treatment etc. of the contact surface with tip ball 112 should be considered.

A straight rod portion 115 is extended forwards from spring 114. The front end of this rod portion 115 abuts the rear side of tip ball 112 to press it. This pressure causes tip ball 112 to come in sealing contact with the inner brim of the ball holding portion (formed by press-fitting etc.) of point assembly 111.

A joint 102 is integrally formed of a resin molding which comprises a front pipe portion (corresponding to 'a portion to be press-fitted to the rear end of the point assembly' of the invention) 103 at the front end thereof which will be press-fitted to pipe portion 113 of point assembly 111; rear pipe portion (corresponding to 'a portion to be press-fitted to the ink reservoir' of the invention) 105 which will be press-fitted to the front end of an ink reservoir 117; and a flexible portion, e.g. a bellows 104 which is provided between the front pipe portion 103 and rear pipe portion 105. Provided in the rear of a bore 110 of front pipe portion 103 is a valve chamber 107 in which a ball valve 116 is placed with play. In the rear of valve chamber 107, a ball seat 108 of a tapered or spherical form and a conduit 109 are formed. Valve chamber 107, ball seat 108 and conduit 109 are formed adaptively eccentric relative to the axial center. The hollow of the aforementioned bellows 104 and rear pipe portion 105 is made to communicate with the bore of ink reservoir 117. A groove (not shown) which allows ink to flow in the axial direction is formed on one side of the inner wall of valve chamber 107. When point assembly 111 is oriented downwards, this ball valve 116 idly held inside valve chamber 107 will abut one-sidedly against the rear end of pipe portion 113 of point assembly 111 thereby forming an ink channel. Ink in ink reservoir 117 flows into the bore of point assembly 111 through conduit 109, the aforementioned groove and the ink flow passage etc. Conversely, when point assembly is oriented upward, ball valve 116 will abut the ball seat 108 to prevent backward leakage of ink.

Ink reservoir 117 is filled up with an ink 118 suitable for the ball-point pen elements 101*a* and 101*b*. Further, an ink follower 119 consisting of a translucent, nondrying greasy material is filled at the rear end of ink 118. This follower will move in contact with the ink surface following the consumption of the ink. In order to prevent deformation due to impacts from being dropped or clicking, a resin-made follower rod 120 having a specific weight substantially equal to that of follower 119 may be immersed in follower 119, as required.

The aforementioned ink reservoir 117 uses a molding of, for example, transparent PP (polypropylene) resin etch, and should be formed from a material that has good clear-drain performance. Further, ink reservoir 117 may be integrally formed with joint 102.

The ink reserving portion of ink reservoir 117 is non-flexible and has a relatively large cross-section. In the first embodiment, this portion has an almost D-shaped section so that it can be fitted in the middle barrel 130 without forming useless space. The portion for jointing the point assembly 111 with the ink reserving portion should be formed so as to readily be deflected transversely with respect to the axial direction. It is also possible to provide a flexible tube which connects the ink reservoir with the joint which is press-fitted to the rear end of point assembly 111.

Operation and Effect of the First Embodiment

When rear barrel 150 is rotated relative to middle barrel 130, this rotation causes the cylindrical cam 134 to turn. Then, one of the writing elements will be selected by slanting cam surface 135 and the writing tip part can be projected out from the front end opening of front barrel 152. Although the ink reserving portion of ball-point pen element 101*a* or 101*b* is non-flexible, the front part of the writing element will be able to flexibly deflect at bellows 104. Therefore, without being impeded, the writing tip part can be projected and retracted smoothly from the front end opening of front barrel 152. When the mechanical pencil element is selected, the rear end of rear barrel should be pushed to deliver lead. When the eraser is to be used, crown 144 at the rear end of inner cylinder 143 should be rotated.

This rotation causes eraser holder 147 to move backwards whilst being guided along spiral groove 138 of cylindrical cam 134 and slits 145 of inner cylinder 143. In this way, eraser 156 will be delivered from the rear end.

As to ball-point pen elements 101*a* and 101*b*, when the point assembly 111 is oriented upward, ball valve 116 will be placed on ball seat 108 in valve chamber 107 to seal conduit 109. Therefore, even if the ink right below tip ball 112 in point assembly 111 is used up during upward writing, any head which would cause backward leaking, will not be exerted on ink. Consequently, as soon as point assembly 111 is turned down again, ink will become ready to flow out and thus ink starving during writing can be prevented. In this connection, if a structure without any ball valve is used for upward writing, the weight of ink acts in the direction of causing backward leaking and draws air into point assembly. Therefore, when the element is returned to the position of downward writing, ink cannot follow immediately, thereby causing ink starving.

In the writing state where point assembly 111 is oriented downward, ball valve 116 abuts the rear end of point assembly 111 at its one side so that an ink channel through which ink can be flowed into point assembly 111 is assured on the opposite side. In this way, ink 118 which has entered valve chamber 107 from ink reservoir 117 through conduit 109 will be brought to the backside of tip ball 112.

In this condition, since tip ball 112 is pressed forwards by rod portion 115 so that the ball comes into sealing contact with the inner brim of the tip holding portion, it is possible to prevent forward leaking of ink. When tip ball 112 is slightly moved backwards by the writing pressure, a gap which allows ink to flow out can be created. As tip ball 112 rotates during writing, ink flows out smoothly without causing any blobbing. Thus, it becomes possible to create line traces with thick line density.

Channels (a plurality of ink flowing channels which pass through toward the bore of the point assembly are provided on the ball seat for the tip ball) are formed behind tip ball 112, and rod portion 115 is disposed through the central hole around which the channels are formed. Ink inside point assembly 111 will be brought to the backside of tip ball 112 through ink flowing channels and the gap between the central hole and rod portion 115.

Configuration of the Second Embodiment

Figure 5:
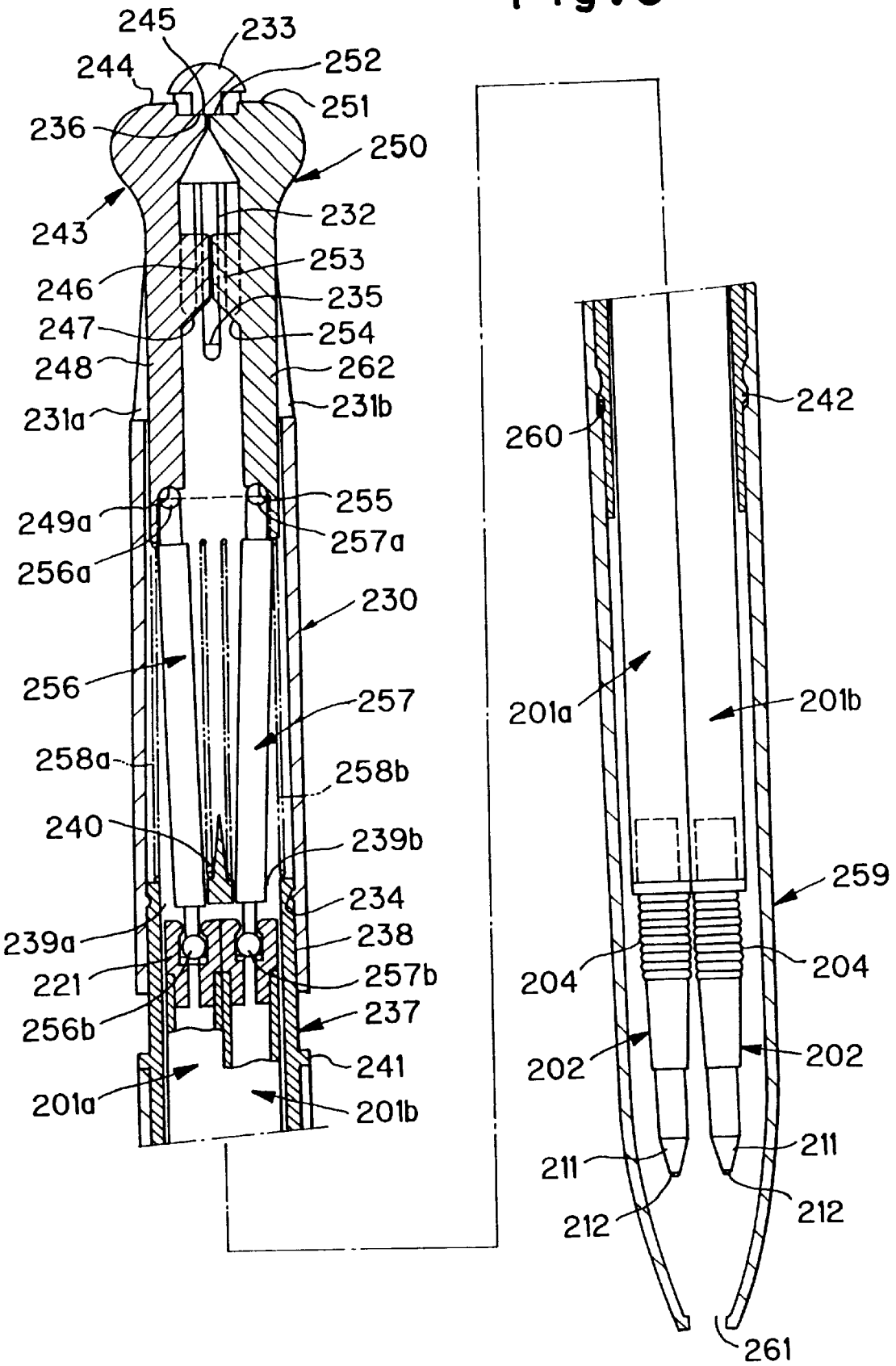
FIG. 5 is a vertical sectional view showing the overall structure of a multiplex writing implement with its writing tip portion retracted, in accordance with the second embodiment of the invention.
Figure 6:
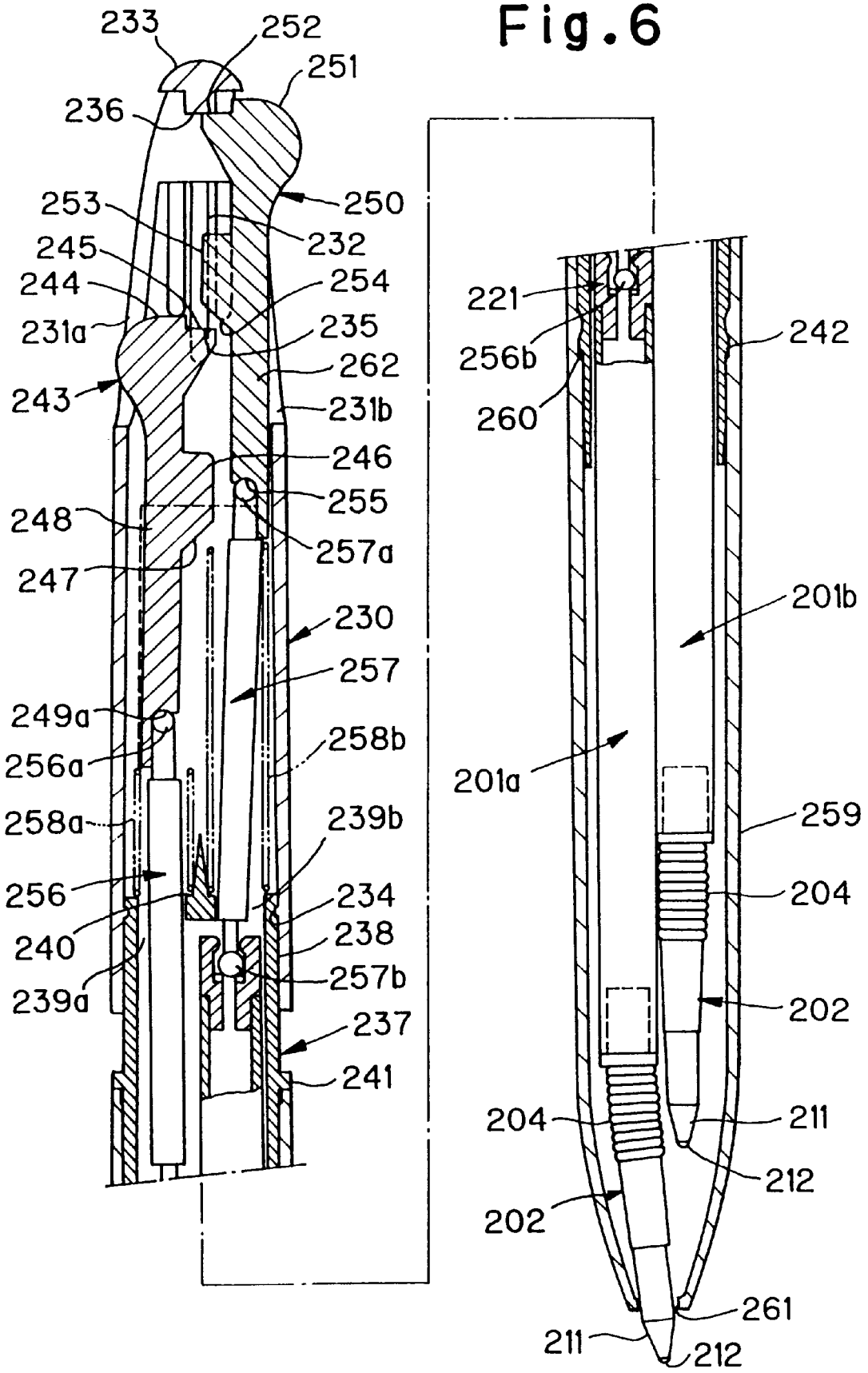
FIG. 6 is a vertical sectional view showing the condition in which the writing tip portion of one ball-point pen element is projected from the front opening of the front barrel, in accordance with the second embodiment of the invention.

First, FIGS. 5 through 8 show the second embodiment of the invention. A barrel cylinder is composed of a front barrel 259 and a rear barrel 230. As shown in FIGS. 5 and 6, rear barrel 230 has two longitudinal slots 231*a* and 231*b* which extend up to a rear end portion 233. The rear barrel further has an inside partition 232. An abutment 236 is defined by rear end portion 233 of rear barrel 230 and the rear ends of longitudinal slots 231*a* and 231*b*. The front end of partition 232 forms a stopper 235. Formed on the inner wall at the front part of rear barrel 230 is an engaging projection 234 which catches a joint 237 (to be referred to hereinbelow) so that the rear barrel will be able to shift back and forth (or in the axial direction) relative to the joint.

Figure 9:
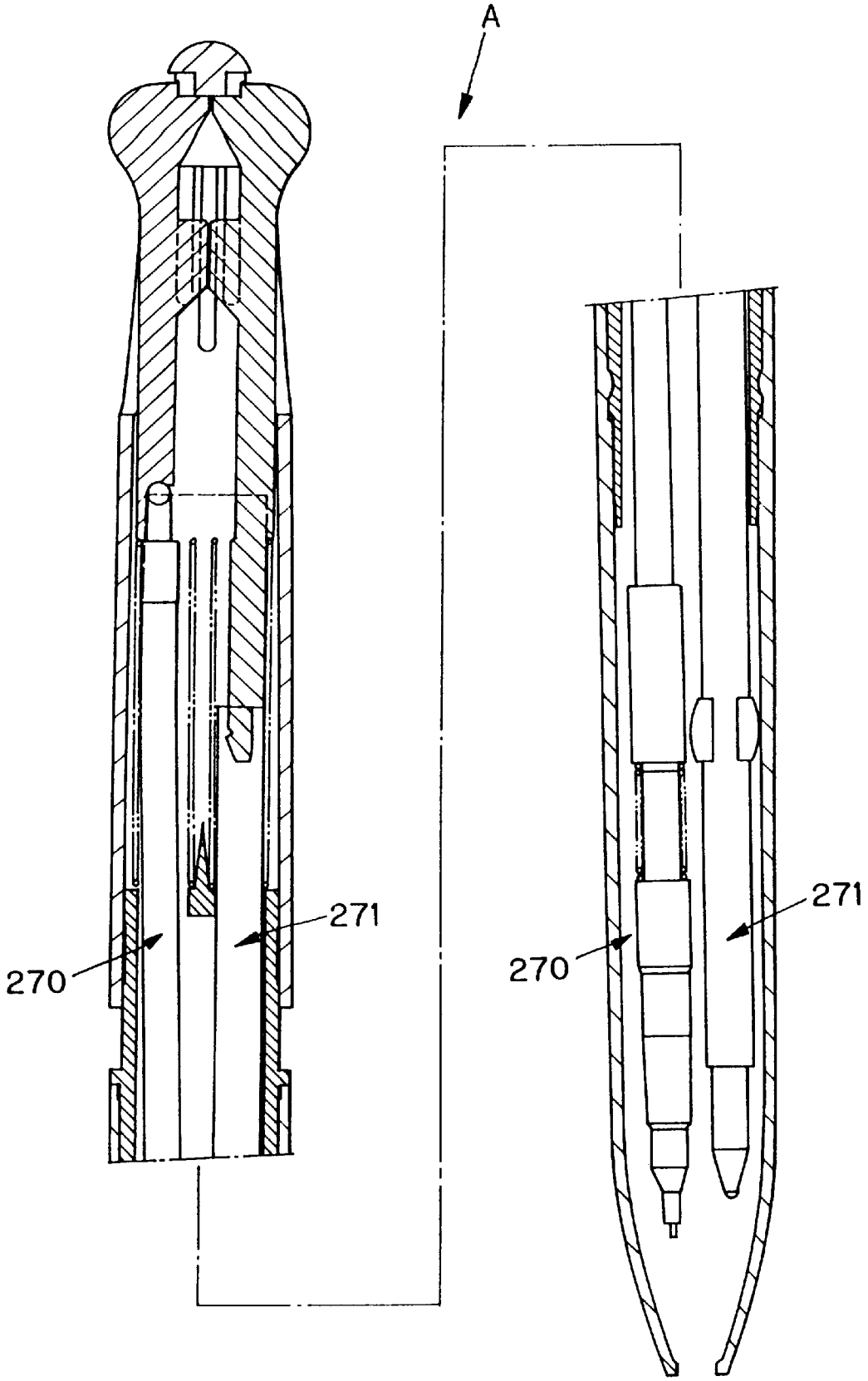
Fig.9 PRIOR ART
FIG. 9 is a vertical sectional view showing the overall structure of a prior art multiplex writing implement having a mechanical pencil element and a normal oil-based ball-point pen element with their writing tip portions retracted.
Figure 10:
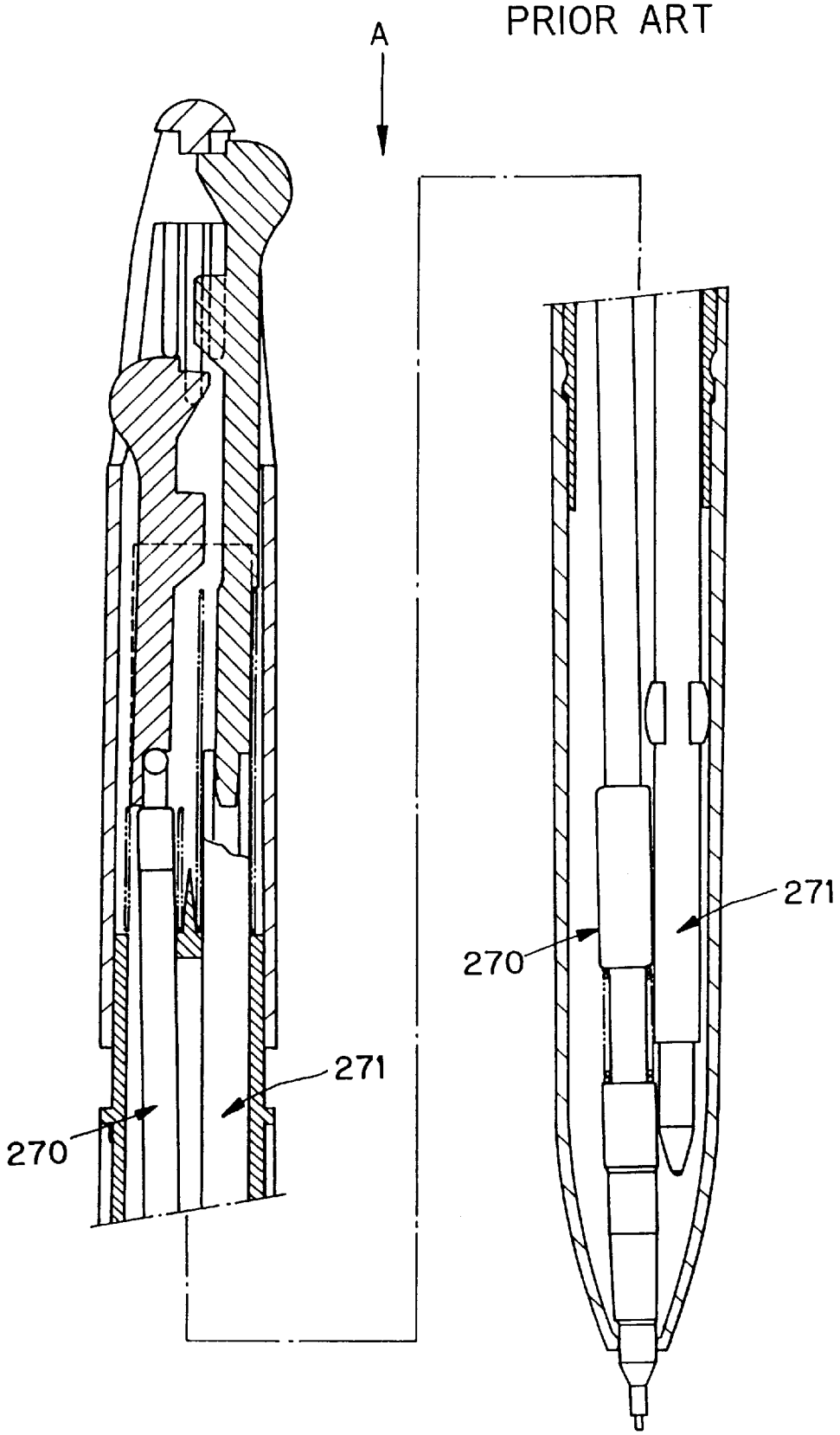
Fig.10 PRIOR ART
FIG. 10 is a vertical sectional view showing a prior art multiplex writing implement in which the writing tip portion of a mechanical pencil element is projected from the front opening of the front barrel.

This axially shifting mechanism of joint 237 relative to rear barrel 230 is not a necessary feature of the invention. Nevertheless, if a mechanical pencil element 270 and a normal oil-based ball-point pen element 271 are incorporated as in a conventional multiplex writing implement A shown in FIGS. 9 and 10, it is necessary to deliver lead of mechanical pencil element 270. This second embodiment is devised so that it can be used interchangeably for both cases.

The aforementioned joint 237 is composed of two portions, namely front-half and rear-half pipe portions. The rear-half pipe portion has a rear end 240 through which two through-holes 239*a* and 239*b* are formed, and further has a grooved engaging portion 238 on the rear outer peripheral side. Engaging projection 234 of rear barrel 230 is elastically fitted into this groove so that the rear barrel can move in the axial direction. The joint has a flange portion 241 at a substantially halfway thereof. The front-half pipe portion has a connecting portion 242 in the front part for detachably attaching a front barrel 259 (to be described later). Rear barrel 230 is attached to joint 237 by elastically fitting engaging projection 234 into engaging portion 238. For this attachment, it is necessary to align longitudinal slots 231*a* and 231*b* of rear barrel 230 with corresponding through-holes 239*a* and 239*b* of joint 237, respectively. Therefore, rear barrel 230 and joint 237 should be jointed axially movably but fixed to each other in rotational direction. For this purpose, there are various methods; as an example, a plurality of rectangular ribs may be formed on the rear pipe portion behind flange portion 241 of joint 237 while engaging grooves which will mate the ribs may be formed in the front part of rear barrel 230.

Figure 8:
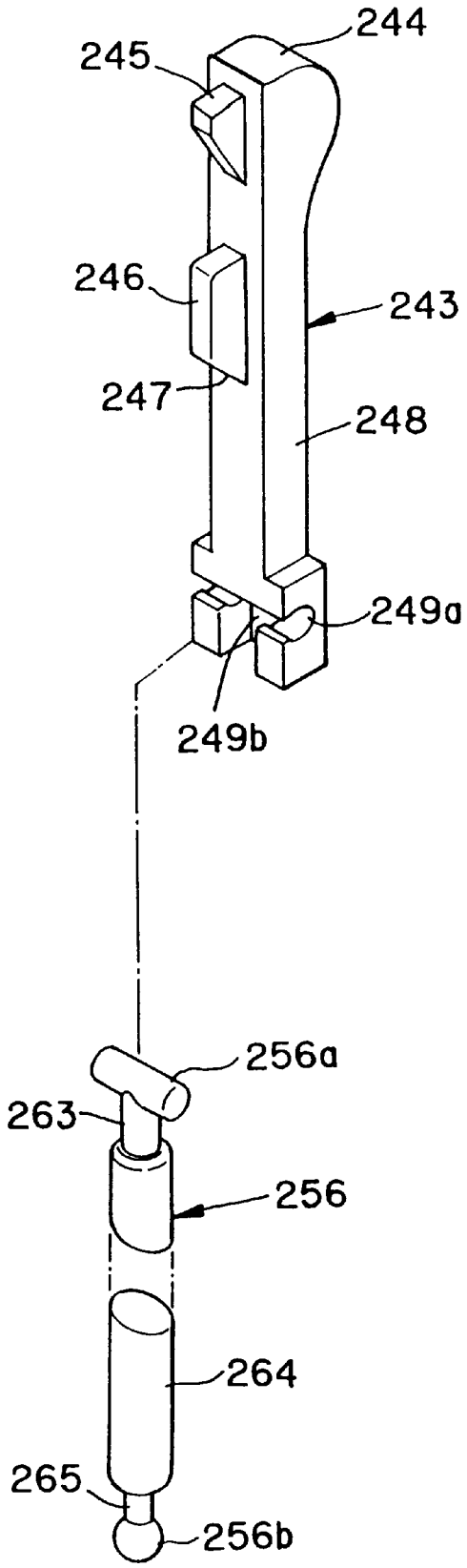
FIG. 8 is a perspective view showing the structure of a clicking portion and a joint in accordance with the second embodiment.

One click portion 243 (there are two click portions 243 and 250) has a plate-like rod portion 248, as shown in FIG. 8, and its rear part has a rear end 244 which bulges to the outer side and a stepped engaging portion 245 which protrudes out to the inner side. A projection 246 to the inner side of the rod portion 248 is formed in the front of stepped portion 245. The lower side of this projection 246 is defined by a slant surface 247. Formed at the front part of rod portion 248 are lateral and longitudinal grooves 249*a* and 249*b* which are arranged substantially in the form of T.

A joint 256 is also shown in FIG. 8. In the rear part of joint 256, a rod portion 263 and a support rod 256*a* are arranged substantially in the form of T. The joint further has a relatively long rod portion 264 whose diameter becomes large as it approaches its front end. A support rod 256*a* whose diameter is somehow smaller is attached to the front end of rod portion 264. A spherical part 256*b* which is somewhat bulging is supported by the support rod 256*a*. Pipe portion 263 is fitted in the aforementioned longitudinal groove 249*b* while support rod 256*a* is socketed into lateral groove 249*a* so that joint 256 will be able to properly rotate about the axis of the support rod 256*a*.

Attached to spherical part 256*b* of joint 256 is the rear end of a ball-point pen element 201*a* to be referred to hereinbelow. The other click portion 250 and its joint 257 are configured in the same manner as above so that detailed description will be omitted.

Attached to spherical portion 256*b* of joint 256 and spherical portion 257*b* of joint 257 are the rear ends of ball-point pen elements 201*a* and 201*b* having different colors and producing different line widths. These ball-point pen elements 201*a* and 201*b* are fitted in longitudinal slots 231*a* and 231*b* of rear barrel 230 and inserted into through-holes 239*a* and 239*b*, respectively. Further, return springs 258*a* and 258*b* are interposed between the front ends of rod portions 248 and 262 of the aforementioned click portions 243 and 250, and the rear end 240 of joint 237. In this way, ball-point pen elements 201*a* and 201*b* are assembled inside the barrel cylinder.

Further, the front part of joint 237 is detachably attached to front barrel 259 by mutually elastic deformation. That is, the front barrel has a grooved connecting portion 260 at the rear part of the inner wall thereof, and this groove will be snap fitted with projected connecting portion 242. The connection between joint 237 and front barrel 259 should properly be prevented from being separated from each other, and is preferably prevented from being rotated. As an example to achieve this, ribs with partial grooves should be formed on one of the above elements while mating grooves with partial ribs should be formed on the other. Alternatively, the two elements may be joined by screw-fitting. Although a configuration with two writing elements was illustrated in the above description of the second embodiment, a writing implement which includes three or more writing elements may be designed.

Next, ball-point pen element 201*a* to be incorporated in the multiplex writing implement of the invention will be described. Here, two ball-point pen elements 201*a* and 201*b* have the same structure, and differ in the color of ink, the line width, etc.

Ink used for these ball-point pen elements 201*a* and 201*b* is so-called thixotropic water-soluble or low-viscosity oil-based ball-point ink.

Figure 7:
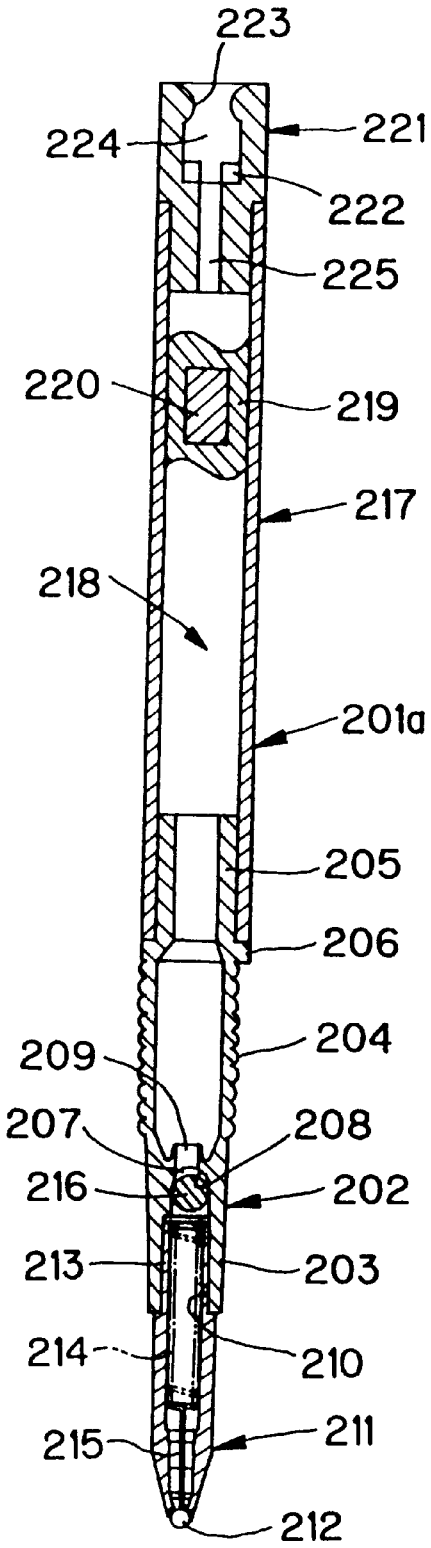
FIG. 7 is a vertical sectional view showing a ball-point pen element in accordance with the second embodiment.

As shown in FIG. 7, a point assembly 211 is constructed so that a tip ball 212 is substantially abutted onto a seat having channels which will permit ink to flow in, and is held rotatably by a front press-fitted portion. Further, a spring 214 is inserted into the bore of point assembly 211. The rear end of a pipe portion 213 of point assembly 211 is properly press-fitted so that the rear part of spring 214 will not come out. In order to prevent dryout of the writing point and the forward leakage of ink, it is very important to bring tip ball 212 into sealing contact with the inner surface of the tip holding portion. To achieve this, the surface roughness of the inner surface of point assembly 211 that holds tip ball 212, the ground finish of the inner surface for improving precision of the sealing contact by press-fitting and the secondary plastic process for improving accuracy of press-fitting should be considered. Further, the surface treatment etc. of the contact surface with tip ball 212 should be considered.

A straight rod portion 215 is extended forwards from spring 214. The front end of this rod portion 215 abuts the rear side of tip ball 212 to press it. This pressure causes tip ball 212 to come in sealing contact with the inner brim of the ball holding portion (formed by press-fitting etc.) of point assembly 211.

A joint 202 is integrally formed of a resin molding which comprises: a front pipe portion 203 at the front end thereof which will be press-fitted to pipe portion 213 of point assembly 211; an rear pipe portion 205 which will be press-fitted to the front end of an ink reservoir 217; and a flexible portion, e.g. a bellows 204 which is provided between the front pipe portion 203 and rear pipe portion 205. Provided in the rear of a bore 210 of front pipe portion 203 is a valve chamber 207 in which a ball valve 216 is placed with play. In the rear of valve chamber 207, a ball seat 208 of a tapered or spherical form and a conduit 209 are formed. Valve chamber 207, ball seat 208 and conduit 209 are formed adaptively eccentric relative to the axial center. The hollow of the aforementioned bellows 204 and rear pipe portion 205 is made to communicate with the bore of ink reservoir 217. A groove (not shown) which allows ink to flow in the axial direction is formed on one side of the inner wall of valve chamber 207. When point assembly 211 is oriented downwards, this ball valve 216 idly held inside valve chamber 207 will abut one-sidedly against the rear end of pipe portion 213 of point assembly 211 thereby forming an ink channel. Ink in ink reservoir 217 flows into the bore of point assembly 211 through conduit 209, the aforementioned groove and the ink flow passage etc. Conversely, when point assembly is oriented upward, ball valve 216 will abut the ball seat 208 to prevent backward leakage of ink.

Ink reservoir 217 is filled up with an ink 218 suitable for the aforementioned ball-point pen elements 201*a* and 201*b*. Further, an ink follower 219 consisting of a translucent, nondrying greasy material is filled at the rear end of ink 218. This follower will move in contact with the ink surface following the consumption of the ink. In order to prevent deformation due to impacts from being dropped or clicking, a resin-made follower rod 220 having a specific weight substantially equal to that of follower 219 may be immersed in follower 219, as required.

The aforementioned ink reservoir 217 uses a molding of, for example, transparent PP resin etc., and should be formed from a material that has good clear-drain performance. Further, ink reservoir 217 may be integrally formed with joint 202.

A tail plug 221 is fixed to the rear end hole of ink reservoir 217. Tail plug 221 has a small hole 225 which connect the bore of ink reservoir 217 with the outside, and a hollowed portion 224 behind the small hole 225. This hollowed portion 224 is to receive spherical part 256*b* of the aforementioned joint 256. The tail plug further has a stepped portion which the spherical part 256*b* will abut. This stepped portion has a groove 222 so as to assure the ventilation to the small hole 225. Further, the rear end of hollowed portion 224 is formed with a protruded portion 223 which will detachably catch spherical part 256*b*. Here, this spherical part 256*b* will be able to move relative to tail plug 221.

The ink reserving portion of ink reservoir 217 is non-flexible and has a relatively large cross-section. For example, this portion has an almost D-shaped section so that it can be fitted in the front barrel 259 without forming useless space (not shown). The portion for jointing the point assembly 211 with the ink reserving portion should be formed so as to readily be deflected transversely with respect to the axial direction. It is also possible to provide a flexible tube which connects the ink reservoir with the joint which is press-fitted to the rear end of point assembly 211.

Operation and Effect of the Second Embodiment

FIG. 5 shows the accommodated state of writing tip portions. First, as shown in FIG. 6, when rear end 244 of click portion 243 is clicked toward the front barrel, stepped engaging portion 245 is engaged with stopper 235 of partition 232 in rear barrel 230. Thus, the writing tip portion of ball-point pen element 201*a* is projected out from a front end opening 261 of front barrel 259.

During this operation, since bellows 204 of joint 202 is flexed readily, the writing tip portion can be projected smoothly. In this state, when rear end 251 of click portion 250 is clicked forwards, slant surface 254 of projection 253 pushes out the stepped engaging portion 245 so that the engagement between stepped engaging portion 245 and stopper 235 is released. Then, click portion 243 moves backwards and the writing tip portion of ball-point pen element 201*a* retracts from front end opening 261 of front barrel 259, while the other stepped engaging portion 252 of click portion 250 engages stopper 235 and the writing tip portion of the other ball-point pen element 201*b* projects out from front end opening 261. In this connection, to accommodate both the writing tip portions inside as shown in FIG. 5, from, for example, the state of FIG. 6, click portion 250 should be pressed up to a position where slant surface 254 of projection 253 will abut stepped engaging portion 245 of click portion 243 and release the between stepped engaging portion 245 and stopper 235.

As to ball-point pen elements 201*a* and 201*b*, when the point assembly 211 is oriented upward, ball valve 216 will be placed on ball seat 208 in valve chamber 207 to seal conduit 209. Therefore, even if the ink right below tip ball 212 in point assembly 211 is used up during upward writing, any head which would cause backward leaking, will not be exerted on ink. Consequently, as soon as point assembly 211 is turned down again, ink will become ready to flow out and thus ink starving during writing can be prevented. In this connection, if a structure without any ball valve is used for upward writing, the weight of ink acts in the direction of causing backward leaking and draws air into point assembly. Therefore, when the element is returned to the position of downward writing, ink cannot follow immediately, thereby causing ink starving.

In the writing state where point assembly 211 is oriented downward, ball valve 216 abuts the rear end of point assembly 211 at its one side so that an ink channel through which ink can be flowed into point assembly 211 is assured on the opposite side. In this way, ink 218 which has entered valve chamber 207 from ink reservoir 217 through conduit 209 will be brought to the backside of tip ball 212.

In this condition, since tip ball 212 is pressed forwards by rod portion 215 so that the ball comes into sealing contact with the inner brim of the tip holding portion, it is possible to prevent forward leaking of ink. When tip ball 212 is slightly moved backwards by the writing pressure, a gap which allows ink to flow out can be created. As tip ball 212 rotates during writing, ink flows out smoothly without causing any blobbing. Thus, it becomes possible to create line traces with thick line density.

Channels (a plurality of ink flowing channels which pass through toward the bore of the point assembly are provided on the ball seat for the tip ball) are formed behind tip ball 212, and rod portion 215 is disposed through the central hole around which the channels are formed. Ink inside point assembly 211 will be brought to the backside of tip ball 212 through ink flowing channels and the gap between the central hole and rod portion 215.

Configuration of the Third Embodiment

Figure 11:
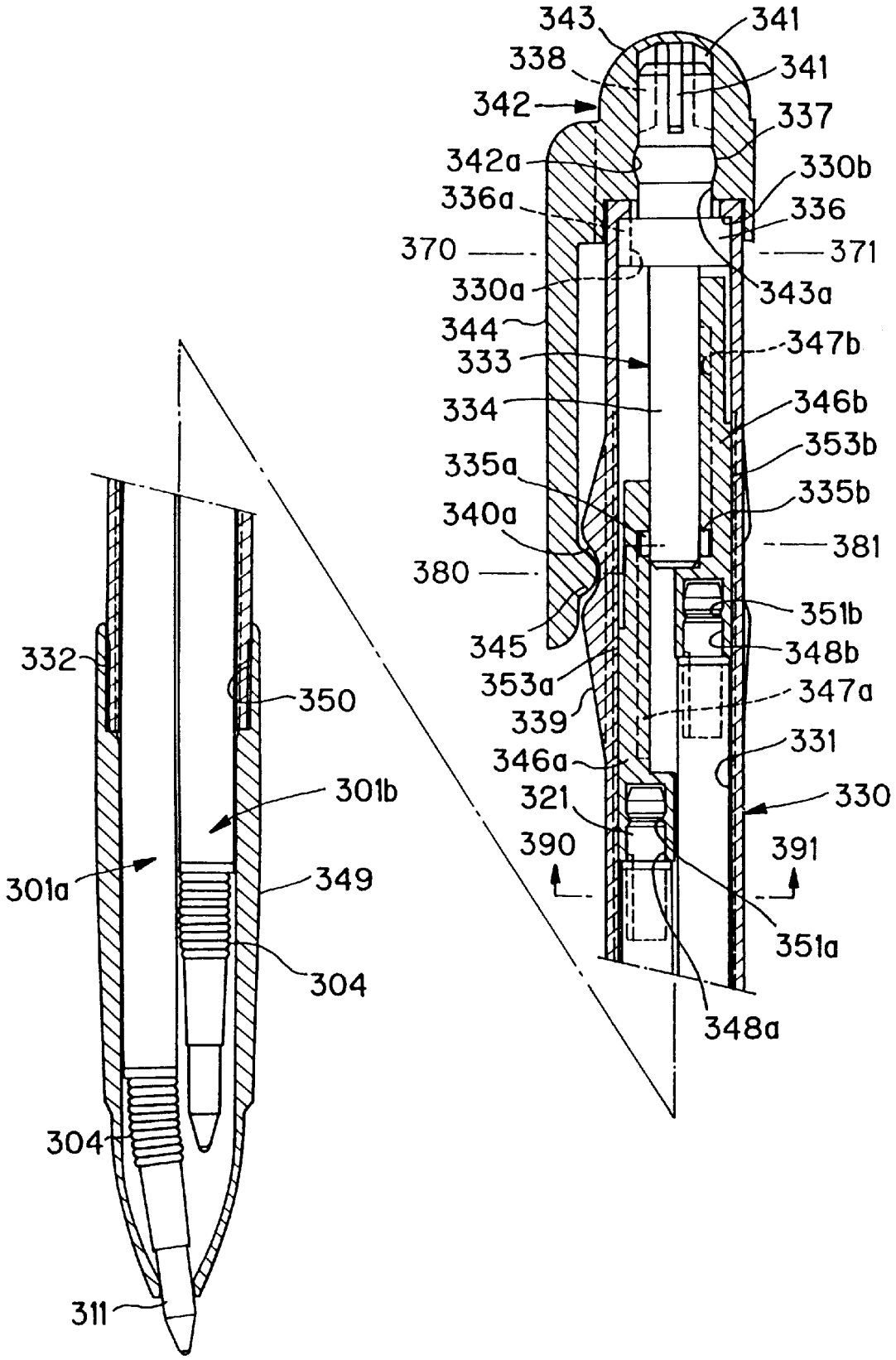
FIG. 11 is a vertical sectional view showing the overall structure of a multiplex writing implement of a first example in accordance with the third embodiment of the invention, where two kinds of ball-point elements are incorporated and a part of the view is in the non-sectional representation.
Figure 12:
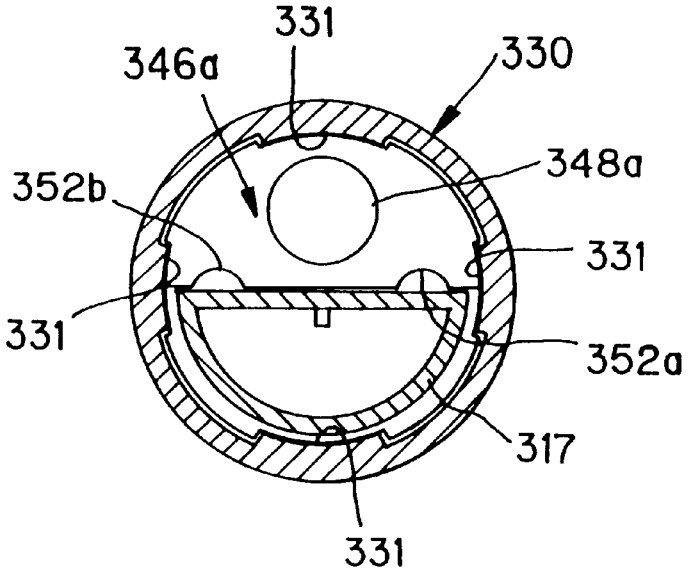
FIG. 12 is a sectional view taken on a line 390–391 in FIG. 11, showing the condition where the sliding pieces have no writing element attached.

FIGS. 11 through 19 show a first example of the third embodiment of the invention. A barrel cylinder is composed of a front barrel 349 and a rear barrel 330. In FIG. 11, two ball-point pen elements 301*a* and 301*b* are provided.

The multiplex writing implement of FIG. 11 comprises: front barrel 349 which accommodates a writing-instrumental mechanism which is positioned in the front part; rear barrel 330; and an operating handle 342 disposed in the rear end of rear barrel 330. A female thread 350 is formed on the inner periphery at the rear part of front barrel 349, whereas a male thread 332 is formed in the front part of rear barrel 330. The male thread is screwed into female thread 350 of front barrel 349 and can be removed therefrom as required, such as writing elements should be replaced. A rotation-stopper rib 330*a* which will restrict the rotating range of a rotary shaft 333 to be referred to hereinbelow and a stepped portion 330*b* are formed on the inner periphery at the rear end of the bore of rear barrel 330. Four guide ribs 331 are formed in the axial direction, 90° apart from one another on the front inner periphery of rear barrel 330.

Further, three mound-like raised portions 339 are formed on the outer periphery of rear barrel 330, rather near to the rear end. Two of them have depressed portions 340*a* and 340*b* in the center of raised portions 339.

Rotary shaft 333 has a small-diametric portion 334 in the front of a large-diametric portion 336. A projection 335*a* is formed on the peripheral surface in the front part of small-diametric portion 334, and another projection 335*b* is formed on the other opposite side. Rotary shaft 333 has a cylindrical portion having a reduced diameter in the rear of the large-diametric portion 336. This cylindrical portion has a radially projected engaging portion 337 on the outer periphery in the front part thereof and further has rotation-stopper grooves 338 at desired positions in the rear end thereof. Provided on the peripheral surface of the aforementioned large-diametric portion 336 is a groove 336*a* which is engaged with the aforementioned rib 330*a* to limit the rotation of rotary shaft 333 to a range of about 120° relative to rear barrel 330.

Operating handle 342 is composed of a crown 343, a clip 344 which extends forwards from one peripheral part of crown 343. Provided on the inner side in the front part of clip 344 is a bead 345. Crown 343 has a hollow 343*a* formed in the front part thereof. The inside wall surface of hollow 343*a* has an annular engaging groove 342*a* formed in the front inner peripheral surface and rotation-stopper ribs 341 formed in the rear peripheral surface at required number.

Provided at the front ends of sliding pieces 346*a* and 346*b* are insert holes 348*a* and 348*b*, which have inwardly projected engaging portions 351*a* and 351*b* for catching the rear ends of ball-point pen elements 301*a* and 301*b* (which will be described later), respectively. Cam grooves 347*a* and 347*b* are formed on the inner peripheral sides of the sliding pieces behind the insert holes. These cam grooves 347*a* and 347*b* receive urging forces exerted by projections 335*a* and 335*b* as they turn with the rotation of rotary shaft 333 so that respective sliding pieces 346*a* and 346*b* can move forwards or backwards. Formed on the outer peripheral sides of sliding pieces 346*a* and 346*b* are grooves 353*a* and 353*b* as rotation stoppers which engage the aforementioned guide ribs 331 of rear barrel 330.

Therefore, grooves 353*a* and 353*b* formed on the sides of sliding pieces 346*a* and 346*b* mesh corresponding guide ribs 331, whereby sliding pieces 346*a* and 346*b* will smoothly be moved forwards or backwards. The transverse cross sections of sliding pieces 346*a* and 346*b* are of substantially D-shape. Accordingly, it is an advantage that the conventionally used complicated structure which uses a guide cylinder having two opposing guide grooves is not needed.

Sliding pieces 346*a* and 346*b* come in contact with each other on their flat sides. In order to smoothen the sliding movement between the two, guiding projections 352*b* are provided for sliding piece 346*b* while guiding grooves 352*a* should be inserted into guiding projections 352*b* are formed in sliding piece 346*a*.

Then, the aforementioned sliding pieces 346*a* and 346*b* are engaged with projections 335*a* and 335*b*, respectively. In this state, rotary shaft 333 together with the sliding pieces is inserted into the bore of rear barrel 330 until the rear end of large-diametric portion 336 is abutted against stepped portion 330*b* of rear barrel 330. In this condition, the aforementioned operating handle 342 is attached to the rear cylindrical portion of rotary shaft 333.

For this attachment, engaging portion 337 becomes engaged with engaging groove 342*a* of crown 343 while rotation-stopper grooves 338 become fitted with rotation-stopper ribs 341 of crown 343. Thus, rotary shaft 333 and operating handle 342 will integrally be fixed to one another. In this arrangement, when operating handle 342 is turned relative to rear barrel 330 and therefore rotary shaft 333 rotates, one of the sliding pieces advances forwards, the other moves backwards. Attached to insert holes 348*a* and 348*b* of sliding pieces 346*a* and 346*b* are the rear ends of ball-point pen element 301*a* and 301*b*, respectively. Further, front barrel 349 is fixed to the front part of rear barrel 330.

Figure 20:
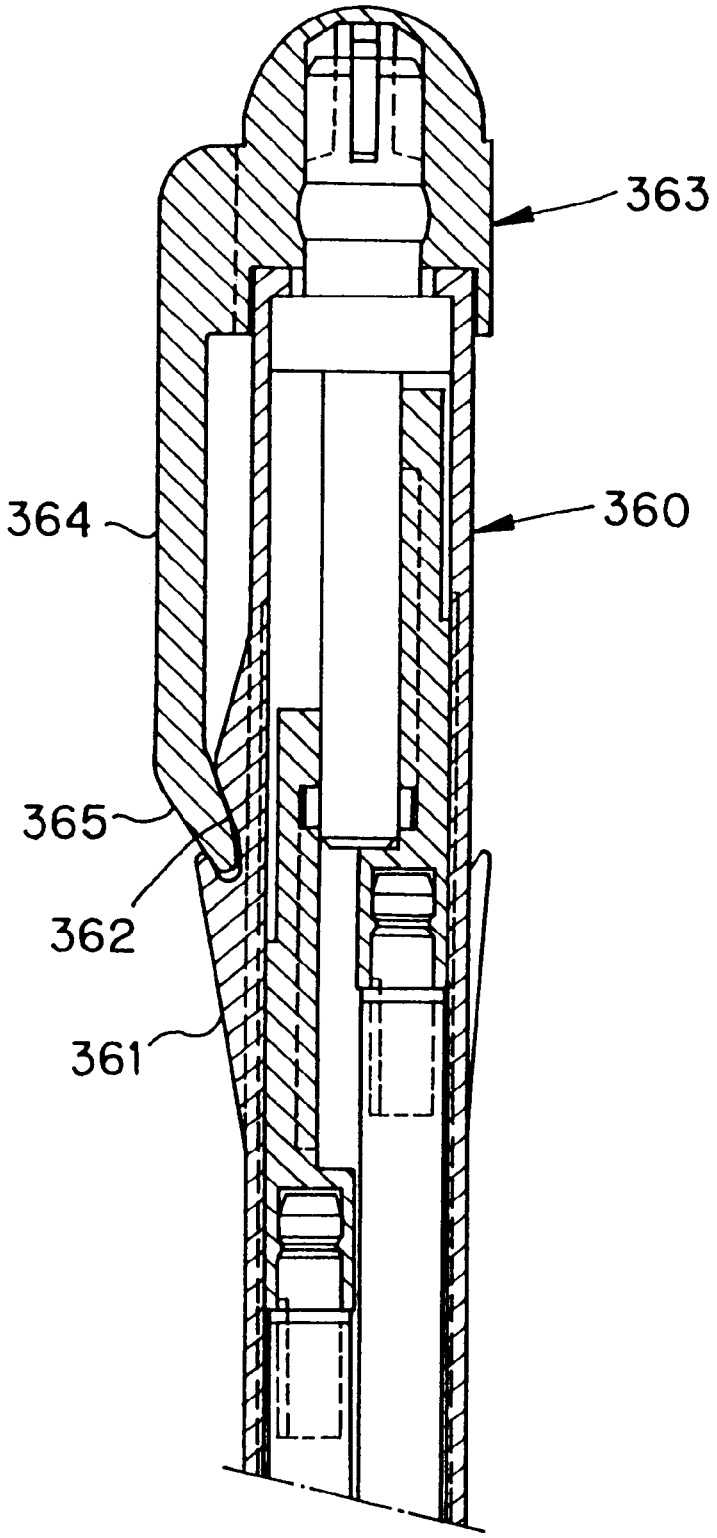
FIG. 20 is a vertical sectional view showing the rear half of a multiplex writing implement in a second example of the third embodiment, where a part of the view is in the non-sectional representation.

FIG. 20 shows a second example of the third embodiment. The basic structure of this example is the same as in the first example, and its difference from the first example will be explained in the description of operation hereinbelow.

Next, ball-point pen element 301*a* to be incorporated in the multiplex writing implement of this third embodiment will be described. Here, two ball-point pen elements 301*a* and 301*b* have the same structure, and differ in the color of ink etc. Ink used for these ball-point pen elements 301*a* and 301*b* is so-called thixotropic water-soluble or low-viscosity oil-based ball-point ink.

Figure 19:
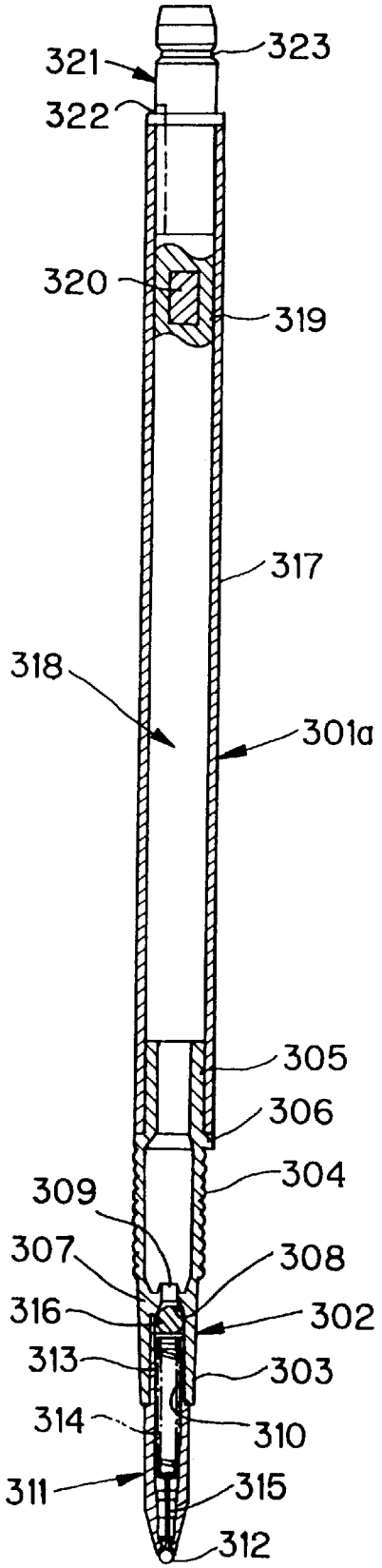
FIG. 19 is a vertical sectional view of a ball-point pen element in accordance with the first example of the third embodiment.

As shown in FIG. 19, a point assembly 311 is constructed so that a tip ball 312 is substantially abutted onto a seat having channels which will permit ink to flow in, and is held rotatably by a front press-fitted portion. Further, a spring 314 is inserted into the bore of point assembly 311. The rear end of a pipe portion 313 of point assembly 311 is properly press-fitted so that the rear part of spring 314 will not come out. In order to prevent dryout of the writing point and the forward leakage of ink, it is very important to bring tip ball 312 into sealing contact with the inner surface of the tip holding portion. To achieve this, the surface roughness of the inner surface of point assembly 311 that holds tip ball 312, the ground finish of the inner surface for improving precision of the sealing contact by press-fitting and the secondary plastic process for improving accuracy of press-fitting should be considered. Further, the surface treatment etc. of the contact surface with tip ball 312 should be considered.

A straight rod portion 315 is extended forwards from spring 314. The front end of this rod portion 315 abuts the rear side of tip ball 312 to press it. This pressure causes tip ball 312 to come in sealing contact with the inner brim of the ball holding portion (formed by press-fitting etc.) of point assembly 311.

A joint 302 is integrally formed of a resin molding which comprises: a front pipe portion 303 at the front end thereof which will be press-fitted to pipe portion 313 of point assembly 311; an rear pipe portion 305 which will be press-fitted to the front end of an ink reservoir 317; and a flexible portion, e.g. a bellows 304 which is provided between the front pipe portion 303 and rear pipe portion 305. Provided in the rear of a bore 310 of front pipe portion 303 is a valve chamber 307 in which a ball valve 316 is placed with play. In the rear of valve chamber 307, a ball seat 308 of a tapered or spherical form and a conduit 309 are formed. Valve chamber 307, ball seat 308 and conduit 309 are formed adaptively eccentric relative to the axial center. The hollow of the aforementioned bellows 304 and rear pipe portion 305 is made to communicate with the bore of ink reservoir 317. A groove (not shown) which allows ink to flow in the axial direction is formed on one side of the inner wall of valve chamber 307. When point assembly 311 is oriented downwards, this ball valve 316 idly held inside valve chamber 307 will abut one-sidedly against the rear end of pipe portion 313 of point assembly 311 thereby forming an ink channel. Ink in ink reservoir 317 flows into the bore of point assembly 311 through conduit 309, the aforementioned groove and the ink flow passage etc. Conversely, when point assembly is oriented upward, ball valve 316 will abut the ball seat 308 to prevent back leakage of ink.

Ink reservoir 317 is filled up with an ink 318 suitable for the aforementioned ball-point pen elements 301*a* and 301*b*. Further, an ink follower 319 consisting of a translucent, nondrying greasy material is filled at the rear end of ink 318. This follower will move in contact with the ink surface following the consumption of the ink. In order to prevent deformation due to impacts from being dropped or clicking, a resin-made follower rod 320 having a specific weight substantially equal to that of follower 319 may be immersed in follower 319, as required. A tail plug 321 is fixed to the rear end of ink reservoir 317. Formed in the rear cylindrical part of this tail plug 321 is an engaging groove 323 which is detachably caught by engaging portion 351*a* or 351*b* inside the insert hole in the front part of sliding piece 346*a* or 346*b*, respectively. Tail plug 321 further has a ventilation groove 322 which connects the inside of ink reservoir 317 with the outside air.

The aforementioned ink reservoir 317 uses a molding of, for example, transparent PP resin etc., and should be formed from a material that has good clear-drain performance. Further, ink reservoir 317 may be integrally formed with joint 302.

The ink reserving portion of ink reservoir 317 is non-flexible and has a relatively large cross-section. In this third embodiment, this portion has an almost D-shaped section so that it can be fitted in the rear barrel 330 without forming useless space (not shown). The portion for jointing the point assembly 311 with the ink reserving portion should be formed so as to readily be deflected transversely with respect to the axial direction. It is also possible to provide a flexible tube which connects the ink reservoir with the joint which is press-fitted to the rear end of point assembly 311.

Operation and Effect of the Third Embodiment

When the operating handle 342 is turned approximately 120° relative to rear barrel 330, rotary shaft 333 rotates and therefore projections 335*a* and 335*b* rotate along cam grooves 347*a* and 347*b* of sliding pieces 346*a* and 346*b*. With this rotation, one of the sliding pieces advances forwards, the other moves backwards. Thus, the writing tip portion of the ball-point pen element on the advancing side can be projected out from the front end opening of front barrel 349. Further, even if the ink reserving portions of ball-point pen elements 301*a* and 301*b* are non-flexible, the writing tip portion of the writing element will be able to flexibly deflect at bellows 304. Therefore, without being impeded, the writing tip part can smoothly be projected from and retracted into the front end opening of front barrel 349.

Figure 16:
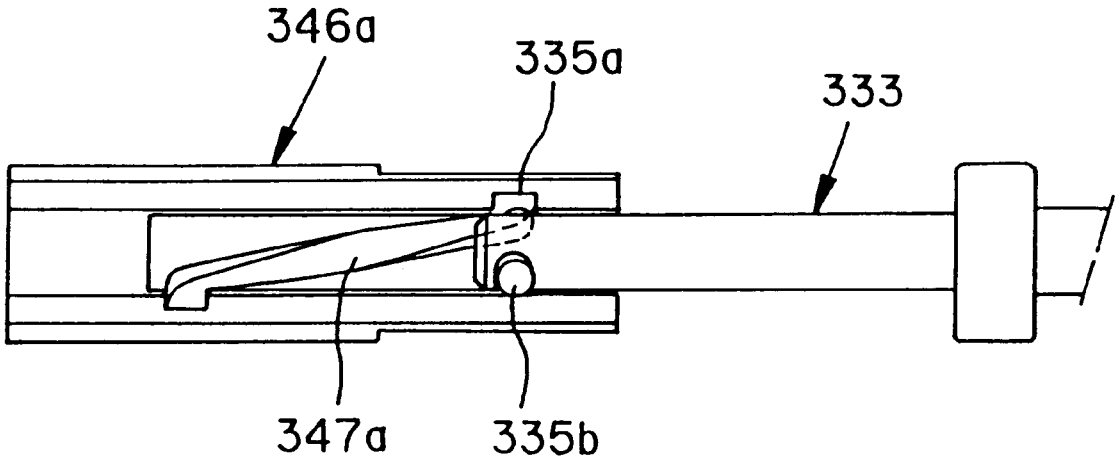
FIGS. 16 and 16*a* are illustrations showing the positional relations between a rotary shaft and sliding pieces where one of ball-point pen elements is projected as the rotary shaft is rotated, in the first example of the third embodiment.
Figure 16A:
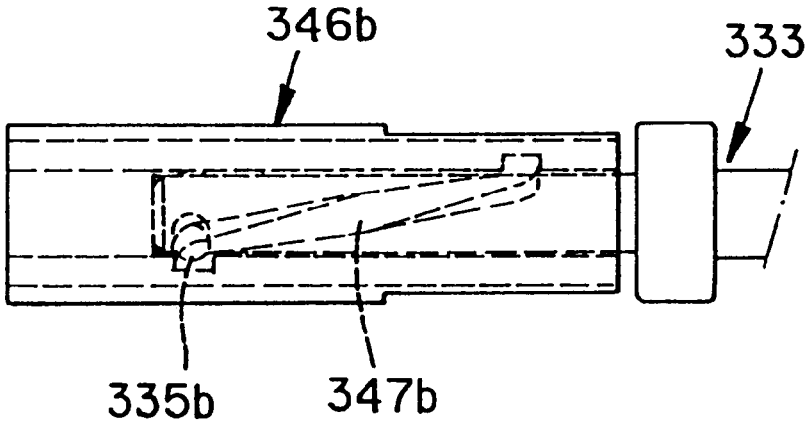
Figure 17:
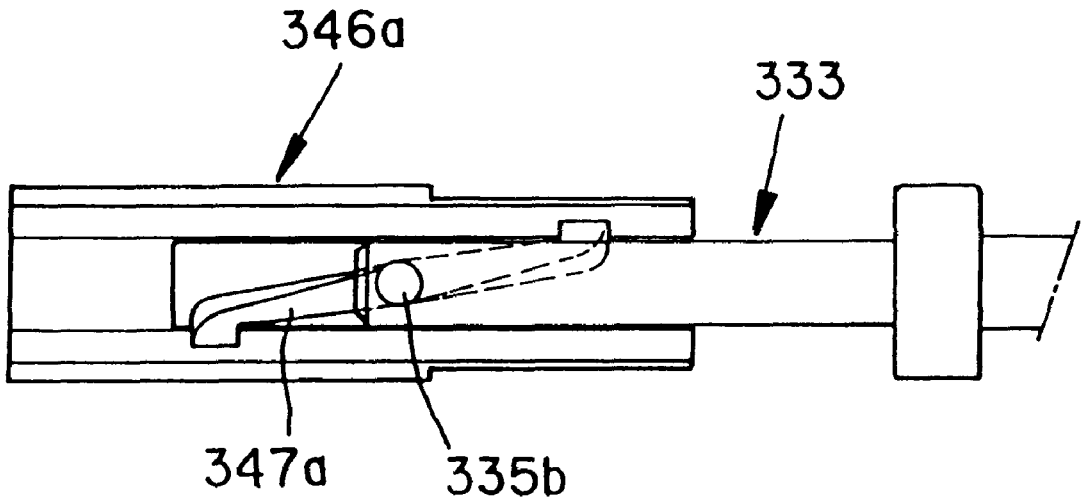
FIGS. 17 and 17*a* are illustrations showing the positional relations between a rotary shaft and sliding pieces where all ball-point pen elements are retracted as the rotary shaft is rotated, in the first example of the third embodiment.
Figure 17A:
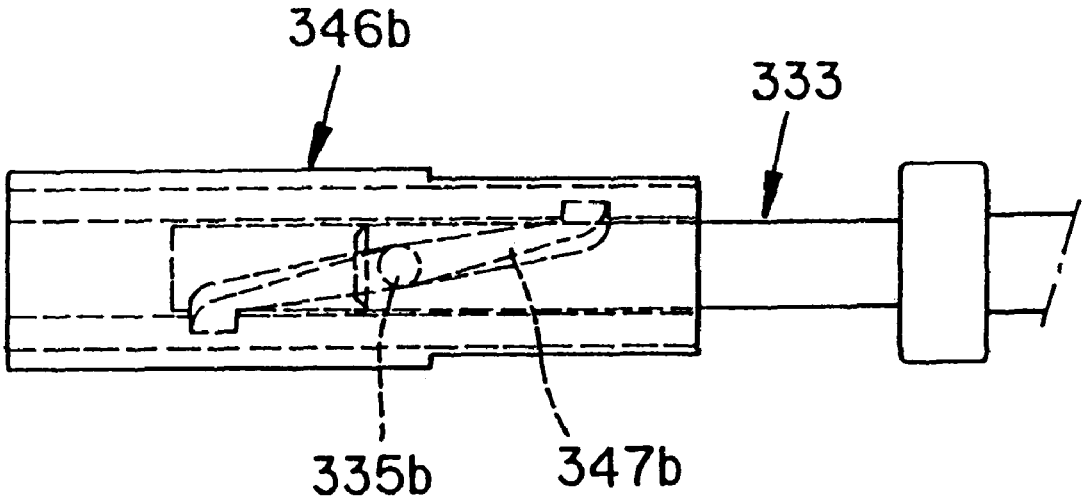
Figure 18:
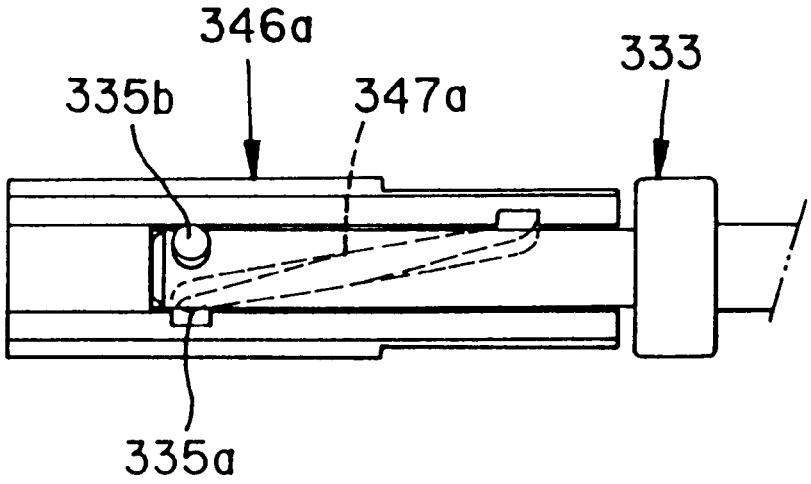
FIGS. 18 and 18*a* are illustrations showing the positional relations between a rotary shaft and sliding pieces where one of ball-point pen elements is projected as the rotary shaft is rotated, in the first example of the third embodiment.
Figure 18A:
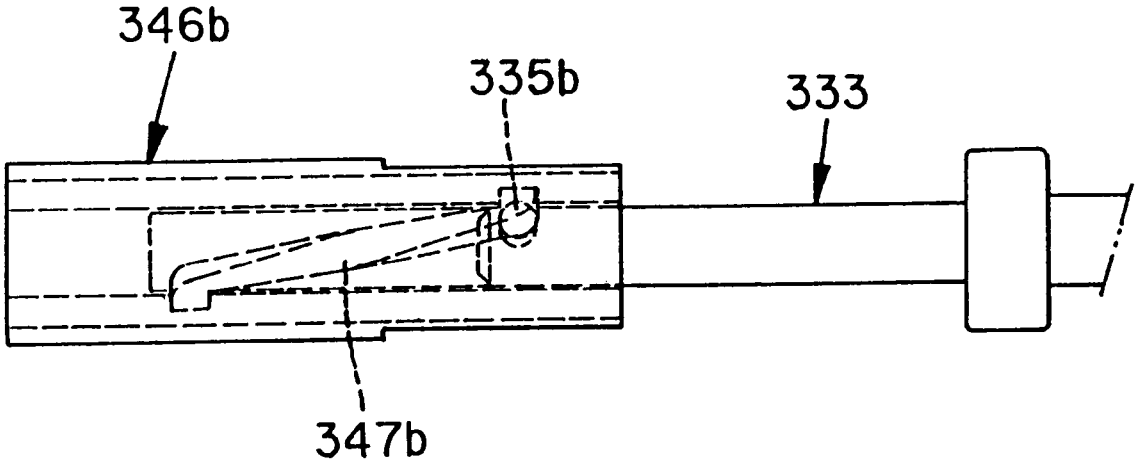

FIGS. 16 through 18 show the conditions where sliding pieces 346*a* and 346*b* move forwards and backwards relative to the rotation of rotary shaft 333. In the figures, since the outlines of sliding pieces 346*a* and 346*b* would overlap one another relative to rotary shaft 333, the drawings are separated for the description's convenience.

First, FIG. 11 shows a state where ball-point pen element 301*a* is projected. FIG. 16 shows the positional relationship of rotary shaft 333, sliding pieces 346*a* and 346*b*, corresponding to the state of FIG. 11. At that moment, rib 330*a* of rear barrel 330 abuts an abutment 336*b* of groove 336*a* formed on large-diametric portion 336 of rotary shaft 333 so that a rotation in one direction will be restricted (see FIG. 14).

Figure 13:
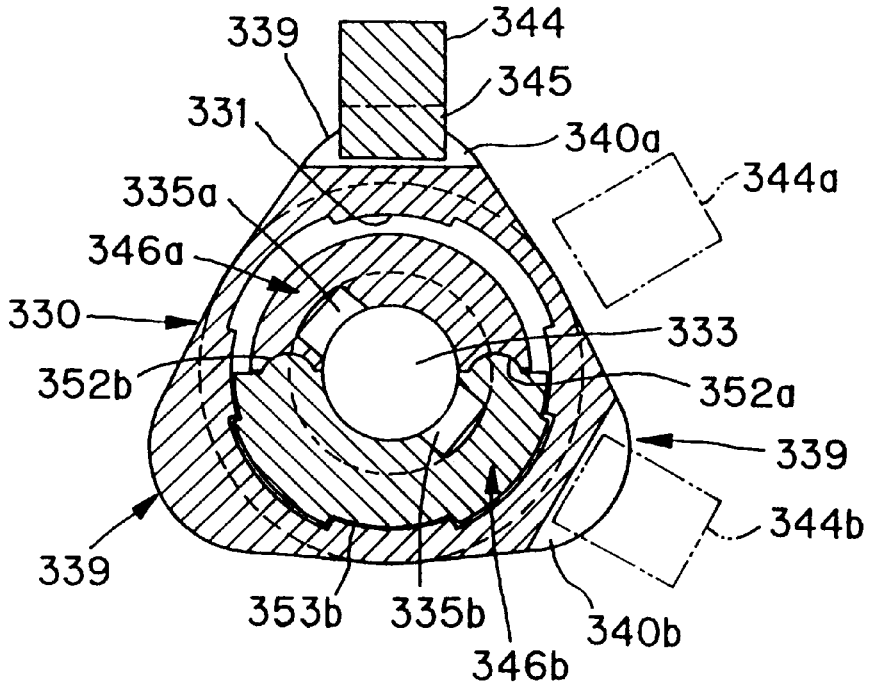
FIG. 13 is a sectional view taken on a line 380–381 in FIG. 11, showing various positions of a clip as an operating handling is rotated.
Figure 14:
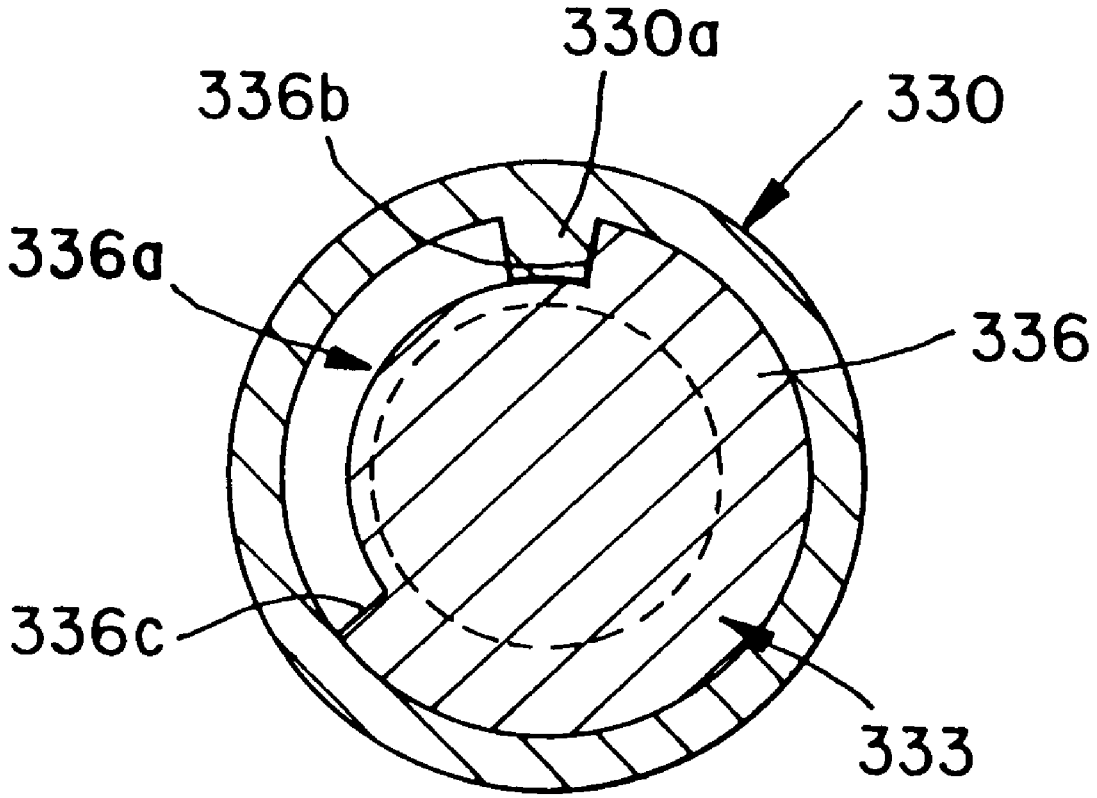
FIG. 14 is a sectional view taken on a line 370–371 in FIG. 11.
Figure 15:
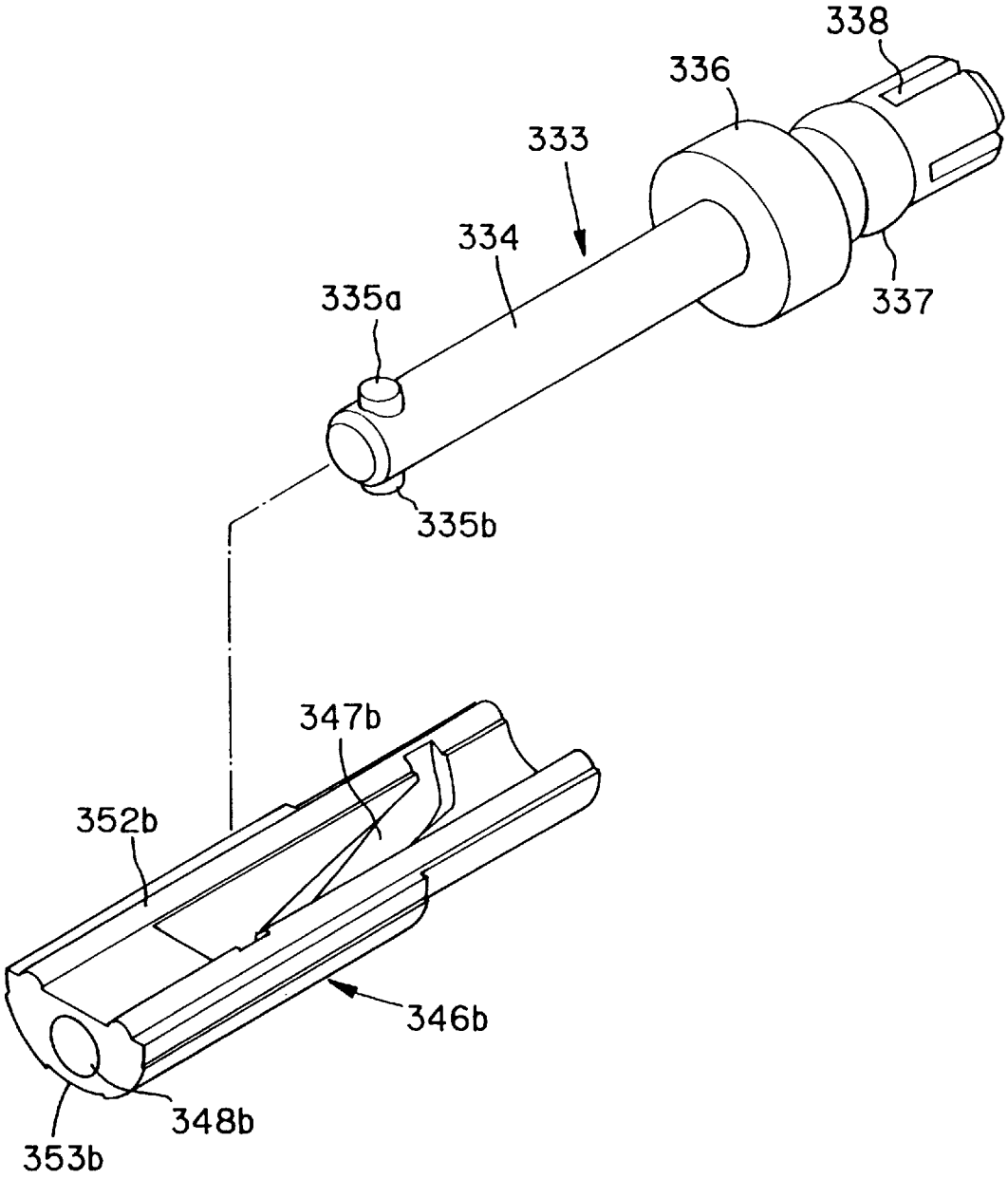
FIG. 15 is a perspective view showing the shapes of a rotary shaft and a sliding piece in the first example of the third embodiment.

As shown in FIGS. 11 and 13, bead 345 of clip 344 is covered or concealed by depressed portion 340*a* in raised portion 339 of rear barrel 330, so as to create a condition that clip 344 will not be hooked into a breast pocket etc.

Next, when rotary shaft 333 is rotated in the other direction, sliding piece 346*a* moves backwards so that the writing tip portion of ball-point pen element 301*a* retracts into front barrel 349 while sliding piece 346*b* moves forwards.

At that moment, the writing tip portions are accommodated inside front barrel 349 for the pocketable state. FIG. 17 shows the positional relationship of rotary shaft 333, sliding pieces 346*a* and 346*b*, corresponding to this state. In this state, clip 344 is located at a position designated at 344*a* in FIG. 13 so that the clip will easily be hooked into a breast pocket etc.

A further rotation of rotary shaft 333 in the same direction above, causes sliding piece 346*a* to move backwards more while sliding piece 346*b* moves further forwards so that the writing tip portion of ball-point pen element 301*b* projects out from the front end opening of front barrel 349. FIG. 18 shows the positional relationship of rotary shaft 333, sliding pieces 346*a* and 346*b*, corresponding to this state. At that moment, clip 344 is located in a position designated by 344*b* in FIG. 13 so that bead 345 of clip 344 is concealed by depressed portion 340*b* in raised portion 339, thus creating a condition that clip 344 will be impeded from being hooked into a breast pocket etc. Further, an abutment 336*c* of groove 336*a* formed on large-diametric portion 336 of rotary shaft 333 abuts rib 330*a* of rear barrel 330 so that a further rotation in the other direction will be prohibited (see FIG. 14).

Meanwhile, in the aforementioned second example in FIG. 20, an inclined depressed engaging portion 362 is formed in a raised portion 361 on a rear barrel 360 while a clip 364 has a bended end 365. Whenever either of the writing tip portions is projected, bended end 365 is engaged with depressed engaging portion 362 so that clip 364 will never be hooked into a breast pocket etc.

It should be noted that the means for prohibiting the clip from being hooked is not limited to the above method of the third embodiment. For example, when the depressed engaging portion is shaped with a spherical groove, a dove tail groove or etc., the front end portion or the bead portion of the clip to be engaged therewith may be formed in the shape corresponding to the engaging portion. In this way, it is possible to create a state where the clip cannot be opened and will not be hooked to a breast pocket etc.

As to ball-point pen elements 301*a* and 301*b*, when the point assembly 311 is oriented upward, ball valve 316 will be placed on ball seat 308 in valve chamber 307 to seal conduit 309. Therefore, even if the ink right below tip ball 312 in point assembly 311 is used up during upward writing, any head which would cause backward leaking, will not be exerted on ink. Consequently, as soon as point assembly 311 is turned down again, ink will become ready to flow out and thus ink starving during writing can be prevented. In this connection, if a structure without any ball valve is used for upward writing, the weight of ink acts in the direction of causing backward leaking and draws air into point assembly. Therefore, when the element is returned to the position of downward writing, ink cannot follow immediately, thereby causing ink starving.

In the writing state where point assembly 311 is oriented downward, ball valve 316 abuts the rear end of point assembly 311 at its one side so that an ink channel through which ink can be flowed into point assembly 311 is assured on the opposite side. In this way, ink 318 which has entered valve chamber 307 from ink reservoir 317 through conduit 309 will be brought to the backside of tip ball 312.

In this condition, since tip ball 312 is pressed forwards by rod portion 315 so that the ball comes into sealing contact with the inner brim of the tip holding portion, it is possible to prevent forward leaking of ink. When tip ball 312 is slightly moved backwards by the writing pressure, a gap which allows ink to flow out can be created. As tip ball 312 rotates during writing, ink flows out smoothly without causing any blobbing. Thus, it becomes possible to create line traces with thick line density.

Channels (a plurality of ink flowing channels which pass through toward the bore of the point assembly are provided on the ball seat for the tip ball) are formed behind tip ball 312, and rod portion 315 is disposed through the central hole around which the channels are formed. Ink inside point assembly 311 will be brought to the backside of tip ball 312 through ink flowing channels and the gap between the central hole and rod portion 315.

Configuration of the Fourth Embodiment

Figure 21:
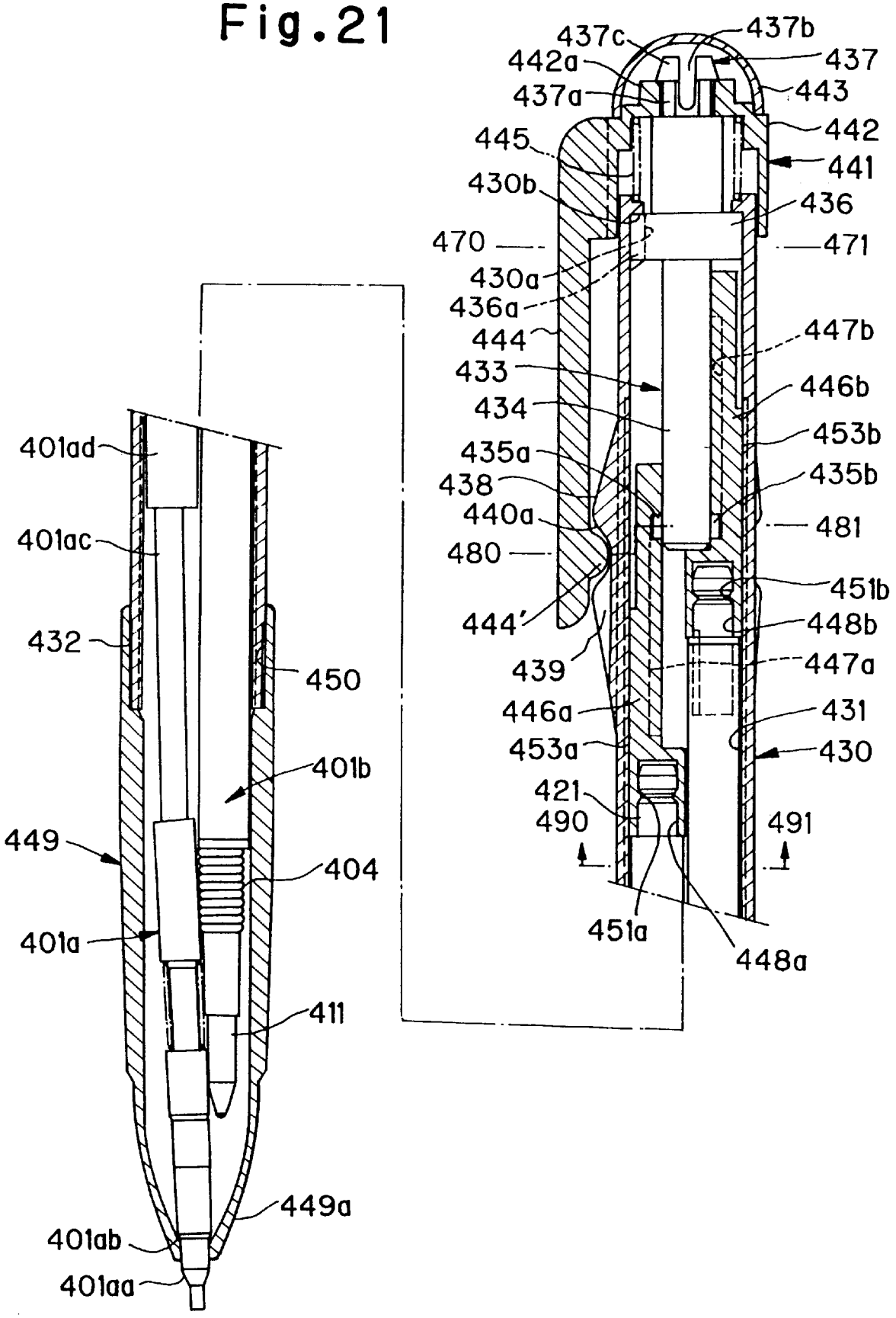
FIG. 21 is a vertical sectional view showing the overall structure of a multiplex writing implement of a first example in accordance with the fourth embodiment of the invention, where a part of the view is in the non-sectional representation.
Figure 22:
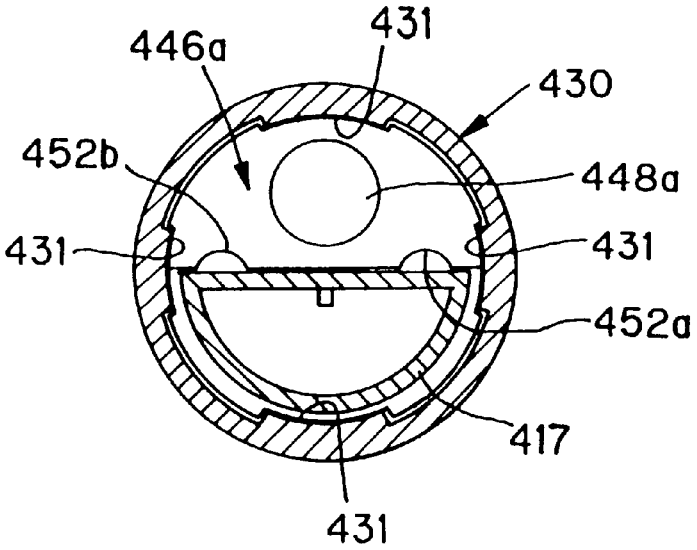
FIG. 22 is a sectional view taken on a line 490–491 in FIG. 21, showing the condition where the sliding pieces have no writing element attached.

FIGS. 21 through 30 show a first example of the fourth embodiment of the invention. A barrel cylinder is composed of a front barrel 449 and a rear barrel 430. In FIG. 21, a mechanical pencil element 401*a* and ball-point pen element 401*b* are provided.

The multiplex writing implement of FIG. 21 comprises: front barrel 449 which accommodates a writing-instrumental mechanism which is positioned in the front part; rear barrel 430; and an operating handle 441 disposed in the rear end of rear barrel 430. A female thread 450 is formed on the inner periphery at the rear part of front barrel 449, whereas a male thread 432 is formed in the front part of rear barrel 430. The male thread is screwed into female thread 450 of front barrel 449 and can be removed therefrom as required, such as writing elements should be replaced. A rotation-stopper rib 430*a* which will restrict the rotating range of a rotary shaft 433 to be referred to hereinbelow and a stepped portion 430*b* are formed on the inner periphery at the rear end of the bore of rear barrel 430. Four guide ribs 431 are formed in the axial direction, 90° apart from one another on the front inner periphery of rear barrel 430.

Further, three mound-like raised portions 438 are formed on the outer periphery of rear barrel 430, rather near to the rear end. Two of them have depressed portions 440*a* and 440*b* in the center of raised portions 438. It should be noted that the depressed portion 440*a* has a groove 439 in the front part thereof.

Rotary shaft 433 has a small-diametric portion 434 in the front of a large-diametric portion 436. A projection 435*a* is formed on the peripheral surface in the front part of small-diametric portion 434, and another projection 435*b* is formed on the other opposite side. Rotary shaft 433 has a first cylindrical portion having a reduced diameter in the rear of the large-diametric portion 436, a second cylindrical portion 437*a* behind the first cylindrical portion; and an engaging portion 437 having a flange 437*c* at the rear end thereof with a cutaway groove 437*b*. Further, unillustrated rotation-stopper ribs or grooves, which will be described later, for operating handle 441 are formed on the peripheral side of cylindrical portion 437*a*. Provided on the peripheral surface of the aforementioned large-diametric portion 436 is a groove 436*a* which is engaged with the aforementioned rib 430*a* of rear barrel 430 to limit the rotation of rotary shaft 433 to a range of about 120° relative to rear barrel 430.

Operating handle 441 is composed of a sleeve 442 to be covered on the rear end portion of rear barrel 430 and a clip 444 which extends forwards from one peripheral part of sleeve 442. Provided on the inner side in the front part of clip 444 is a bead 444'. Formed on the inside wall surface of the hollow of a rear end portion 442*a* of sleeve 442 is an unillustrated groove or rib which engages the rib or groove formed on the peripheral surface of cylindrical portion 437*a* of rotary shaft 433. As will be described later, the flange portion 437*c* of rotary shaft 433 is made to penetrate through rear end portion 442*a* and come out from the rear end of it. In this way, rotary shaft 433 and operating handle 441 are securely fixed to each other.

Provided at the front ends of sliding pieces 446*a* and 446*b* are insert holes 448*a* and 448*b*, which have inwardly projected engaging portions 451*a* and 451*b* for catching the rear ends of mechanical pencil element 401*a* (which will be described later) and ball-point pen element 401*b*, respectively. Cam grooves 447*a* and 447*b* are formed on the inner peripheral sides of the sliding pieces behind the insert holes. These cam grooves 447*a* and 447*b* receive urging forces exerted by projections 435*a* and 435*b* as they turn with the rotation of rotary shaft 433 so that respective sliding pieces 446*a* and 446*b* can move forwards or backwards. Formed on the outer peripheral sides of sliding pieces 446*a* and 446*b* are grooves 453*a* and 453*b* as rotation stoppers which engage the aforementioned guide ribs 431 of rear barrel 430.

Therefore, grooves 453*a* and 453*b* formed on the sides of sliding pieces 446*a* and 446*b* mesh corresponding guide ribs 431, whereby sliding pieces 446*a* and 446*b* will smoothly be moved forwards or backwards. The transverse cross sections of sliding pieces 446*a* and 446*b* are of substantially D-shape. Accordingly, it is an advantage that the conventionally used complicated structure which uses a guide cylinder having two opposing guide grooves is not needed.

Sliding pieces 446*a* and 446*b* come in contact with each other on their flat sides. In order to smoothen the sliding movement between the two, guiding projections 452*b* are provided for sliding piece 446*b* while guiding grooves 452*a* which should be inserted into guiding projections 452*b* are formed in sliding piece 446*a*.

Then, the aforementioned sliding pieces 446*a* and 446*b* are engaged with projections 435*a* and 435*b*, respectively. In this state, rotary shaft 433 together with the sliding pieces is inserted into the bore of rear barrel 430 until the rear end of large-diametric portion 436 is abutted against stepped portion 430*b* of rear barrel 430. In this condition, the aforementioned operating handle 441 is attached to the rear cylindrical portion of rotary shaft 433 with a spring 445 interposed between the rear end of rear barrel 430 and the front end of rear end portion 442*a* of operating handle 441.

For this attachment, engaging portion 437 becomes engaged with the hole of rear end portion 442*a* of operating handle 441 so that rotary shaft 433 and operating handle 441 will integrally be fixed to one another. In this arrangement, when operating handle 441 is turned relative to rear barrel 430 and therefore rotary shaft 433 rotates, one of the sliding pieces advances forwards, the other moves backwards. A crown 443 is securely attached to the rear end of operating handle 441.

When crown 443 is clicked relative to rear barrel 430, rotary shaft 433 moves in the axial direction. In link with this movement, sliding pieces 446*a* and 446*b* also move in the axial direction.

Attached to insert holes 448*a* and 448*b* of sliding pieces 446*a* and 446*b* are the rear ends of mechanical pencil element 401*a* and ball-point pen element 401*b*, respectively. Further, front barrel 449 is fixed to the front part of rear barrel 430.

Meanwhile, mechanical pencil element 401*a* is a type which is used for typical multiplex writing implements. That is, as shown in FIG. 21, when the rear end of crown 443 is clicked, a lead pipe 401*ac* is moved in the axial direction in link with sliding piece 446*a*, thereby delivering new lead.

Figure 31:
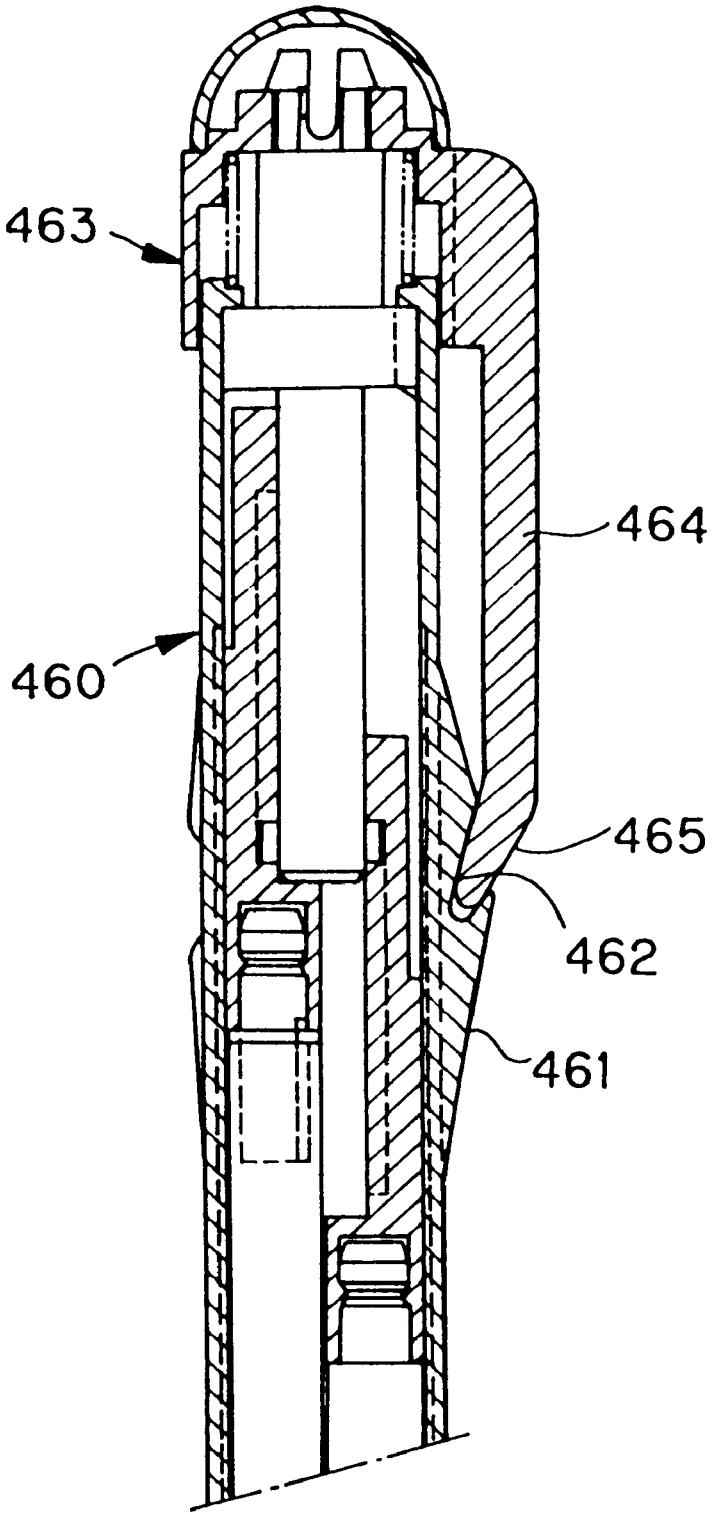
FIG. 31 is a vertical sectional view showing the rear half of a multiplex writing implement in a second example of the fourth embodiment, where a part of the view is in the non-sectional representation.

FIG. 31 shows a second example of the fourth embodiment The basic structure of this example is the same as in the first example, and its difference from the first example will be explained in the description of operation hereinbelow.

Next, ball-point pen element 401*b* to be incorporated in the multiplex writing implement of this fourth embodiment will be described. Ink used for ball-point pen elements 401*b* is so-called thixotropic water-soluble or low-viscosity oil-based ball-point pen ink.

Figure 30:
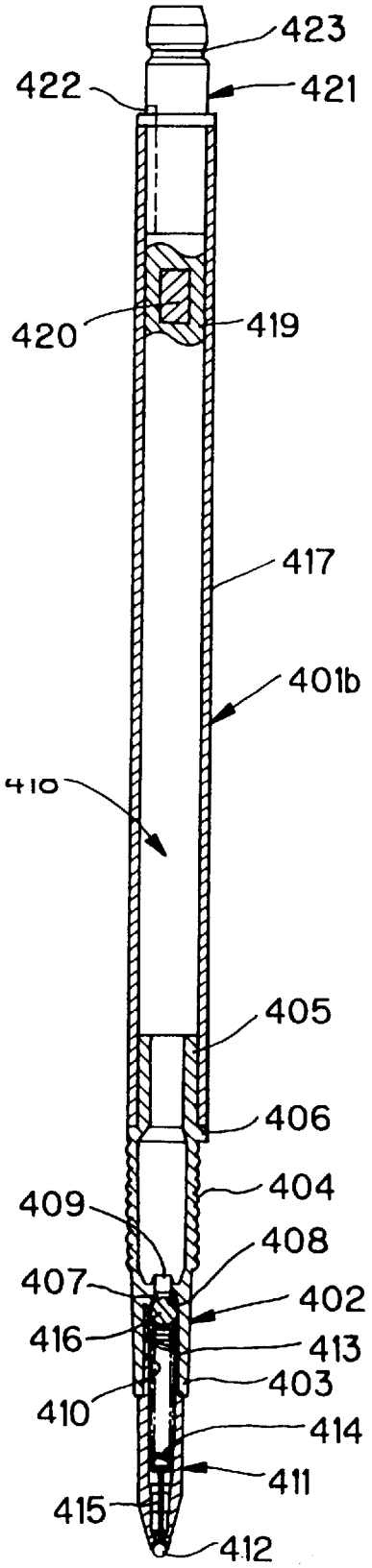
FIG. 30 is a vertical sectional view of a ball-point pen element in accordance with the first example of the fourth embodiment.

As shown in FIG. 30, a point assembly 411 is constructed so that a tip ball 412 is substantially abutted onto a seat having channels which will permit ink to flow in, and is held rotatably by a front press-fitted portion. Further, a spring 414 is inserted into the bore of point assembly 411. The rear end of a pipe portion 413 of the point assembly 411 is properly press-fitted so that the rear part of spring 414 will not come out. In order to prevent dryout of the writing point and the forward leakage of ink, it is very important to bring tip ball 412 into sealing contact with the inner surface of the tip holding portion. To achieve this, the surface roughness of the inner surface of point assembly 411 that holds tip ball 412, the ground finish of the inner surface for improving precision of the sealing contact by press-fitting and the secondary plastic process for improving accuracy of press-fitting should be considered. Further, the surface treatment etc. of the contact surface with tip ball 412 should be considered.

A straight rod portion 415 is extended forwards from spring 414. The front end of this rod portion 415 abuts the rear side of tip ball 412 to press it. This pressure causes tip ball 412 to come in sealing contact with the inner brim of the ball holding portion (formed by press-fitting etc.) of point assembly 411.

A joint 402 is integrally formed of a resin molding which comprises: a front pipe portion 403 at the front end thereof which will be press-fitted to pipe portion 413 of point assembly 411; an rear pipe portion 405 which will be press-fitted to the front end of an ink reservoir 417; and a flexible portion, e.g. a bellows 404 which is provided between the front pipe portion 403 and rear pipe portion 405. Provided in the rear of a bore 410 of front pipe portion 403 is a valve chamber 407 in which a ball valve 416 is placed with play. In the rear of valve chamber 407, a ball seat 408 of a tapered or spherical form and a conduit 409 are formed. Valve chamber 407, ball seat 408 and conduit 409 are formed adaptively eccentric relative to the axial center. The hollow of the aforementioned bellows 404 and rear pipe portion 405 is made to communicate with the bore of ink reservoir 417. A groove (not shown) which allows ink to flow in the axial direction is formed on one side of the inner wall of valve chamber 407. When point assembly 411 is oriented downwards, this ball valve 416 idly held inside valve chamber 407 will abut one-sidedly against the rear end of pipe portion 413 of point assembly 411 thereby forming an ink channel. Ink in ink reservoir 417 flows into the bore of point assembly 411 through conduit 409, the aforementioned groove and the ink flow passage etc. Conversely, when point assembly is oriented upward, ball valve 416 will abut the ball seat 408 to prevent back leakage of ink.

Ink reservoir 417 is filled up with an ink 418 suitable for the aforementioned ball-point pen element 401*b*. Further, an ink follower 419 consisting of a translucent, nondrying greasy material is filled at the rear end of ink 418. This follower will move in contact with the ink surface following the consumption of the ink. In order to prevent deformation due to impacts from being dropped or clicking, a resin-made follower rod 420 having a specific weight substantially equal to that of follower 419 may be immersed in follower 419, as required. A tail plug 421 is fixed to the rear end of ink reservoir 417. Formed in the rear cylindrical part of this tail plug 421 is an engaging groove 423 which is detachably caught by engaging portion 451*b* inside insert hole 448*b* in the front part of sliding piece 446*b*. Tail plug 421 further has a ventilation groove 422 which connects the inside of ink reservoir 417 with the outside air.

The aforementioned ink reservoir 417 uses a molding of, for example, transparent PP resin etc., and should be formed from a material that has good clear-drain performance. Further, ink reservoir 417 may be integrally formed with joint 402.

The ink reserving portion of ink reservoir 417 is non-flexible and has a relatively large cross-section. In the fourth embodiment this portion has an almost D-shaped section so that it can be fitted in the rear barrel 430 without forming useless space (not shown). The portion for jointing the point assembly 411 with the ink reserving portion should be formed so as to readily be deflected transversely with respect to the axial direction. It is also possible to provide a flexible tube which connects the ink reservoir with the joint which is press-fitted to the rear end of point assembly 411.

Meanwhile, a joint 401*ad* which is connected to the aforementioned lead pipe 401*ac*, is formed and attached to sliding piece 446*a* in the same manner as performed for the rear part of the ball-point pen element 401*b*. Alternatively, it is also possible to integrally form the lead pipe with the joint (inclusive of the tail-plug shape), so that mechanical pencil element 401*a* can be removed from the front end of the lead pipe and some lead can be inserted into the lead pipe.

Operation and Effect of the Fourth Embodiment

When the operating handle 441 is turned approximately 120° relative to rear barrel 430, rotary shaft 433 rotates and therefore projections 435*a* and 435*b* rotate along cam grooves 447*a* and 447*b* of sliding pieces 446*a* and 446*b*. With this rotation, one of the sliding pieces advances forwards, the other moves backwards. Thus, the writing tip portion of the ball-point pen element on the advancing side can be projected out from the front end opening of front barrel 449. Further, even if ink reservoir 417 portion of ball-point pen element 401*b* is non-flexible, the writing tip portion of the writing element will be able to flexibly deflect at bellows 404. Therefore, without being impeded, the writing tip part can smoothly be projected from and retracted into the front end opening of front barrel 449.

Figure 27:
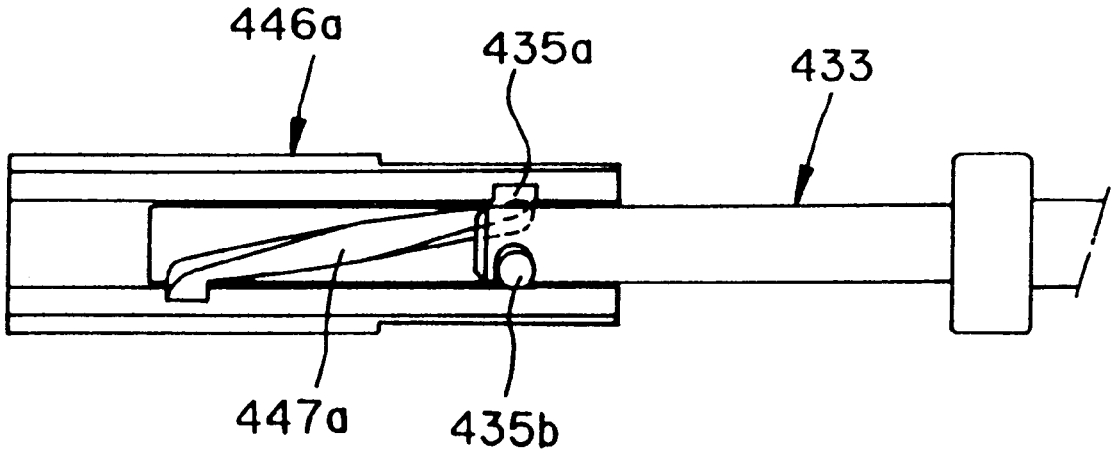
FIGS. 27 and 27*a* are illustrations showing the positional relations between a rotary shaft and sliding pieces where a mechanical pencil element is projected as the rotary shaft is rotated, in the first example of the fourth embodiment.
Figure 27A:
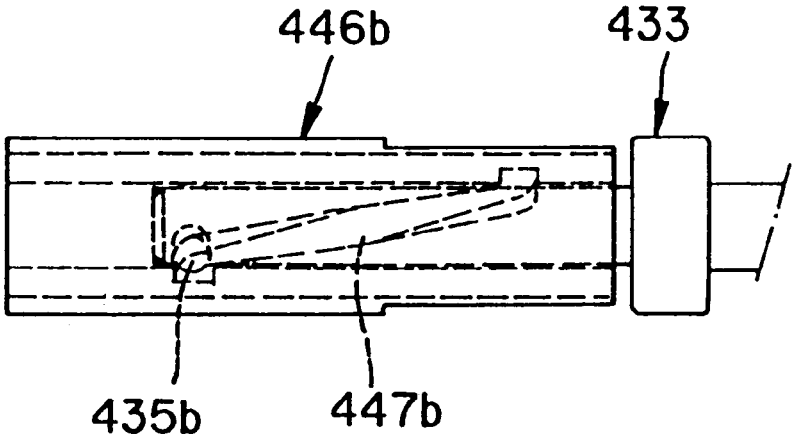
Figure 28:
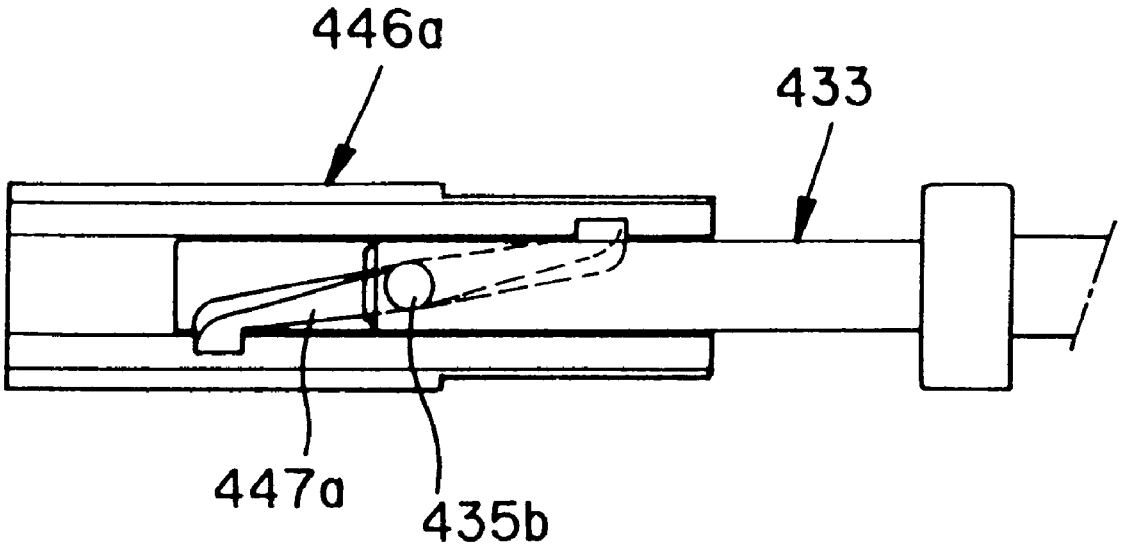
FIGS. 28 and 28*a* are illustrations showing the positional relations between a rotary shaft and sliding pieces where all writing pen elements are retracted as the rotary shaft is rotated, in the first example of the fourth embodiment.
Figure 28A:
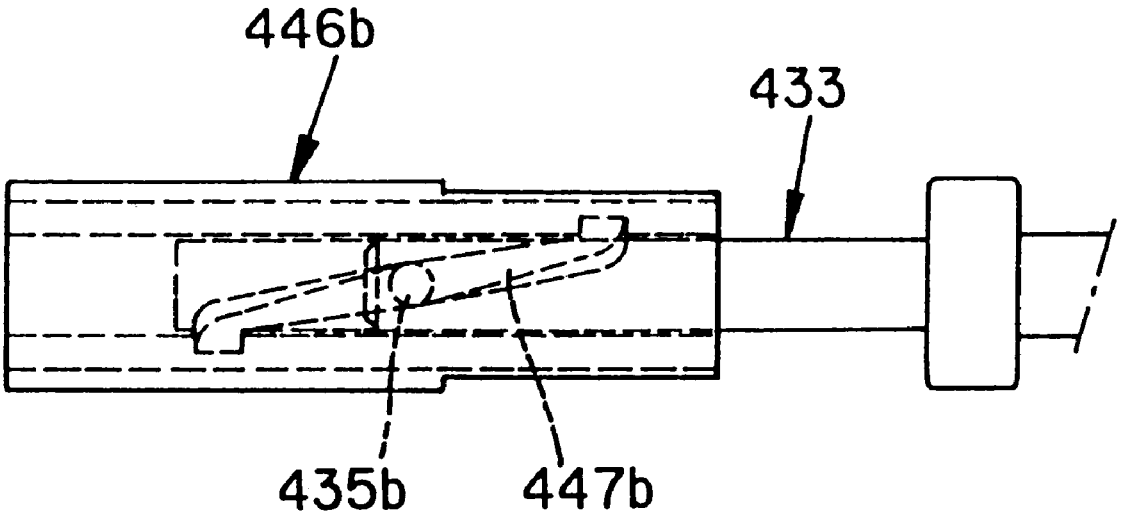
Figure 29:
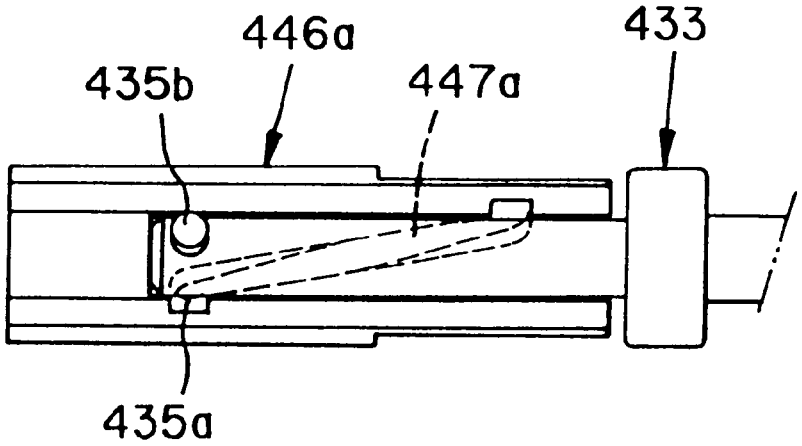
FIGS. 29 and 29*a* are illustrations showing the positional relations between a rotary shaft and sliding pieces where one of writing pen elements is retracted as the rotary shaft is rotated, in the first example of the fourth embodiment.
Figure 29A:
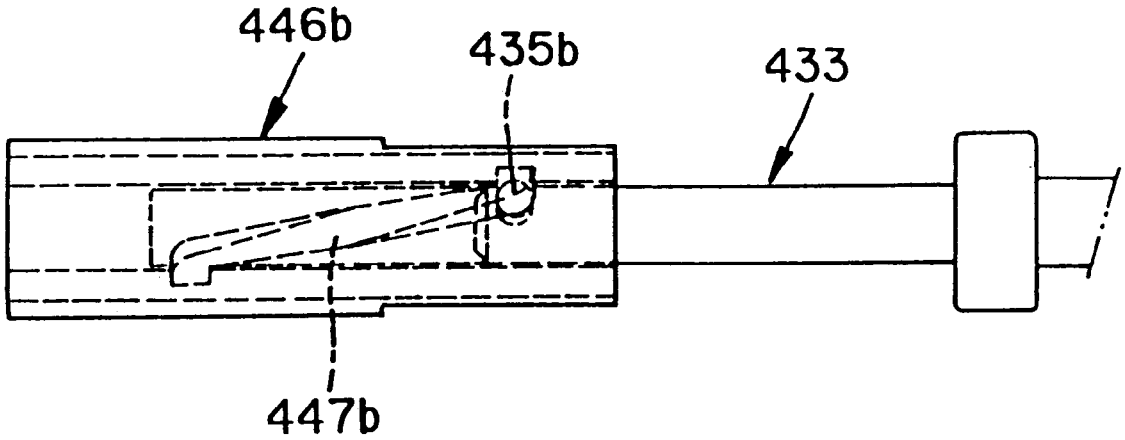

FIGS. 27 through 29 show the conditions where sliding pieces 446*a* and 446*b* move forwards and backwards relative to the rotation of rotary shaft 433. In the figures, since the outlines of sliding pieces 446*a* and 446*b* would overlap one another relative to rotary shaft 433, the drawings are separated for the description's convenience.

First, FIG. 21 shows a state where mechanical pencil element 401*a* is projected. FIG. 27 shows the positional relationship of rotary shaft 433, sliding pieces 446*a* and 446*b*, corresponding to the state of FIG. 21. At that moment, rib 430*a* of rear barrel 430 abuts an abutment 436*b* of groove 436*a* formed on large-diametric portion 436 of rotary shaft 433 so that a rotation in one direction will be restricted (see FIG. 24).

Figure 23:
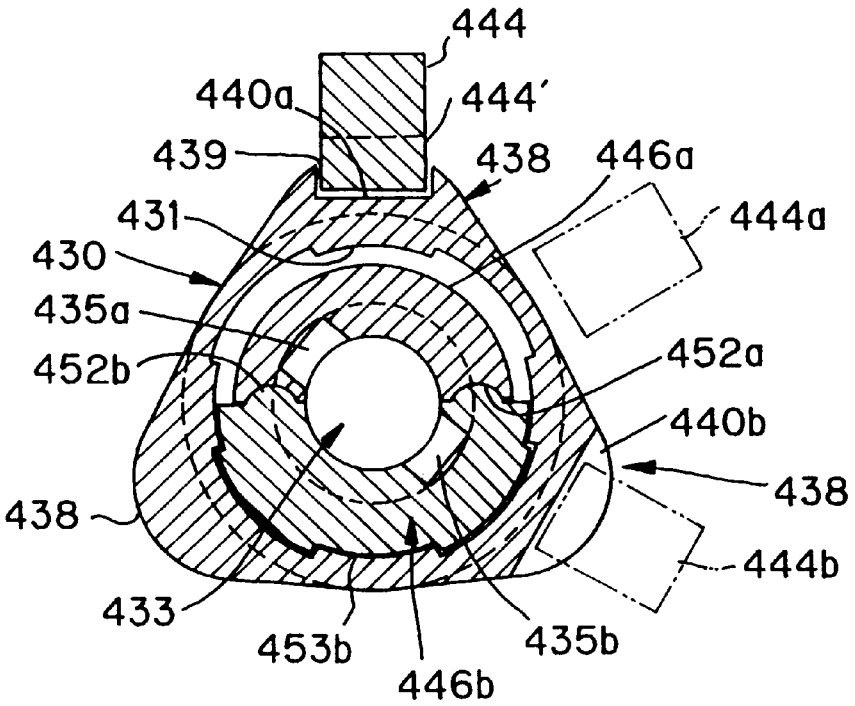
FIG. 23 is a sectional view taken on a line 480–481 in FIG. 21, showing various positions of a clip as an operating handle is rotated.
Figure 24:
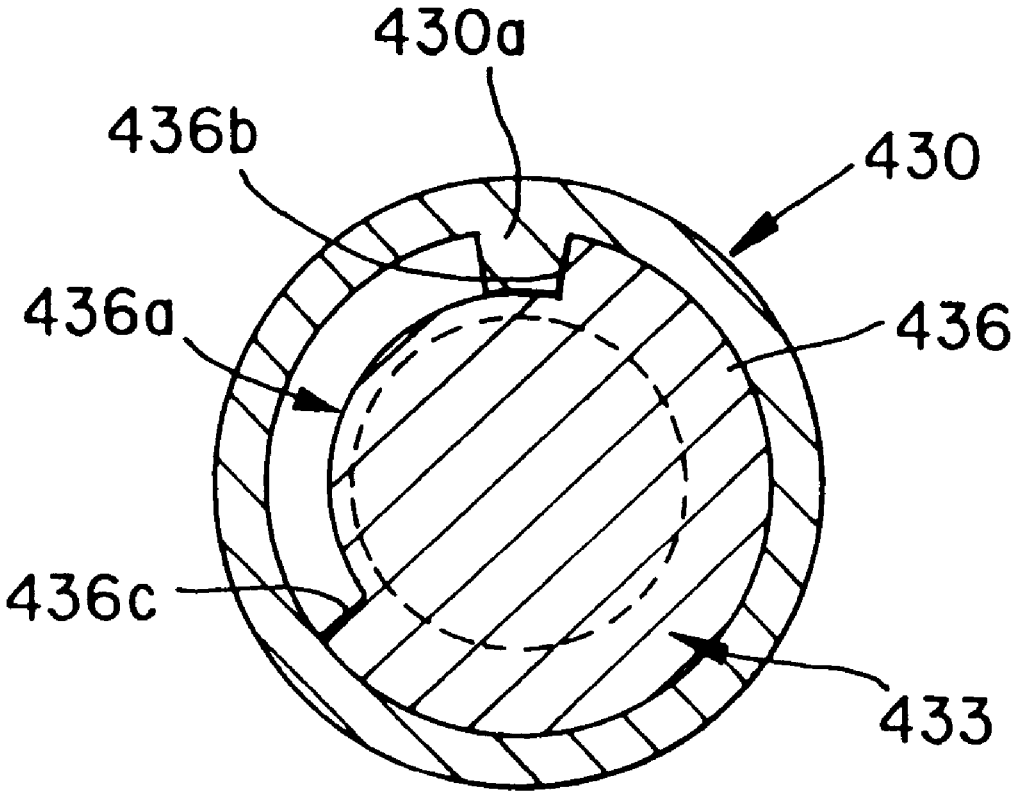
FIG. 24 is a sectional view taken on a line 470–471 in FIG. 21.
Figure 25:
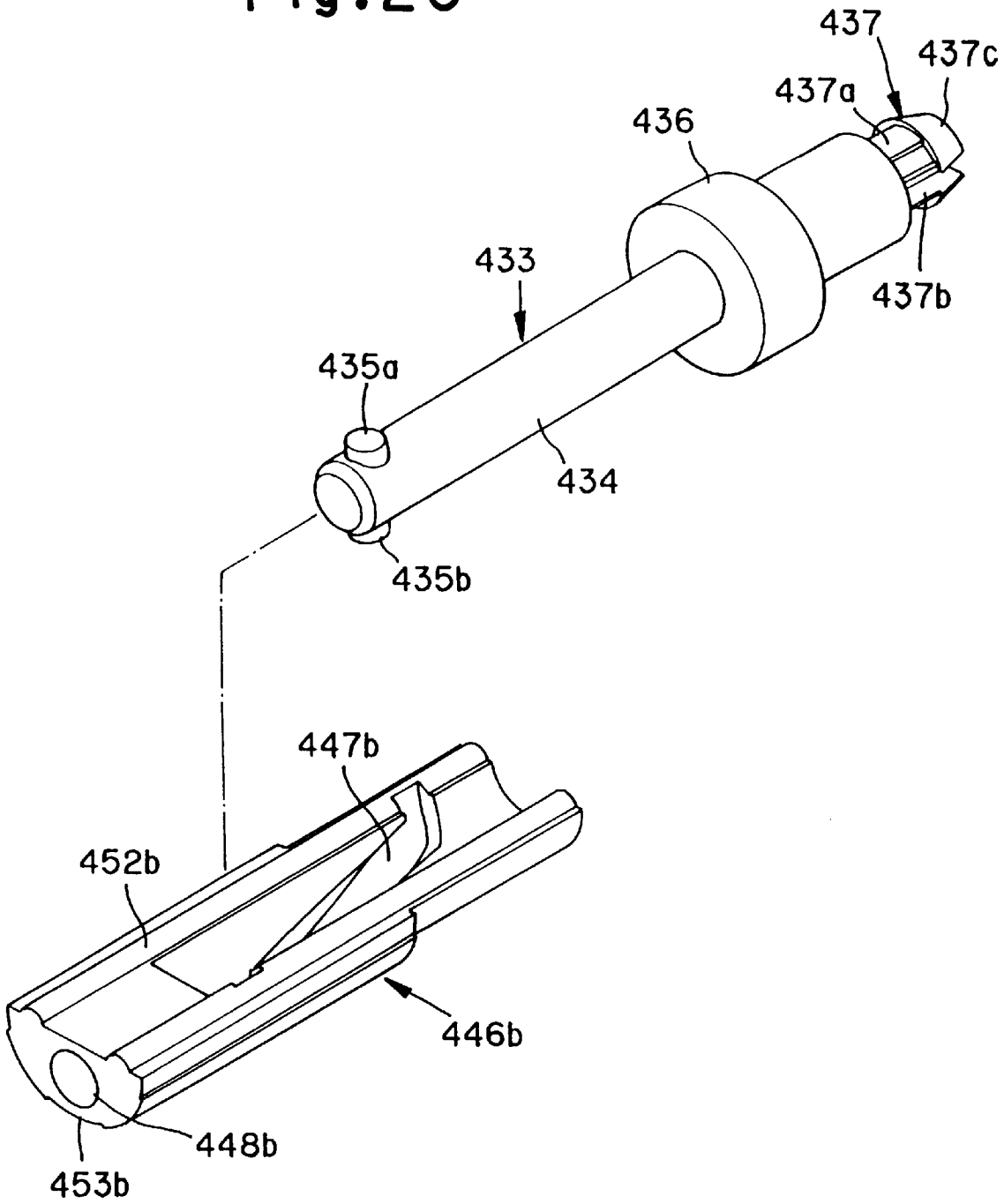
FIG. 25 is a perspective view showing the shapes of a rotary shaft and a sliding piece in the first example of the fourth embodiment.
Figure 26:
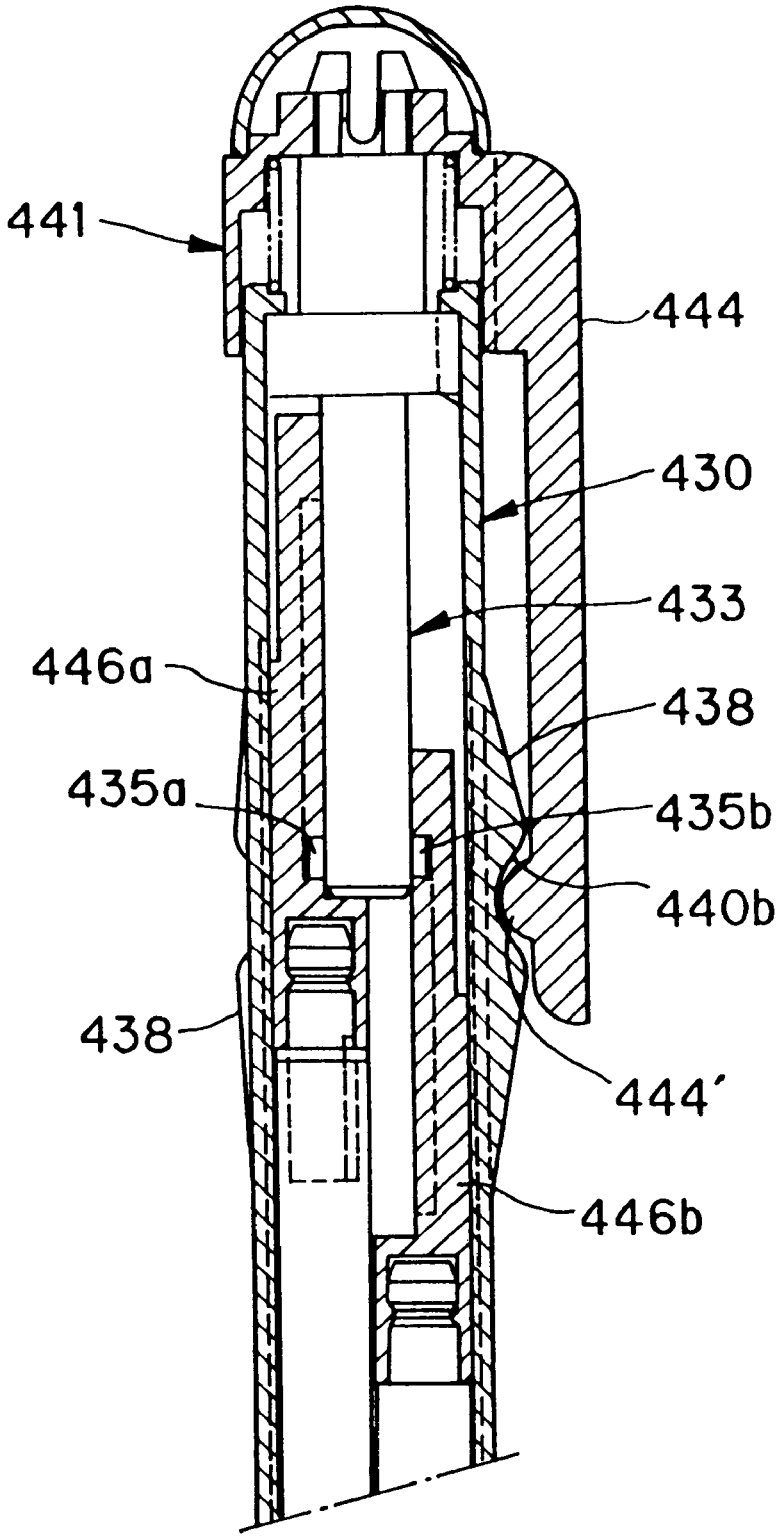
FIG. 26 is a vertical sectional view showing the rear half of a multiplex writing implement, where the ball-point pen element in the first example of the fourth embodiment is projected, and a part of the view is in the non-sectional representation.

As shown in FIGS. 21 and 23, bead 444' of clip 444 is covered or concealed by depressed portion 440*a* in raised portion 438 of rear barrel 430. Nevertheless, bead 444' is able to move in the axial direction along groove 439. Thus, the clicking action will not be impeded.

Next, when rotary shaft 433 is rotated in the other direction, sliding piece 446*a* moves backwards so that the writing tip portion of mechanical pencil element 401*a* retracts into front barrel 449 while sliding piece 446*b* moves forwards.

At that moment, the writing tip portions are accommodated inside front barrel 449 for the pocketable state. FIG. 28 shows the positional relationship of rotary shaft 433, sliding pieces 446*a* and 446*b*, corresponding to this state. In this state, clip 444 is located at a position designated at 444*a* in FIG. 23 so that the clip will readily be hooked into a breast pocket etc.

A further rotation of rotary shaft 433 in the same direction above, causes sliding piece 446*a* to move backwards more while sliding piece 446*b* moves further forwards so that the writing tip portion of ball-point pen element 401*b* projects out from the front end opening of front barrel 449. FIG. 29 shows the positional relationship of rotary shaft 433, sliding pieces 446*a* and 446*b*, corresponding to this state. At that moment, clip 444 is located in a position designated by 444*b* in FIG. 23 so that bead 444' of clip 444 is concealed by depressed portion 440*b* in raised portion 438, thus creating a condition that clip 344 will be impeded from being hooked into a breast pocket etc., (see FIG. 26). Further, an abutment 436*c* of groove 436*a* formed on large-diametric portion 436 of rotary shaft 433 abuts rib 430*a* of rear barrel 430 so that a further rotation in the other direction will be prohibited (see FIG. 24). Further, if a rib or etc. which will practically abut the rear end of rear barrel 430, is formed on the peripheral surface of the cylindrical portion behind large-diametric portion 436 of rotary shaft 433, it also becomes possible to prohibit the clicking movement when ball-point pen element 401*b* is projected or when no writing element is projected. In this case, it is necessary to devise a structure that the rib will be fitted into the rear end of rear barrel 430 when mechanical pencil element 401*a* is projected so that it will not impede the clicking operation.

Meanwhile, in the aforementioned second example in FIG. 31, an inclined depressed engaging portion 462 is formed in a raised portion 461 on a rear barrel 460 while a clip 464 has a bended end 465. Whenever either of the writing tip portions is projected, bended end 465 is engaged with depressed engaging portion 462 so that clip 464 will never be hooked into a breast pocket etc.

It should be noted that the means for prohibiting the clip from being hooked is not limited to the above method of the fourth embodiment. For example, when the depressed engaging portion is shaped with a spherical groove, a dove tail groove or etc., the front end portion or the bead portion of the clip to be engaged therewith may be formed in the shape corresponding to the engaging portion. In this way, it is possible to create a state where the clip cannot be opened and will not be hooked to a breast pocket etc.

As to ball-point pen element 401*b*, when the point assembly 411 is oriented upward, ball valve 416 will be placed on ball seat 408 in valve chamber 407 to seal conduit 409. Therefore, even if the ink right below tip ball 412 in point assembly 411 is used up during upward writing, any head which would cause backward leaking, will not be exerted on ink. Consequently, as soon as point assembly 411 is turned down again, ink will become ready to flow out and thus ink starving during writing can be prevented. In this connection, if a structure without any ball valve is used for upward writing, the weight of ink acts in the direction of causing backward leaking and draws air into point assembly. Therefore, when the element is returned to the position of downward writing, ink cannot follow immediately, thereby causing ink starving.

In the writing state where point assembly 411 is oriented downward, ball valve 416 abuts the rear end of point assembly 411 at its one side so that an ink channel through which ink can be flowed into point assembly 411 is assured on the opposite side. In this way, ink 418 which has entered valve chamber 407 from ink reservoir 417 through conduit 409 will be brought to the backside of tip ball 412.

In this condition, since tip ball 412 is pressed forwards by rod portion 415 so that the ball comes into sealing contact with the inner brim of the tip holding portion, it is possible to prevent forward leaking of ink. When tip ball 412 is slightly moved backwards by the writing pressure, a gap which allows ink to flow out can be created. As tip ball 412 rotates during writing, ink flows out smoothly without causing any blobbing. Thus, it becomes possible to create line traces with thick line density.

Channels (a plurality of ink flowing channels which pass through toward the bore of the point assembly are provided on the ball seat for the tip ball) are formed behind tip ball 412, and rod portion 415 is disposed through the central hole around which the channels are formed. Ink inside point assembly will be brought to the backside of tip ball 412 through ink flowing channels and the gap between the central hole and rod portion 415.

Configuration of the Fifth Embodiment

First, FIGS. 32 through 35 show a ball-point pen element 501 of a first example of the fifth embodiment in accordance with the invention. As shown in the figures, a point assembly 512 is constructed so that a tip ball 513 is substantially abutted onto a seat having channels which will permit ink to flow in, and is held rotatably by a front press-fitted portion. Further, a spring 515 is inserted into a tip bore 512*c*. The rear end of a pipe portion 514 of point assembly 512 is properly press-fitted (by press-fitted portion 514*a*) so that a coil portion 515*a* at the rear end of spring 515 will not come out. In order to prevent dryout of the writing point and the forward leaking of ink, it is very important to bring tip ball 513 into sealing contact with the inner surface of a tip holding portion 512*b*. To achieve this, the surface roughness of the inner surface of point assembly 512 that holds tip ball 513, the ground finish of the inner surface for improving precision of the sealing contact by press-fitting and the secondary plastic process for improving accuracy of press-fitting should be considered. Further, the surface treatment etc. of the contact surface with tip ball 513 should be considered.

A straight rod portion 516 is extended forwards from spring 515. The front end of this rod portion 516 abuts the rear side of tip ball 513 to press it. This pressure causes tip ball 513 to come in sealing contact with the inner brim of the ball holding portion 512*b* (formed by press-fitting etc.) of point assembly 512.

A front joint 502 has a front pipe portion 502*a* at the front end thereof which will be press-fitted to pipe portion 514 of point assembly 512 and an rear pipe portion 502*b*. A rear joint 503 is comprised of a front sleeve 503*a*, a small-diametric ink conduit pipe 506 behind the front sleeve, a flexing portion 503*b* having a plurality of thin disc-like fins 504 formed on the outer peripheral portion of ink conduit pipe 506 along the axial direction, and a rear pipe 503*c* which has a flange 507 and formed behind the flexing portion.

In the above arrangement, rear pipe portion 502*b* of front joint 502 is hermetically fixed into the hollow of front sleeve 503*a* of rear joint 503, and rear pipe 503*c* of rear joint 503 is hermetically fixed into the front bore of an ink reservoir 518.

Figure 33:
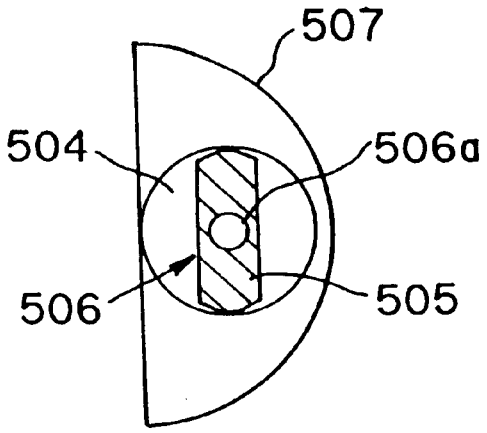
FIG. 33 is a sectional view taken on 570–571 in FIG. 32.
Figure 34:
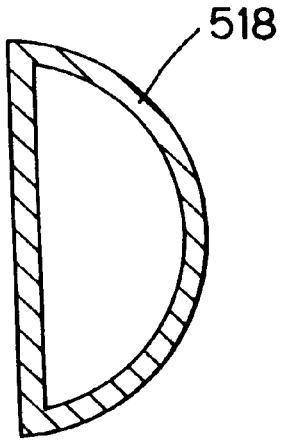
FIG. 34 is a sectional view taken on 580–581 in FIG. 32.
Figure 35:
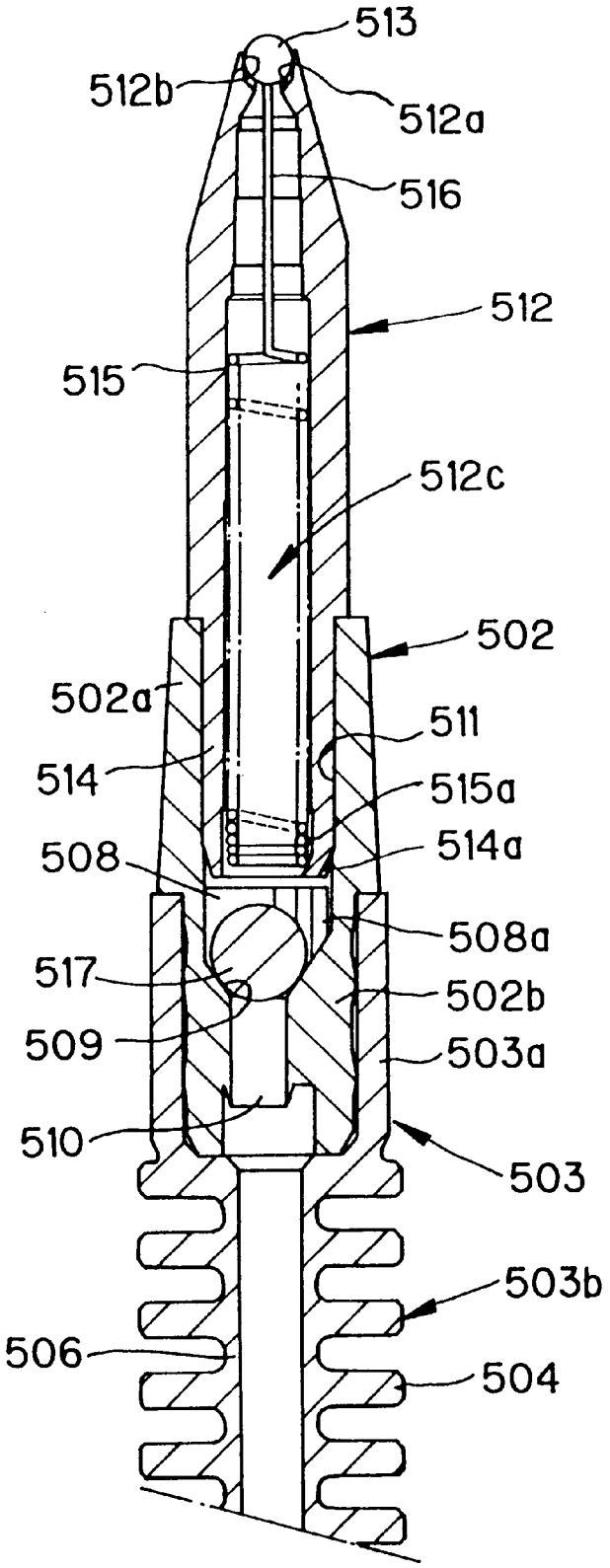
FIG. 35 is an enlarged view showing main components of the front part of the writing element in FIG. 32.

Here, as shown in FIG. 33, when ink conduit pipe 506 is formed like a rib 505, the writing element becomes flexed easily only in one direction. This feature makes it possible to prevent an excessive sway of writing tip portion.

Provided in the rear of a bore 511 of the front joint 502 is a valve chamber 508 in which a ball valve 517 is placed with play. In the rear of valve chamber 508, a ball seat 509 of a tapered or spherical form and a conduit 510 are formed. Valve chamber 508, ball seat 509 and conduit 510 are formed adaptively eccentric relative to the axial center. A groove 508*a* which allows ink to flow in the axial direction is formed on one side of the inner wall of valve chamber 508. When point assembly 512 is oriented downwards, this ball valve 517 idly held inside valve chamber 508 will abut one-sidedly against the rear end of pipe portion 514 of point assembly 512 thereby forming an ink channel to tip bore 512*c*. Ink in ink reservoir 518 flows into the tip bore 512*c* through conduit 510, the aforementioned groove 508*a* and the ink flow passage etc. Conversely, when point assembly is oriented upward, ball valve 517 will come in sealing contact with the ball seat 509 to prevent back leakage of ink.

Ink reservoir 518 is filled up with an ink 519 suitable for the aforementioned ball-point pen element 501. Further, an ink follower 520 consisting of a translucent, nondrying greasy material is filled at the rear end of ink 519. This follower will move in contact with the ink surface following the consumption of the ink. In order to prevent deformation due to impacts from being dropped or clicking, a resin-made follower rod 521 having a specific weight substantially equal to that of follower 520 may be immersed in follower 520, as required. A tail plug 522 is fixed to the rear end of ink reservoir 518. A rear cylindrical part 524 of this tail plug 522 is inserted into an insert hole in a connecting part which is linked with a writing element projecting/retracting mechanism for multiplex writing implement. An engaging groove 524*a* which is formed on cylindrical part 524 is detachably caught by an engaging portion provided inside the insert hole, thus ball-point pen element 501 is attached to the multiplex writing implement.

Tail plug 522 further has a ventilation groove 523 which connects the inside of ink reservoir 518 with the outside air. Here, the aforementioned ink reservoir 518 uses a molding of, for example, transparent polypropylene resin etc., and should be formed from a material that has good clear-drain performance.

The ink reserving portion of ink reservoir 518 is non-flexible and has a relatively large cross-section. In the fifth embodiment, this portion has an almost D-shaped section so that two ball-point pen elements can be incorporated in the multiplex writing implement without forming useless space.

Figure 36:
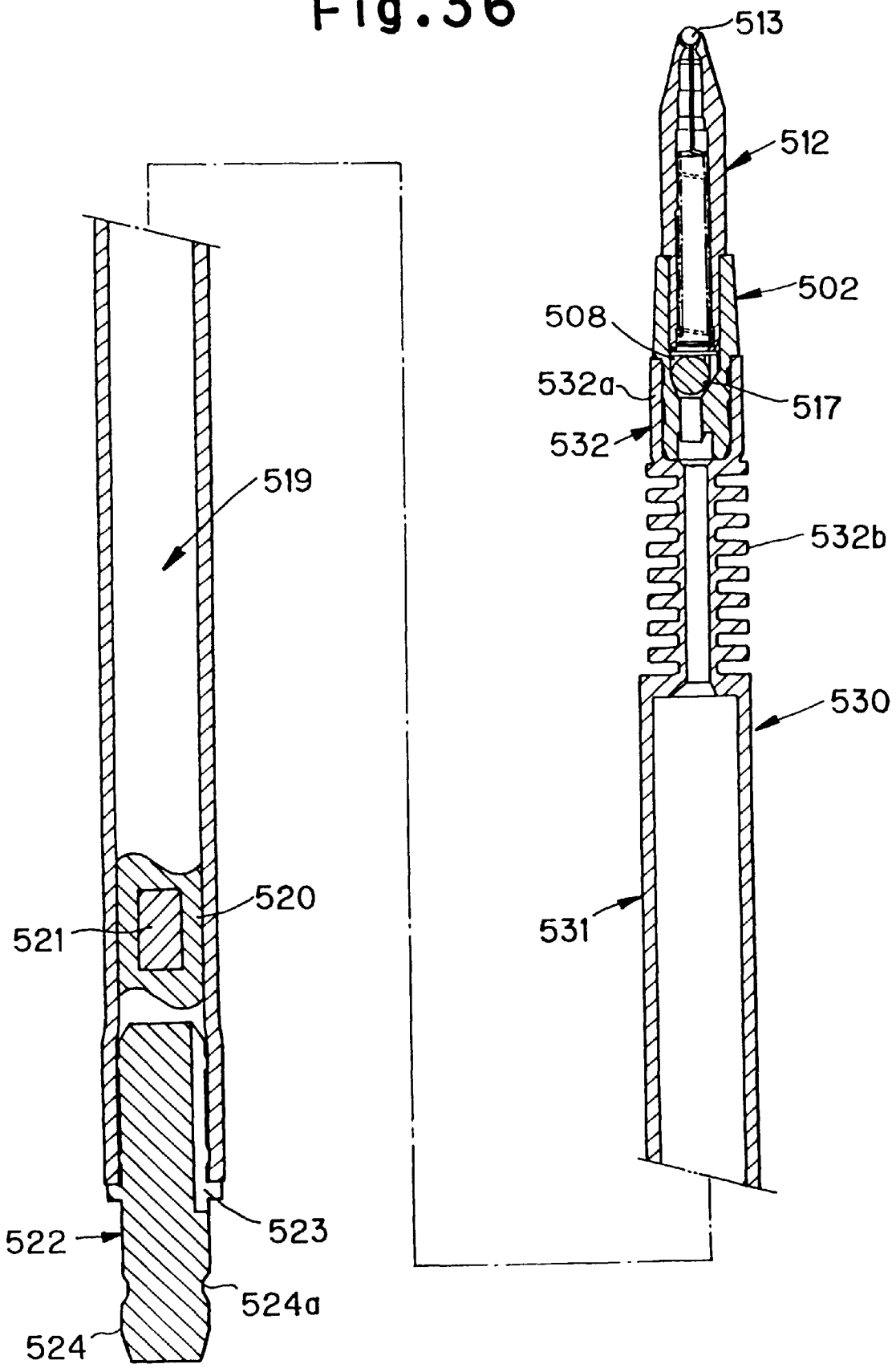
FIG. 36 is a vertical sectional view showing the overall structure of a ball-point pen element of a second example of the fifth embodiment.

FIG. 36 shows a ball-point pen element 530 as a second example of the fifth embodiment. This element is the same as in the first example, except in that a rear joint 532 and an ink reservoir 531 are integrally formed of a resin molding.

Figure 37:
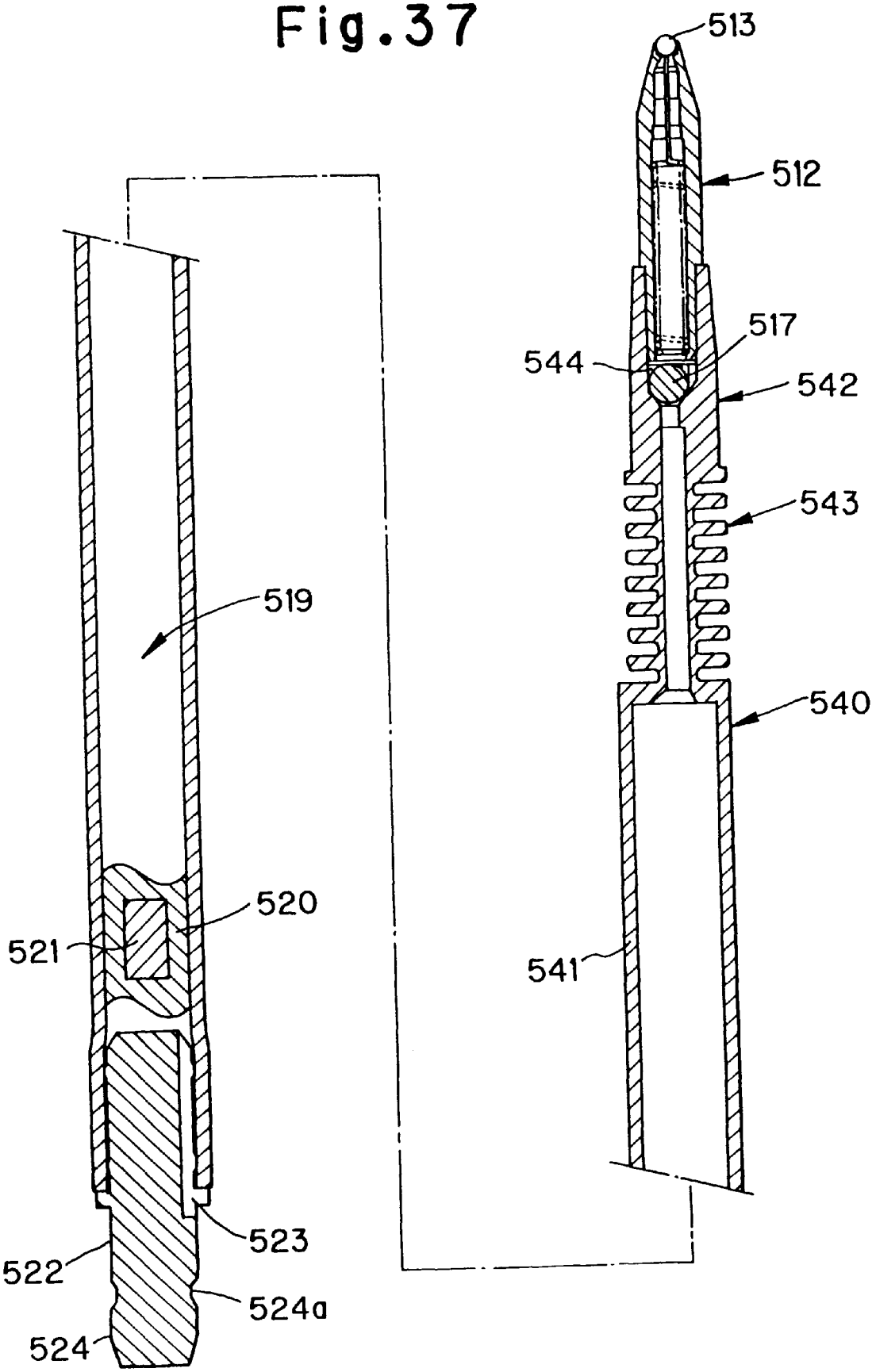
FIG. 37 is a vertical sectional view showing the overall structure of a ball-point pen element of a third example of the fifth embodiment of the invention.
Figure 38:
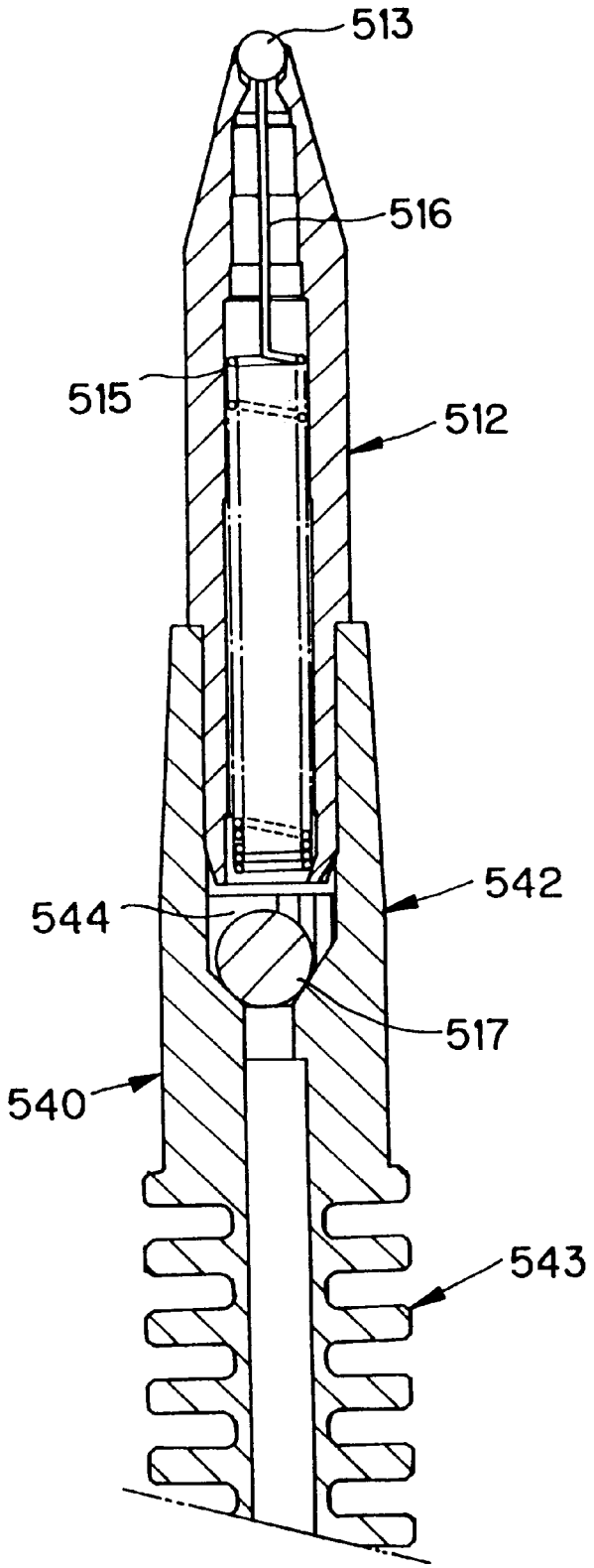
FIG. 38 is an enlarged view showing main components of the front part of the writing element in FIG. 37.

FIGS. 37 and 38 show a ball-point pen element 540 as a third example of the fifth embodiment. This element is basically the same as in the first example, except in that a joint 542, a flexing portion 543 and an ink reservoir 541 are integrally formed of a resin molding.

Figure 32:
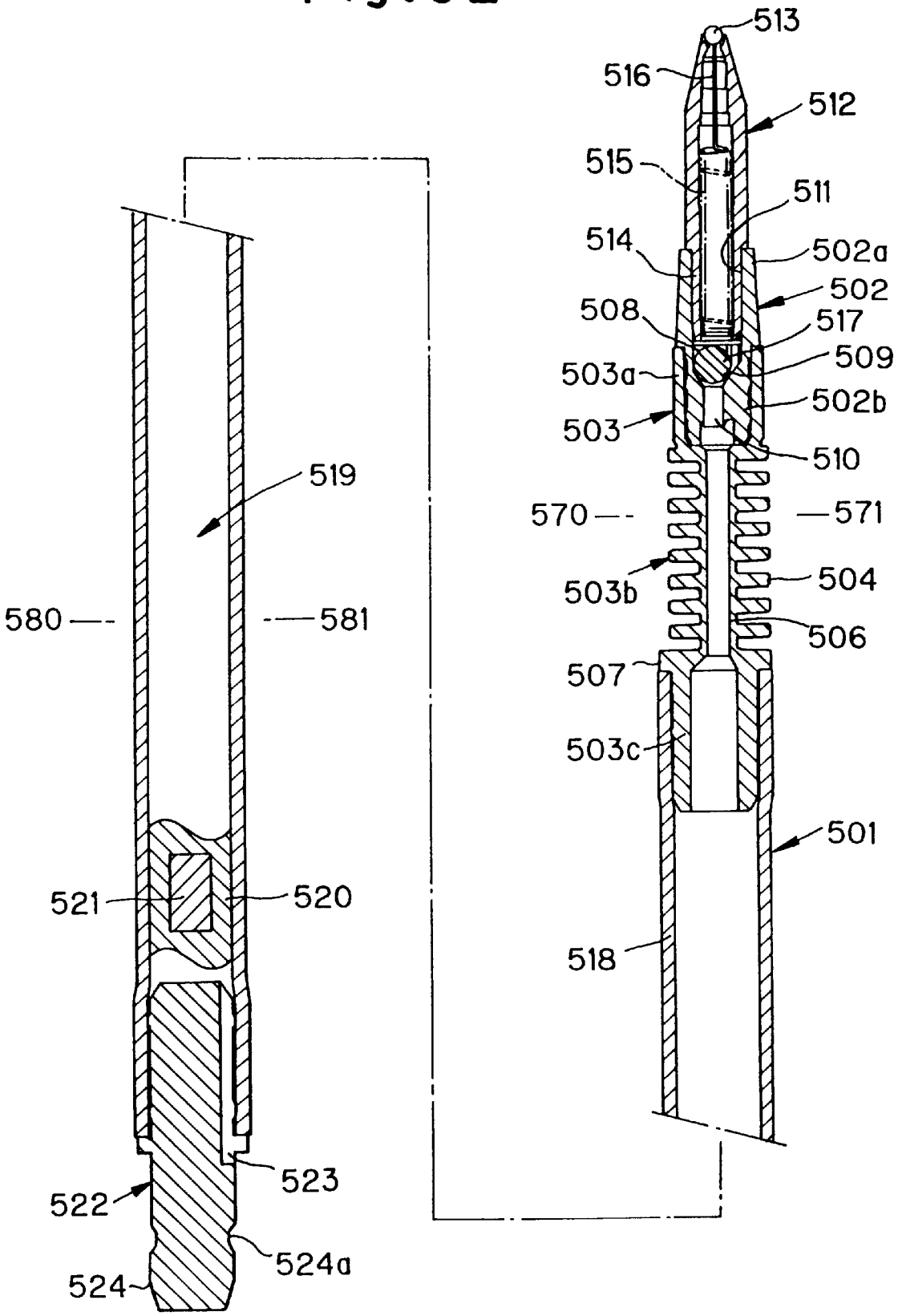
FIG. 32 is a vertical sectional view showing the overall structure of a ball-point pen element of a first example of the fifth embodiment of the invention.

Other than these, it is also possible to form a structure (not shown) in which joint 542 and flexing portion 543 in FIG. 37 are integrally formed and rear pipe 503C is integrally formed behind the flexing portion as in FIG. 32 so that it is securely joined to ink reservoir 518.

Any of the above first through third examples of the fifth embodiment can be selected depending on the convenience for the assembly and specifications of the product. The first example is advantageous to varying the length of the ink reservoir. The second one is suited to needing to display the color of the ink. The third one is beneficial to reducing the cost.

Figure 39:
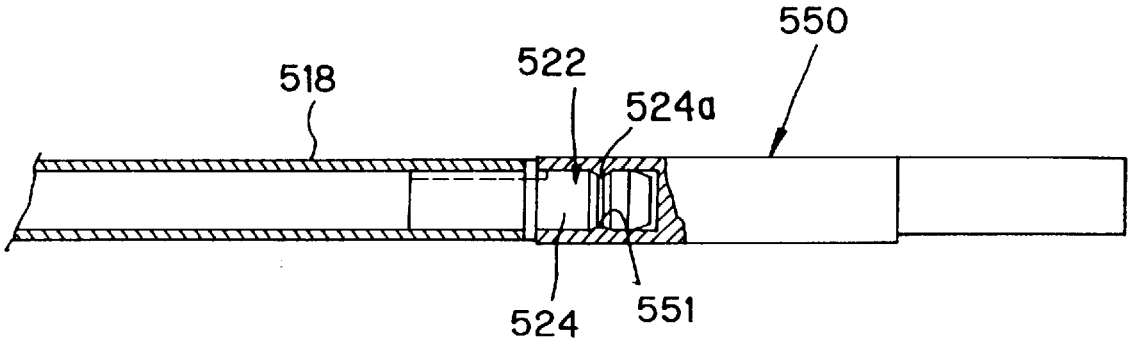
FIG. 39 is a view showing the attached state where a ball-point pen element of the fifth embodiment is attached to a connecting portion of a writing implement.
Figure 40:
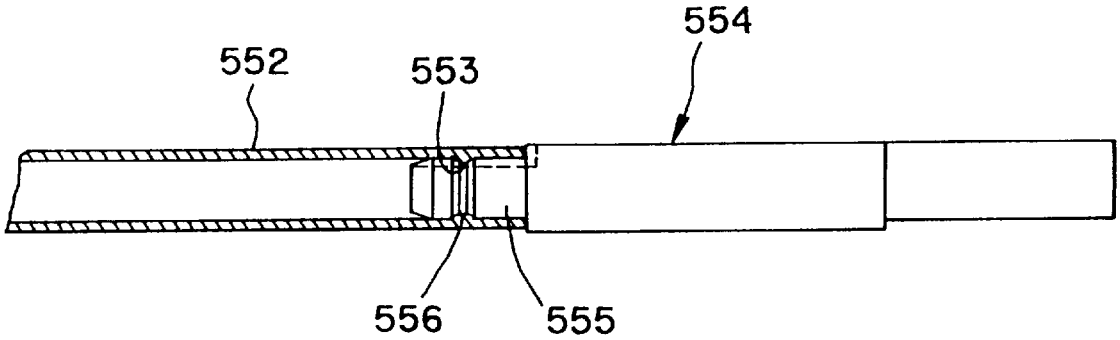
FIG. 40 is a view showing another example of the attached state where a ball-point pen element of the fifth embodiment is attached to a connecting portion of a writing implement.

FIGS. 39 and 40 are views showing the states of attachment of the ball-point pen element of the fifth embodiment to connecting portions 550 and 554 of multiplex writing element, respectively. In FIG. 39, the cylindrical part 524 of tail plug 522 which has been securely fixed to the rear end of ink reservoir 518 is engaged into the insert hole in the front part of connecting portion 550. In this case, an engaging projection 551 of connecting portion 550 is made to fit engaging groove 524*a* on cylindrical part 524. In FIG. 40, a cylindrical part 555 is formed at the front end of connecting portion 554 and this cylindrical part 555 is fitted into the rear end hole of ink reservoir 552. In this case, an engaging groove 556 on cylindrical portion 555 is engaged with a catching portion 553 of ink reservoir 552.

Operation and Effect of the Fifth Embodiment

As to ball-point pen element 501, when the point assembly 512 is oriented upward, ball valve 517 will be placed on ball seat 509 in valve chamber 508 to seal conduit 510. Therefore, even if the ink behind tip ball 513 in point assembly 512 is used up during upward writing, any head which would cause backward leaking, will not be exerted on ink. Consequently, as soon as point assembly 512 is turned down again, ink will become ready to flow out and thus ink starving during writing can be prevented. In this connection, if a structure without any ball valve is used for upward writing, the weight of ink acts in the direction of causing backward leaking and draws air into point assembly. Therefore, when the element is returned to the position of downward writing, ink cannot follow immediately, thereby causing ink starving.

In the writing state where point assembly 512 is oriented downward, ball valve 517 abuts the rear end of point assembly 512 at its one side so that an ink channel through which ink can be flowed into point assembly 512 is assured on the opposite side. In this way, ink 519 which has entered valve chamber 508 from ink reservoir 518 through conduit 510 will be brought to the backside of tip ball 513.

In this condition, since tip ball 513 is pressed forwards by rod portion 516 so that the ball comes into sealing contact with the inner brim of tip holding portion 512*b*, it is possible to prevent forward leaking of ink. When tip ball 513 is slightly moved backwards by the writing pressure, a gap which allows ink to flow out can be created. As tip ball 513 rotates during writing, ink flows out smoothly without causing any blobbing. Thus, it becomes possible to create line traces with thick line density.

Channels 512*a* (a plurality of ink flowing channels which pass through toward the tip bore 512*c* are provided on the ball seat for the tip ball) are formed behind tip ball 513, and rod portion 516 is disposed through the central hole around which channels 512*a* are formed. Ink inside point assembly 512 will be brought to the backside of tip ball 513 through ink flowing channels and the gap between the central hole and rod portion 516.

When the ball-point pen elements 501 are incorporated in a multiplex writing implement and each writing tip part is projected or retracted from the front end of the barrel, even if the ink reservoir 518 is non-flexible, the front part of the writing element will be able to flexibly deflect at flexing portion 503*b*. Therefore, without being impeded, the writing tip part can smoothly be projected from and retracted from the front end of the barrel.

In the above description, the operation and effects of the first example were described, but the same operation and effects will be achieved in the second and third examples.

Configuration of the Sixth Embodiment

Figure 41:
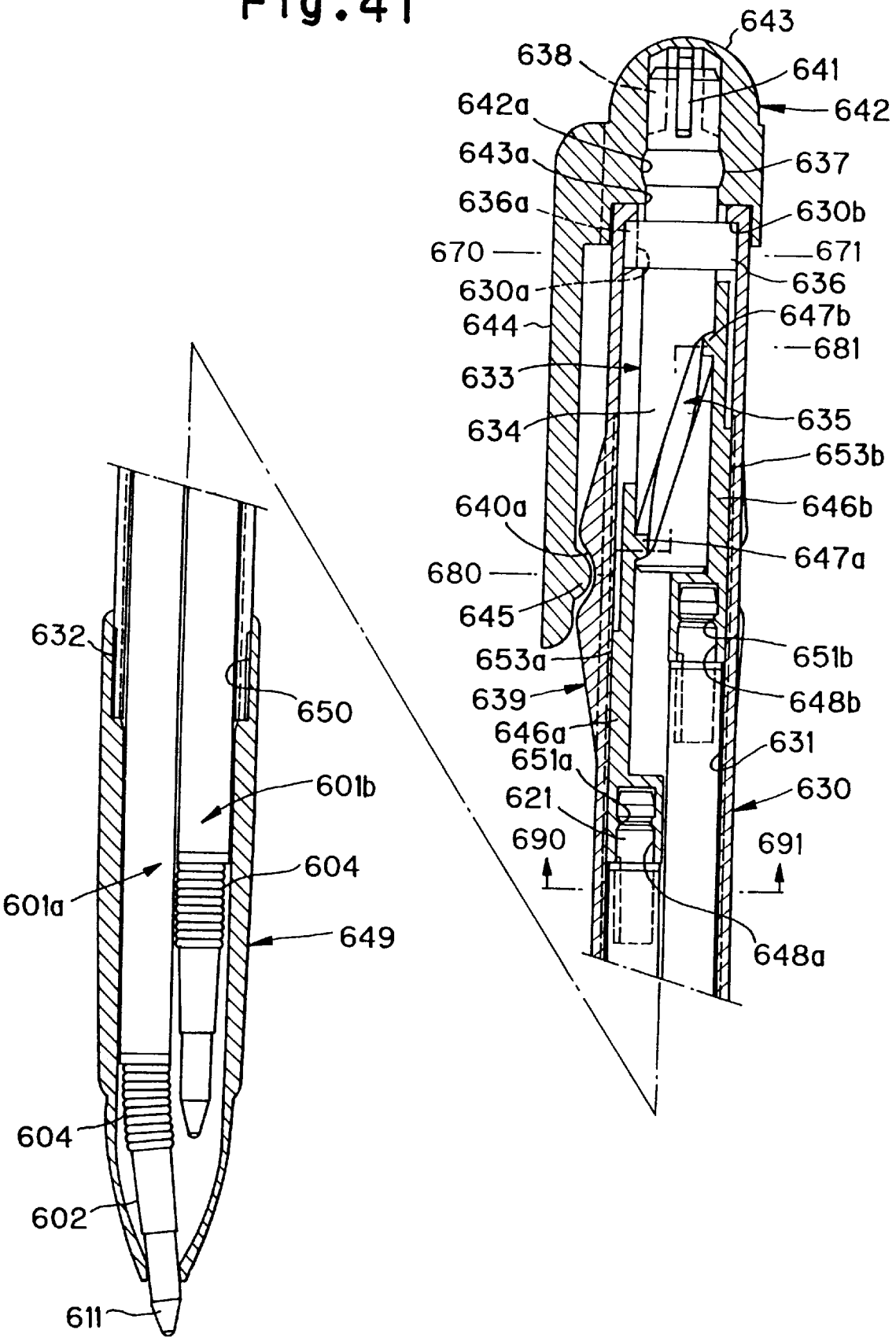
FIG. 41 is a vertical sectional view showing the overall structure of a multiplex writing implement of a first example in accordance with the sixth embodiment of the invention, where two kinds of ball-point pen elements are incorporated and a part of the view is in the non-sectional representation.
Figure 42:
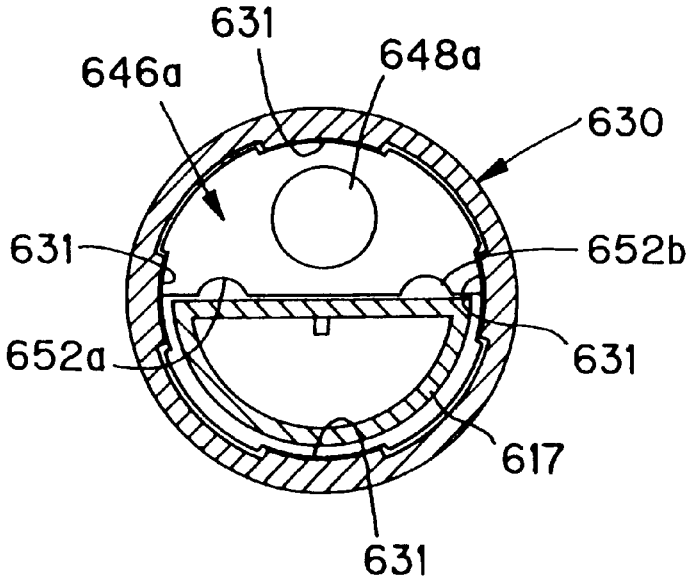
FIG. 42 is a sectional view taken on a line 690–691 in FIG. 41, showing the condition where the sliding pieces have no writing element attached.

First, FIGS. 41 through 45 show the sixth embodiment of the invention. A barrel cylinder is composed of a front barrel 649 and a rear barrel 630. In FIG. 41, two ball-point pen elements 601*a* and 601*b* are provided.

The multiplex writing implement of FIG. 41 comprises: front barrel 649 which accommodates a writing-instrumental mechanism which is positioned in the front part; rear barrel 630; and an operating handle 642 disposed in the rear end of rear barrel 630. A female thread 650 is formed on the inner periphery at the rear part of front barrel 649, whereas a male thread 632 is formed in the front part of rear barrel 630. The male thread is screwed into female thread 650 of front barrel 649 and can be removed therefrom as required, such as writing elements should be replaced. A rotation-stopper rib 630*a* which will restrict the rotating range of a rotary shaft 633 to be referred to hereinbelow and a stepped portion 630*b* are formed on the inner periphery at the rear end of the bore of rear barrel 630. Four guide ribs 631 are formed in the axial direction, 90° apart from one another on the front inner periphery of rear barrel 630.

Further, three mound-like raised portions 639 are formed on the outer periphery of rear barrel 630, rather near to the rear end. Two of them have depressed portions 640*a* and 640*b* in the center of raised portions 639.

Rotary shaft 633 has a small-diametric portion 634 in the front of a large-diametric portion 636. Formed on the peripheral surface of small-diametric portion 634 is a spiral cam groove 635. Further, rotary shaft 633 has a cylindrical portion having a reduced diameter in the rear of the large-diametric portion 636. This cylindrical portion has a radially projected engaging portion 637 on the outer periphery in the front part thereof and further has rotation-stopper grooves 638 at desired positions in the rear end thereof. Provided on the peripheral surface of the aforementioned large-diametric portion 636 is a groove 636*a* which is engaged with the aforementioned rib 630*a* to limit the rotation of rotary shaft 633 to a range of from 120° to 180° relative to rear barrel 630.

Here, when the rotational angle of rotary shaft 633 is made large, the rotational friction will become smaller so that rotational operation can be performed easily. However, the increase of the rotational angle needs a greater action, which is a drawback in the operation. Accordingly, the rotational range should be selected adaptively; that is, when the diameter of the barrel cylinder is small, the rotational angle may be set at 180° or therearound, whereas when the diameter is large, the rotational angle may be designed to be 120° or therearound.

Operating handle 642 is composed of a crown 643, a clip 644 which extends forwards from one peripheral part of crown 643. Provided on the inner side in the front part of clip 644 is a bead 645. Crown 643 has a hollow 643*a* formed in the front part thereof. The inside wall surface of hollow 643*a* has an annular engaging groove 642*a* formed in the front inner peripheral surface and rotation-stopper ribs 641 formed in the rear peripheral surface at required number.

Provided at the front ends of sliding pieces 646*a* and 646*b* are insert holes 648*a* and 648*b*, which have inwardly projected engaging portions 651*a* and 651*b* for catching the rear ends of ball-point pen element 601*a* and 601*b* (which will be described later), respectively. Projections 647*a* and 647*b* are formed on the inner peripheral sides of the sliding pieces behind the insert holes. These projections 647*a* and 647*b* receive urging forces exerted by cam groove 635 as it turns with the rotation of rotary shaft 633 so that corresponding sliding pieces 646*a* and 646*b* can move forwards or backwards. Formed on the outer peripheral sides of sliding pieces 646*a* and 646*b* are grooves 653*a* and 653*b* as rotation stoppers which engage the aforementioned guide ribs 631 of rear barrel 630.

Therefore, grooves 653*a* and 653*b* formed on the sides of sliding pieces 646*a* and 646*b* mesh corresponding guide ribs 631, whereby sliding pieces 646*a* and 646*b* will smoothly be moved forwards or backwards. The transverse cross sections of sliding pieces 646*a* and 646*b* are of substantially D-shape. Accordingly, it is an advantage that the conventionally used complicated structure which uses a guide cylinder having two opposing guide grooves is not needed.

Sliding pieces 646*a* and 646*b* come in contact with each other on their flat sides. In order to smoothen the sliding movement between the two, guiding projections 652*b* are provided for sliding piece 646*b* while guiding grooves 652*a* which should be inserted into guiding projections 652*b* are formed in sliding piece 646*a*.

Then, projections 647*a* and 647*b* of the aforementioned sliding pieces 646*a* and 646*b* are engaged with cam groove 635. In this state, rotary shaft 633 together with the sliding pieces is inserted into the bore of rear barrel 630 until the rear end of large-diametric portion 636 is abutted against stepped portion 630*b* of rear barrel 630. In this condition, the aforementioned operating handle 642 is attached to the rear cylindrical portion of rotary shaft 633.

For this attachment, engaging portion 637 becomes engaged with engaging groove 642*a* of crown 643 while rotation-stopper grooves 638 become fitted with rotation-stopper ribs 641 of crown 643. Thus, rotary shaft 633 and operating handle 642 will integrally be fixed to one another. In this arrangement, when operating handle 642 is turned relative to rear barrel 630 and therefore rotary shaft 633 rotates, one of the sliding pieces advances forwards, the other moves backwards.

Attached to insert holes 648*a* and 648*b* of sliding pieces 646*a* and 646*b* are the rear ends of ball-point pen element 601*a* and 601*b*, respectively. Further, front barrel 649 is fixed to the front part of rear barrel 630.

Figure 46:
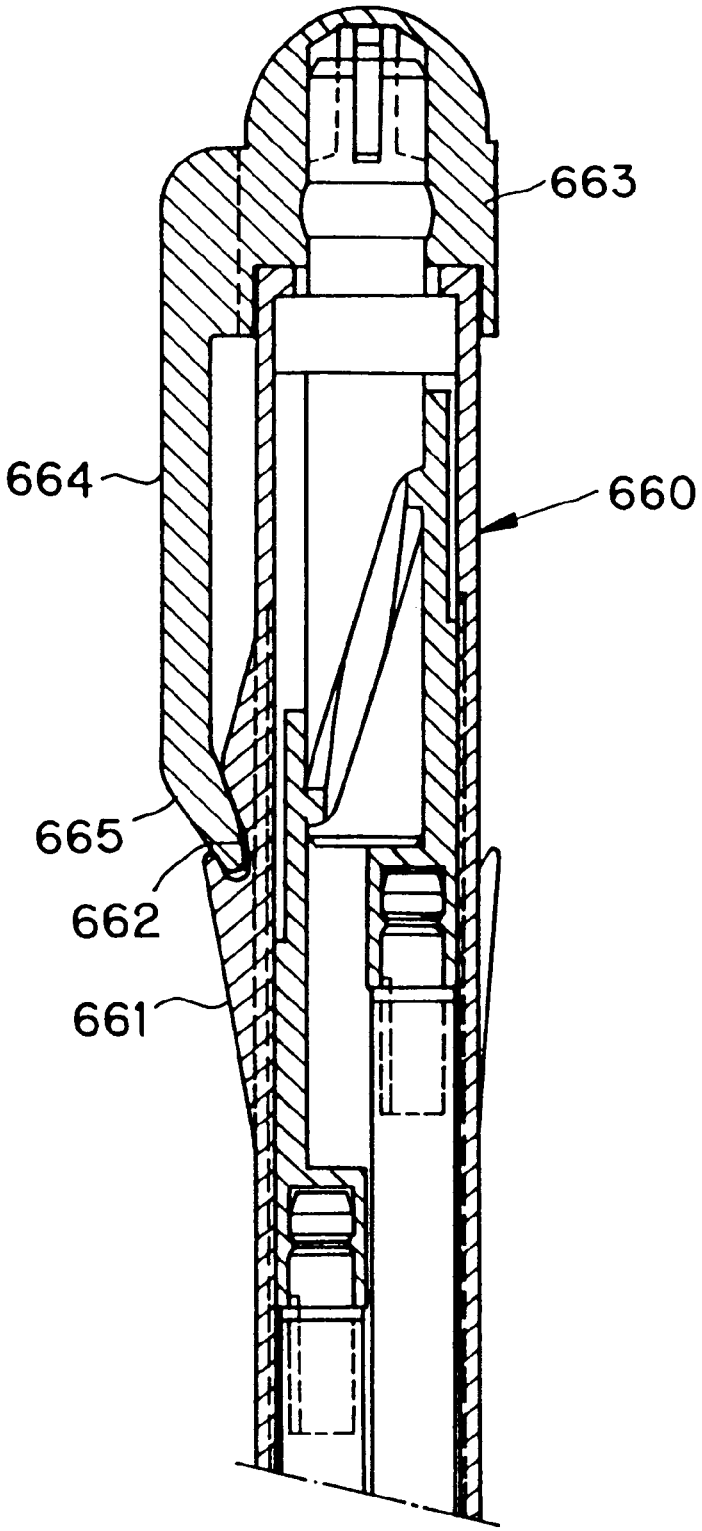
FIG. 46 is a vertical sectional view showing the rear half of a multiplex writing implement in a second example of the sixth embodiment, where a part of the view is in the non-sectional representation.

Meanwhile, FIG. 46 shows a second example of the sixth embodiment. The basic structure of this example is the same as in the first example, and its difference from the first example will be explained in the description of operation hereinbelow.

Next, ball-point pen element 601*a* to be incorporated in the multiplex writing implement of this sixth embodiment will be described. Here, two ball-point pen elements 601*a* and 601*b* have the same structure, and differ in the color of ink etc. Ink used for these ball-point pen elements 601*a* and 601*b* is so-called thixotropic water-soluble or low-viscosity oil-based ball-point ink.

Figure 45:
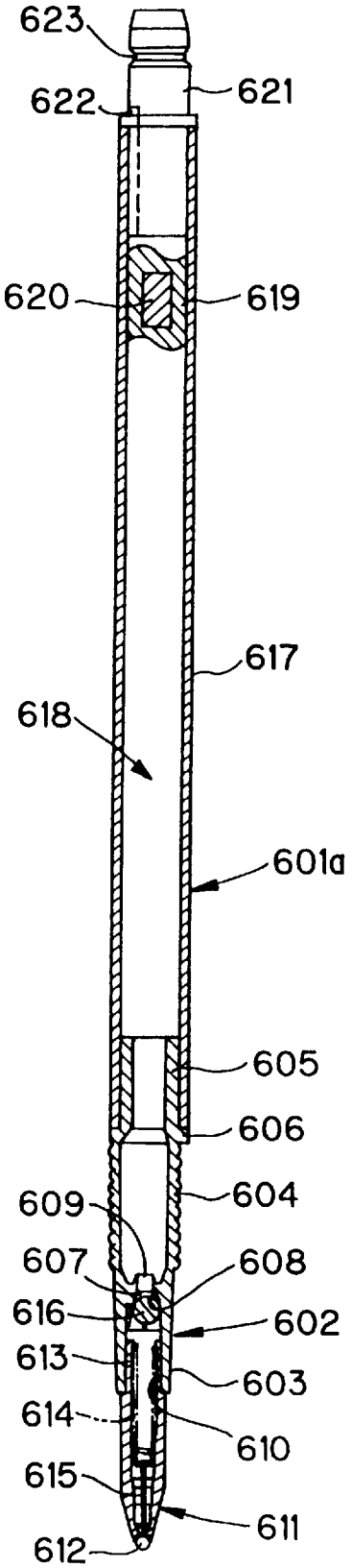
FIG. 45 is a vertical sectional view showing a ball-point pen element of a first example of the sixth embodiment.

As shown in FIG. 45, a point assembly 611 is constructed so that a tip ball 612 is substantially abutted onto a seat having channels which will permit ink to flow in, and is held rotatably by a front press-fitted portion. Further, a spring 614 is inserted into the bore of point assembly 611. The rear end of a pipe portion 613 of point assembly 611 is properly press-fitted so that the rear part of spring 614 will not come out. In order to prevent dryout of the writing point and the forward leakage of ink, it is very important to bring tip ball 612 into sealing contact with the inner surface of the tip holding portion. To achieve this, the surface roughness of the inner surface of point assembly 611 that holds tip ball 612, the ground finish of the inner surface for improving precision of the sealing contact by press-fitting and the secondary plastic process for improving accuracy of press-fitting should be considered. Further, the surface treatment etc. of the contact surface with tip ball 612 should be considered.

A straight rod portion 615 is extended forwards from spring 614. The front end of this rod portion 615 abuts the rear side of tip ball 612 to press it. This pressure causes tip ball 612 to come in sealing contact with the inner brim of the ball holding portion (formed by press-fitting etc.) of point assembly 611.

A joint 602 is integrally formed of a resin molding which comprises: a front pipe portion 603 at the front end thereof which will be press-fitted to pipe portion 613 of point assembly 611; an rear pipe portion 605 which will be press-fitted to the front end of an ink reservoir 617; and a flexible portion, e.g. a bellows 604 which is provided between the front pipe portion 603 and rear pipe portion 605. Provided in the rear of a bore 610 of front pipe portion 603 is a valve chamber 607 in which a ball valve 616 is placed with play. In the rear of valve chamber 607, a ball seat 608 of a tapered or spherical form and a conduit 609 are formed. Valve chamber 607, ball seat 608 and conduit 609 are formed adaptively eccentric relative to the axial center. The hollow of the aforementioned bellows 604 and rear pipe portion 605 is made to communicate with the bore of ink reservoir 617. A groove (not shown) which allows ink to flow in the axial direction is formed on one side of the inner wall of valve chamber 607. When point assembly 611 is oriented downwards, this ball valve 616 idly held inside valve chamber 607 will abut one-sidedly against the rear end of pipe portion 613 of point assembly 611 thereby forming an ink channel. Ink in ink reservoir 617 flows into the bore of point assembly 611 through conduit 609, the aforementioned groove and the ink flow passage etc. Conversely, when point assembly is oriented upward, ball valve 616 will abut the ball seat 608 to prevent back leakage of ink.

Ink reservoir 617 is filled up with an ink 618 suitable for the aforementioned ball-point pen elements 601*a* and 601*b*. Further, an ink follower 619 consisting of a translucent, nondrying greasy material is filled at the rear end of ink 618. This follower will move in contact with the ink surface following the consumption of the ink. In order to prevent deformation due to impacts from being dropped or clicking, a resin-made follower rod 620 having a specific weight substantially equal to that of follower 619 may be immersed in follower 619, as required. A tail plug 621 is fixed to the rear end of ink reservoir 617. Formed in the rear cylindrical part of this tail plug 621 is an engaging groove 623 which is detachably caught by engaging portion 651*a* or 651*b* inside the corresponding insert hole 648*a* or 648*b* in the front part of sliding piece 646*a* or 646*b*, respectively. Tail plug 621 further has a ventilation groove 622 which connects the inside of ink reservoir 617 with the outside air.

The aforementioned ink reservoir 617 uses a molding of, for example, transparent PP resin etc., and should be formed from a material that has good clear-drain performance. Further, ink reservoir 617 may be integrally formed with joint 602.

The ink reserving portion of ink reservoir 617 is non-flexible and has a relatively large cross-section. In the sixth embodiment this portion has an almost D-shaped section so that it can be fitted in the front barrel 630 without forming useless space (not shown). The portion for jointing the point assembly 611 with the ink reserving portion should be formed so as to readily be deflected transversely with respect to the axial direction. It is also possible to provide a flexible tube which connects the ink reservoir with the joint which is press-fitted to the rear end of point assembly 611.

Operation and Effect of the Sixth Embodiment

When the operating handle 642 is turned in one direction relative to rear barrel 630, projections 647*a* and 647*b* of sliding pieces 646*a* and 646*b* move along cam groove 635 as rotary shaft 633 rotates. With this rotation, one of the sliding pieces advance s forwards, the other moves backwards. Thus, the writing tip portion of the ball-point pen element on the advancing side can be projected out from the front end opening of front barrel 649. Further, even if the ink reserving portion of the ball-point pen element is non-flexible, the writing tip portion of the writing element will be able to flexibly deflect at bellows 604. Therefore, without being impeded, the writing tip part can smoothly be projected from and retracted into the front end opening of front barrel 649.

Figure 43:
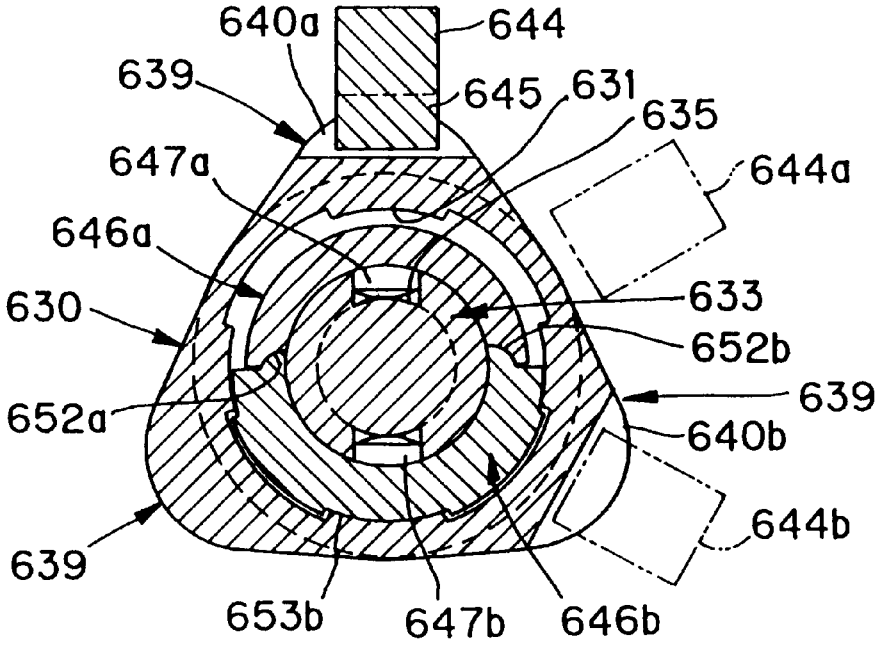
FIG. 43 is a sectional view taken on a line 680–681 in FIG. 41, showing various positions of a clip as an operating handle is rotated.
Figure 44:
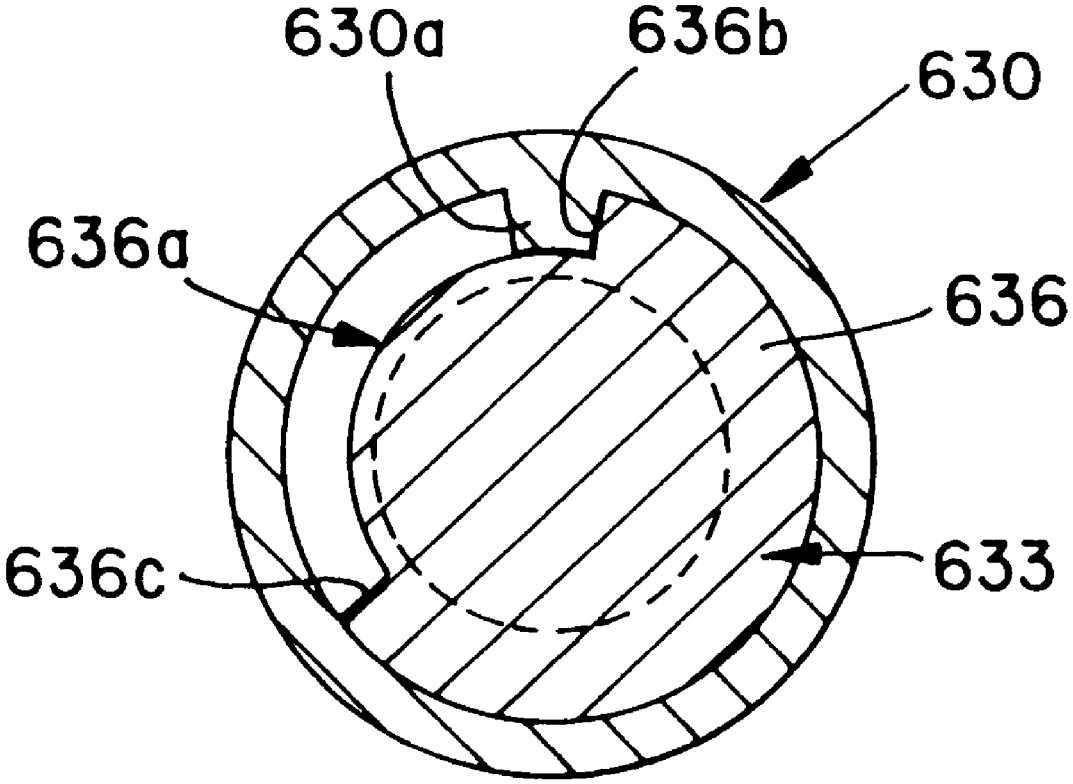
FIG. 44 is a sectional view taken on a line 670–671 in FIG. 41.

In the state where one of the ball-point pen elements, namely 601*a* is projected, as shown in FIGS. 41 and 43, bead 645 of clip 644 is covered or concealed by depressed portion

640*a* in raised portion 639 of rear barrel 630, so as to create a condition that clip 644 will not be hooked into a breast pocket etc.

Next, when rotary shaft 633 is rotated in the other direction, sliding piece 646*a* moves backwards so that the writing tip portion of ball-point pen element 601*a* retracts into front barrel 649 while sliding piece 646*b* moves forwards.

At that moment, the writing tip portions are accommodated inside front barrel 649 for the pocketable state. In this state, clip 644 is located at a position designated at 644*a* in FIG. 43 so that the clip will readily be hooked into a breast pocket etc.

A further rotation of rotary shaft 633 in the same direction above, causes sliding piece 646*a* to move backwards more while sliding piece 646*b* moves further forwards so that the writing tip portion of ball-point pen element 601*b* projects out from the front end opening of front barrel 649. In this state, clip 644 is located in a position designated by 644*b* in FIG. 43 so that bead 645 of clip 644 is concealed by depressed portion 640*b* in raised portion 639, thus creating a condition that clip 644 will be impeded from being hooked into a breast pocket etc. Further, an abutment 636*c* of groove 636*a* formed on large-diametric portion 636 of rotary shaft 633 abuts rib 630*a* of rear barrel 630 so that a further rotation in the other direction will be prohibited (see FIG. 44).

Meanwhile, in the aforementioned second example in FIG. 46, an inclined depressed engaging portion 662 is formed in a raised portion 661 on a rear barrel 660 while a clip 664 has a bended end 665. Whenever either of the writing tip portions is projected, bended end 665 is engaged with depressed engaging portion 662 so that clip 664 will never be hooked into a breast pocket etc.

It should be noted that the means for prohibiting the clip from being hooked is not limited to the above method of the sixth embodiment. For example, when the depressed engaging portion is shaped with a spherical groove, a dove tail groove or etc., the front end portion or the bead portion of the clip to be engaged therewith may be formed in the shape corresponding to the engaging portion. In this way, it is possible to create a state where the clip cannot be opened and will not be hooked to a breast pocket etc.

As to ball-point pen elements 601*a* and 601*b*, when the point assembly 611 is oriented upward, ball valve 616 will be placed on ball seat 608 in valve chamber 607 to seal conduit 609. Therefore, even if the ink behind tip ball 612 in point assembly 611 is used up during upward writing, any head which would cause back leaking, will not be exerted on ink. Consequently, as soon as point assembly 611 is turned down again, ink will become ready to flow out and thus ink starving during writing can be prevented. In this connection, if a structure without any ball valve is used for upward writing, the weight of ink acts in the direction of causing back leaking and draws air into point assembly. Therefore, when the element is returned to the position of downward writing, ink cannot follow immediately, thereby causing ink starving.

In the writing state where point assembly 611 is oriented downward, ball valve 616 abuts the rear end of point assembly 611 at its one side so that an ink channel through which ink can be flowed into point assembly 611 is assured on the opposite side. In this way, ink 618 which has entered valve chamber 607 from ink reservoir 617 through conduit 609 will be brought to the backside of tip ball 612.

In this condition, since tip ball 612 is pressed forwards by rod portion 615 so that the ball comes into sealing contact with the inner brim of the tip holding portion, it is possible to prevent forward leaking of ink. When tip ball 612 is slightly moved backwards by the writing pressure, a gap which allows ink to flow out can be created. As tip ball 612 rotates during writing, ink flows out smoothly without causing any blobbing. Thus, it becomes possible to create line traces with thick line density.

Channels (a plurality of ink flowing channels which pass through toward the bore of the point assembly are provided on the ball seat for the tip ball) are formed behind tip ball 612, and rod portion 615 is disposed through the central hole around which the channels are formed. Ink inside point assembly 611 will be brought to the backside of tip ball 612 through ink flowing channels and the gap between the central hole and rod portion 615.

Configuration of the Seventh Embodiment

Figure 47:
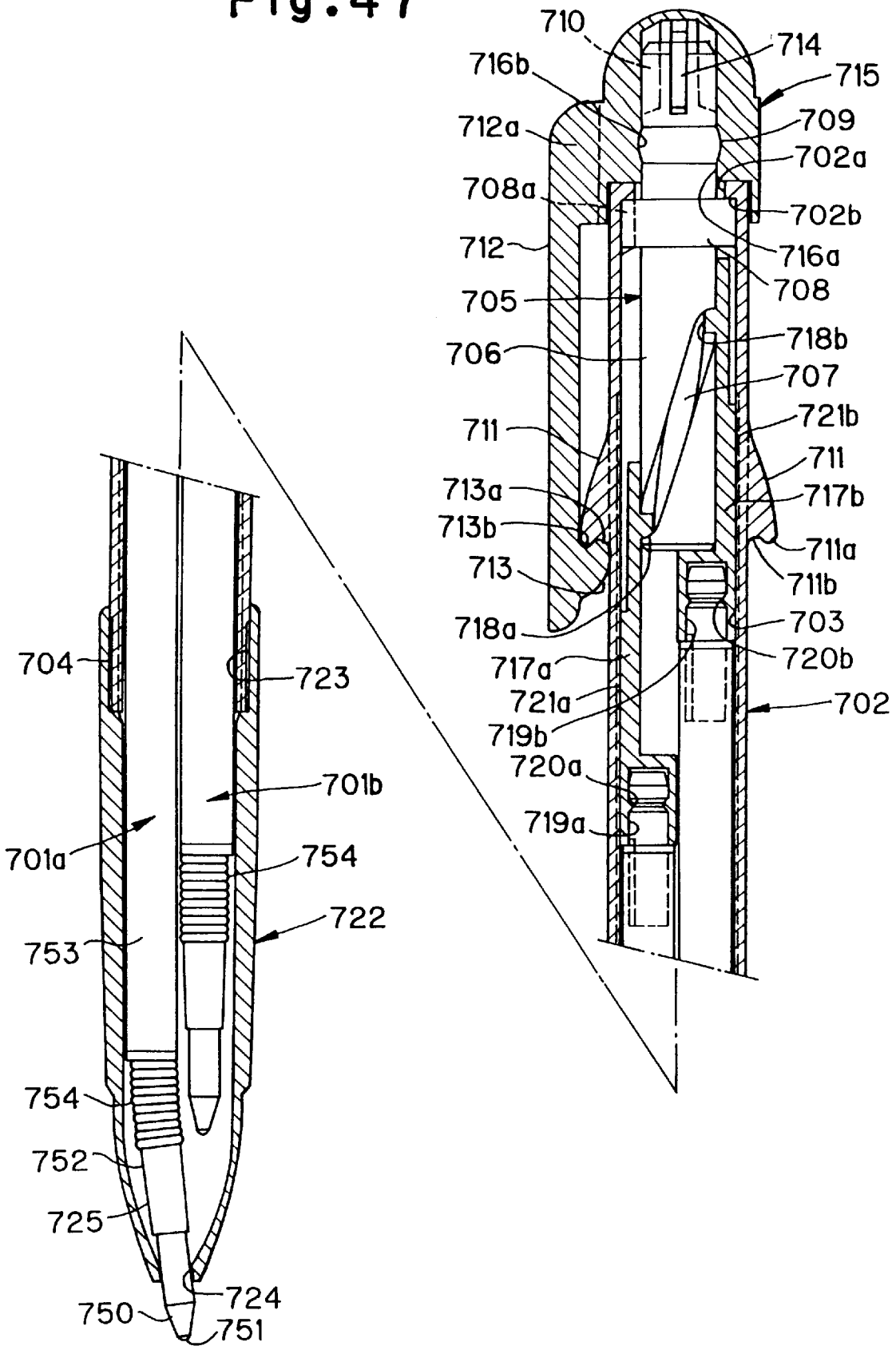
FIG. 47 is a vertical sectional view showing the overall structure of a multiplex writing implement in accordance with the seventh embodiment of the invention, where two kinds of ball-point pen elements are incorporated and a part of the view is in the non-sectional representation.

First, FIG. 47 shows the seventh embodiment of the invention. In FIG. 47, two ball-point pen elements 701*a* and 701*b* are provided. The multiplex writing implement shown in FIG. 47 comprises: a barrel cylinder which is composed of a front barrel 722 accommodating a writing-instrumental mechanism which is positioned in the front part and a rear barrel 702; and an operating handle 715 disposed in the rear end of rear barrel 702. A female thread 723 is formed on the inner periphery at the rear part of front barrel 722.

A male thread 704 is formed in the front part of rear barrel 702. The male thread is screwed into female thread 723 of front barrel 722 and can be removed therefrom as required, such as writing elements should be replaced. An unillustrated rotation-stopper rib which will restrict the rotating range of a rotary shaft 705 as well as a hole 702*a* and a stepped portion 702*b* are formed on the inner periphery at the rear end of the bore of rear barrel 702. Four guide ribs 703 are formed in the axial direction, 90° apart from one another on the front inner periphery of rear barrel 702.

Rotary shaft 705 has a small-diametric portion 706 in the front of a large-diametric portion 708. Formed on the peripheral surface of small-diametric portion 706 is a spiral cam groove 707. Further, rotary shaft 705 has a cylindrical portion having a reduced diameter in the rear of the large-diametric portion 708. This cylindrical portion has a radially projected engaging portion 709 on the outer periphery in the front part thereof and further has rotation-stopper grooves 710 at desired positions in the rear end thereof. Provided on the peripheral surface of the aforementioned large-diametric portion 708 is a groove 708*a* which is engaged with the aforementioned rotation-stopper rib to limit the rotation of rotary shaft 705 to a range of from 120° to 180° relative to rear barrel 702.

Here, when the rotational angle of rotary shaft 705 is made large, the rotational friction will become smaller so that rotational operation can be performed easily. However, the increase of the rotational angle needs a greater action, which is a drawback in the operation. Accordingly, the rotational range should be selected adaptively; that is, when the diameter of the barrel cylinder is small, the rotational angle may be set at 180° or therearound, whereas when the diameter is large, the rotational angle may be designed to be 120° or therearound.

Provided at the front ends of sliding pieces 717*a* and 717*b* are insert holes 719*a* and 719*b*, which have inwardly projected engaging portions 720*a* and 720*b* for catching the rear ends of ball-point pen element 701*a* and 701*b* (which will be described later), respectively. Projections 718*a* and 718*b* are formed on the inner peripheral sides of the sliding pieces behind the insert holes. These projections 718*a* and 718*b* receive urging forces exerted by cam groove 707 as it turns with the rotation of rotary shaft 705 so that corresponding sliding pieces 717*a* and 717*b* can move forwards or backwards. Formed on the outer peripheral sides of sliding pieces 717*a* and 717*b* are grooves 721*a* and 721*b* as rotation stoppers which engage the aforementioned guide ribs 703 of rear barrel 702.

Therefore, grooves 721*a* and 721*b* formed on the sides of sliding pieces 717*a* and 717*b* mesh corresponding guide ribs 703, whereby sliding pieces 717*a* and 717*b* will smoothly be moved forwards or backwards. The transverse cross sections of sliding pieces 717*a* and 717*b* are of substantially D-shape (not shown). Accordingly, it is an advantage that the conventionally used complicated structure which uses a guide cylinder having two opposing guide grooves is not needed.

Operating handle 715 is composed of a crown 716, a clip 712 which extends forwards from one peripheral part of crown 716. Provided on the inner side in the front part of clip 712 is a bead 713. Crown 716 has a hollow 716*a* formed in the front part thereof. The inside wall surface of hollow 716*a* has an annular engaging groove 716*b* formed in the front inner peripheral surface and rotation-stopper ribs 714 formed in the rear peripheral surface at required number.

Then, projections 718*a* and 718*b* of the aforementioned sliding pieces 717*a* and 717*b* are engaged with cam groove 707. In this state, rotary shaft 705 together with the sliding pieces is inserted into the bore of rear barrel 702 until the rear end of large-diametric portion 708 is abutted against stepped portion 702*b* of rear barrel 702. In this condition, the aforementioned operating handle 715 is attached to the rear cylindrical portion of rotary shaft 705.

For this attachment, the aforementioned engaging portion 709 of rotary shaft 705 becomes engaged with engaging groove 716*b* of crown 716 while rotation-stopper grooves 710 become fitted with rotation-stopper ribs 714 of the crown. Thus, rotary shaft 705 and operating handle 715 will integrally be fixed to one another. In this arrangement, when operating handle 715 is turned relative to rear barrel 702 and therefore rotary shaft 705 rotates, one of the sliding pieces advances forwards, the other moves backwards.

Attached to insert holes 719*a* and 719*b* of sliding pieces 717*a* and 717*b* are the rear ends of ball-point pen element 701*a* and 701*b*, respectively. Further, front barrel 722 is fixed to the front part of rear barrel 702.

Meanwhile, a pair of raised portions 711 are formed on the outer peripheral surface of rear barrel 702, rather near to the rear end. This raised portion 711 has a catching portion which is made up of a projected portion 711*a* and a recessed portion 711*b*.

On the other hand, the rear end side of bead 713 of the aforementioned clip 712 is defined by a projected portion 713*a* and a recessed portion 713*b* to form an engaging portion. That is, these catching and engaging portions are arranged so that projected portion 711*a* will be engaged with, or disengaged from, recessed portion 713*b* when clip 712 is circularly moved with the rotation of the operating handle 715.

Figure 48:
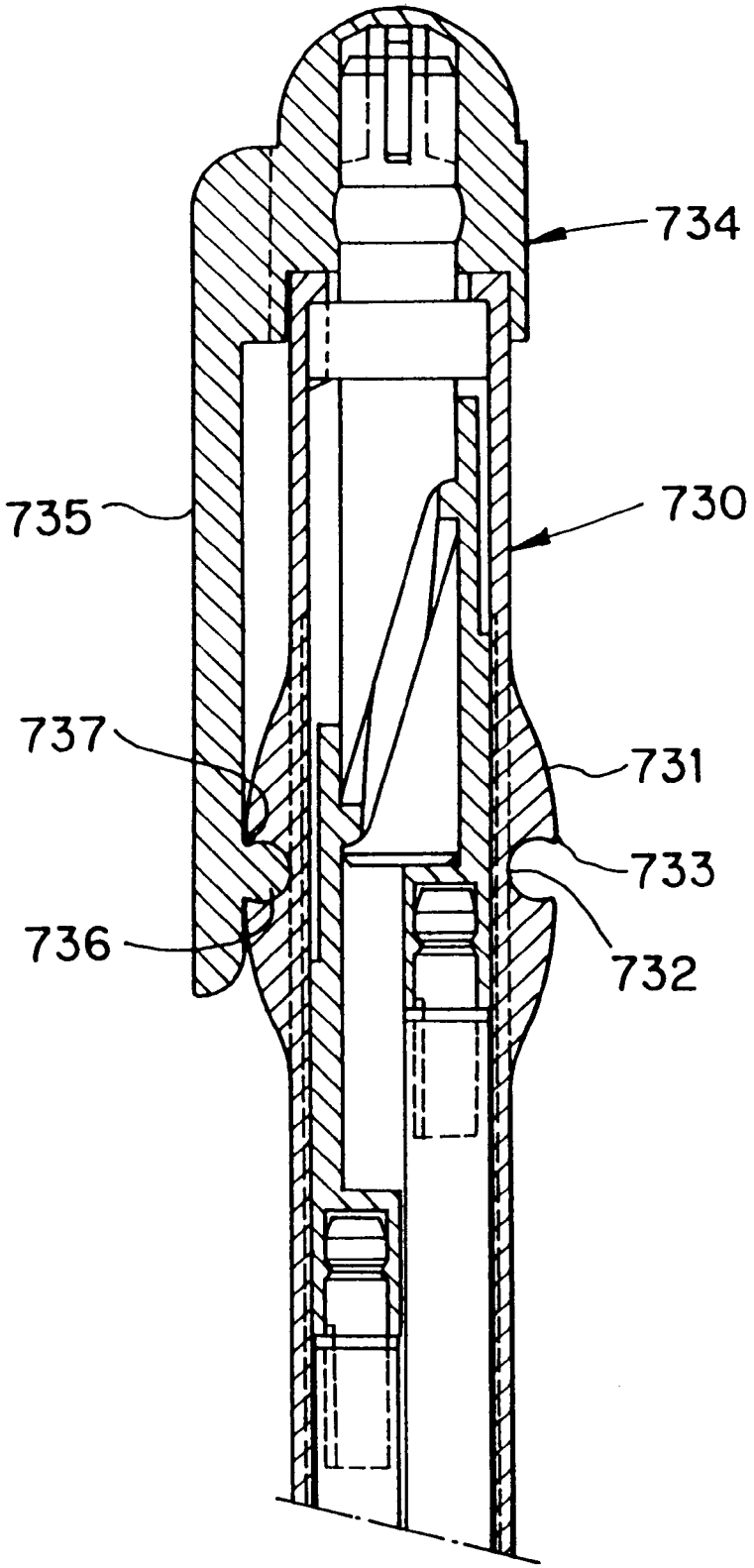
FIG. 48 is a vertical sectional view showing main components of a multiplex writing implement of a second example of the seventh embodiment.

FIG. 48 shows a second example of the seventh embodiment. The basic structure of this example is the same as in the first example, therefore only the difference will be described hereinbelow. In this case, a clip 735 has a bead 736 having a necked root 737 in the front inner side of clip 735. A pair of raised portions 731 are formed on the outer peripheral of the barrel cylinder. Formed on the outer peripheral side of each raised portion 731 is a depressed portion 732 into which bead 736 will be fitted. The hollow of depressed portion 732 is defined by a hooking edge 733 which properly reduce mouth size of opening. In this way, these bead and raised portions are arranged so that hooking edge 733 will be engaged with, or disengaged from, necked root 737 of bead 736 when clip 735 is circularly moved.

Figure 49:
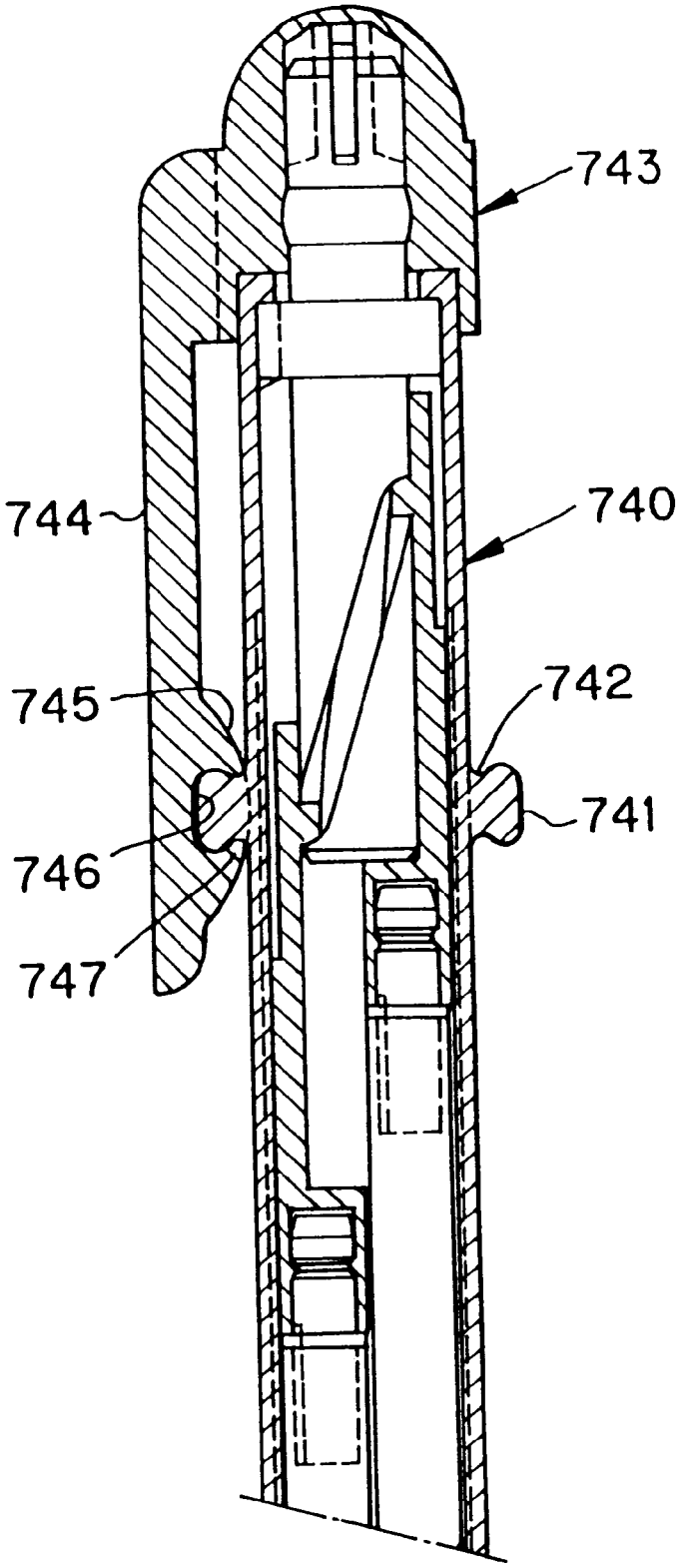
FIG. 49 is a vertical sectional view showing main components of a multiplex writing implement of a third example of the seventh embodiment.

FIG. 49 shows a third example of the seventh embodiment. The basic structure of this example is the same as in the first and second examples, therefore only the difference will be described hereinbelow. In this case, a clip 744 has a bead 745 at its front part. A depressed portion 746 which is opened facing inwards is formed on the inner side of this bead 745. Formed in the opening of depressed portion 746 is a projected portion 747 which properly reduces mouth size of the opening. A pair of raised portions 741 each having a necked root 742 are formed on the outer peripheral surface of the barrel cylinder. In this way, these bead and raised portions are arranged so that projected portion 747 of bead 745 will be engaged with, or disengaged from, necked root 742 of raised portion 741 when clip 744 is circularly moved.

Next, the ball-point pen elements to be incorporated in the multiplex writing implement of this seventh embodiment will be described. Here, two ball-point pen elements 701*a* and 701*b* have the same structure, and differ in the color of ink etc. Ink used for these ball-point pen elements 701*a* and 701*b* is so-called thixotropic middle-viscosity water-soluble or low-viscosity oil-based ball-point ink.

A point assembly 750 is constructed so that a tip ball 751 is substantially abutted onto a seat having channels which will permit ink to flow in, and is held rotatably by a front press-fitted portion. Further, a spring is inserted into the bore of point assembly 750. The rear end of point assembly 750 is properly press-fitted so that the rear part of the spring will not come out. In order to prevent dryout of the writing point and the forward leakage of ink, it is very important to bring tip ball 751 into sealing contact with the inner surface of the tip holding portion. To achieve this, the surface roughness of the inner surface of point assembly 750 that holds tip ball 751, the ground finish of the inner surface for improving precision of the sealing contact by press-fitting and the secondary plastic process for improving accuracy of press-fitting should be considered. Further, the surface treatment etc. of the contact surface with tip ball 751 should be considered.

A straight rod portion is extended forwards from the spring. The front end of this rod portion abuts the rear side of tip ball 751 to press it. This pressure causes tip ball 751 to come in sealing contact with the inner brim of the ball holding portion (formed by press-fitting etc.) of point assembly 750 (the illustration is omitted because this structure is publicly known and is the same as the point assembly shown in the first embodiment etc.)

A joint 752 is integrally formed of a resin molding which comprises: a front pipe portion at the front end thereof which will be press-fitted to point assembly 750; an rear pipe portion which will be press-fitted to the front end of an ink reservoir 753; and an elastically flexible portion 754 such as a bellows, which is provided between the front pipe portion and rear pipe portion. A valve chamber which has a ball valve placed with play and faces the rear part end of point assembly 750, is provided inside joint 752. When point assembly 750 is oriented downwards, a conduit is opened and ink is made to flow to the point assembly side. When the point assembly is placed upwards, the conduit is sealed so that back leakage of ink will be prevented (the illustration is omitted because this structure is publicly known and is the same as the point assembly shown in the first embodiment etc.)

Ink reservoir 753 is filled up with an ink which is either medium-viscosity water-soluble or low-viscosity oil-based ball-point pen ink. Further, an ink follower consisting of a translucent, nondrying greasy material is filled at the rear end of ink. This follower will move in contact with the ink surface following the consumption of the ink. (the illustration is omitted because this structure is publicly known and is the same as the point assembly shown in the first embodiment etc.)

Operation and Effect of the Seventh Embodiment

When the operating handle 715 is turned in one direction relative to rear barrel 702, projections 718*a* and 718*b* of sliding pieces 717*a* and 717*b* move along cam groove 707 as rotary shaft 705 rotates. With this rotation, one of the sliding pieces advances forwards, the other moves backwards. Thus, the writing tip portion of the ball-point pen element on the advancing side can be projected out from a front end opening 724 of front barrel 722. Further, even if ink reservoir 753 of ball-point pen elements 701*a* or 701*b* are non-flexible, the writing tip portion of the writing element will be able to flexibly deflect at elastically flexible portion 754. Therefore, without being impeded, the writing tip part can smoothly be projected from and retracted into front end opening 724.

In the state where one of the ball-point pen elements, namely 701*a* is projected, as shown in FIGS. 47 through and 49, bead 713, 731 or 741 of clip 712, 735 or 744 will be engaged with raised portion 711, 731 or 741 formed on the peripheral surface of rear barrel 702, so as to create a condition that clip 712, 735 or 744 will not be hooked into a breast pocket etc.

Next, when operating handle 715 or rotary shaft 705 is rotated in the other direction, sliding piece 717*a* moves backwards so that the writing tip portion of ball-point pen element 701*a* retracts into front barrel 722 while sliding piece 717*b* moves forwards.

At that moment, the writing tip portions are accommodated inside front barrel 722 for the pocketable state. In this state, clip 712, 735 or 744 becomes disengaged from raised portion 711, 731 or 741 so that the clip will readily be hooked into a breast pocket etc.

A further rotation of rotary shaft 705 in the same direction above, causes sliding piece 717*a* to move backwards more while sliding piece 717*b* moves further forwards so that the writing tip portion of ball-point pen element 701*b* projects out from front end opening 724 of front barrel 722. In this state, clip 712, 735 or 744 is located so that bead 713, 736 or 745 becomes engaged with raised portion 711, 731 or 741 on the peripheral surface of rear barrel 702, thus creating a condition that clip 712, 735 or 744 will not be hooked into a breast pocket etc.

As has been described heretofore, the structures, operations and effects of the multiplex writing implements of the invention are configured. Therefore, in the multiplex writing implement in which at least one ball-point pen element using so-called thixotropic water-soluble or low-viscosity oil-based ball-point ink is incorporated, it is possible to create line traces with thick line density without causing any blobbing or ink starving. It is also possible to keep the writing point resistant to dryout without any cap. Further, it is possible to prevent ink from staining the barrel cylinder, user's hands, clothes etc., which would be caused by forward leakage of ink or back leakage of ink due to upward writing as well as due to impacts from being dropped or clicked. Moreover, it is possible to reliably project or retract the writing tip portions without enlarging the diameter of the barrel cylinder, therefore the structure of the invention will be able to satisfy demands for portability and high performances of handling. Additionally, it is also possible to provide a convenient multiplex writing implement which has ball-point pen elements using an eraser-erasable ink and/or a mechanical pencil element incorporated with an eraser delivering mechanism.

By using a flexible joint which joins the rear part of the writing implement and the front part of the clicking portion, it is possible to project and retract the writing tip portions of the writing elements with increased smoothness, while the diameter of the barrel cylinder can be designed as small as possible, with the slimmest barrel front.

Further, the simplified internal structure of the multiplex writing implement containing a projecting and retracting mechanism for writing elements, will be able to improve assembling and cost performances. Further, this feature is able to provide a convenient multiplex writing implement which has a suitable barrel size which meets the demands for portability and high performances of handling, and still is able to afford high degrees of freedom for the writing elements incorporated.

Moreover, when the operating handle is rotated to a position where the writing tip portion is projected out from the barrel front, hooking of the clip into a breast pocket etc., will be impeded or will totally be prohibited. Accordingly, it is possible to prevent the user from placing the implement with its writing point projected out, into a breast pocket etc. As a result, it is possible to prevent clothes and the like from being stained. Further, since when the writing tip portion is projected out, the clip will not be hooked into a breast pocket etc., the user can easily know the situation that the writing tip portion remains projected, it is possible to prevent the occurrence of damages to clothes etc. due to the sharp edge of the writing tip portion, if the multiplex writing implement has a mechanical pencil element.

What is claimed is:

1. A multiplex writing implement comprising: a barrel cylinder; and a plurality of writing elements incorporated in said barrel cylinder, said multiplex writing implement being characterized in that, the writing tip portions of said writing elements can selectively be projected from or retracted into the barrel front, at least one of said plurality of writing elements is a ball-point pen element which comprises: a point assembly which is composed of a tip ball held in a tip holding portion at the tip end thereof and a spring which is arranged so as to constantly bring said tip ball into sealing contact with the inner brim of said tip holding portion and release the sealed state during writing; an ink reservoir which is disposed behind said point assembly and is filled up with a thixotropinc water-soluble or low-viscosity oil-based ball-point ink whose viscosity decreases as the tip ball rolls during writing so as to allow smooth distribution of ink; and an ink follower which consists of a translucent, nondrying greasy material and is disposed at the rear end of the ink so as to move in contact with the ink surface following the consumption of the ink, the ink reserving portion of said ink reservoir is non-flexible and has a relatively large cross-section, and a portion for jointing said point assembly with said ink reserving portion is formed so that the point assembly of the writing element can readily be deflected transversely with respect to the ink reserving portion of the writing element.

2. A multiplex writing implement according to claim 1, wherein said ball-point pen element has a joint which is integrally formed of: a portion to be press-fitted to the rear end of said point assembly; a portion to be press-fitted to said ink reservoir; and a flexible portion disposed between said portion to be press-fitted to the rear end of said point assembly and said portion to be press-fitted to said ink reservoir.

3. A multiplex writing implement according to claim 1, wherein said ball-point pen element comprises: a valve chamber which is disposed facing the rear end of said point assembly and has a ball valve held therein with play; a ball seat which is formed in the rear of valve chamber and which the ball valve comes in sealing contact with to prevent back leaking of ink; and a conduit which extends from said ball seat to said ink reservoir.

4. A multiplex writing implement according to claim 1, wherein used is an erasable ink which is obtained by adding a cross-linking agent to an ink solvent so that the ink will become a sol when the tip ball rolls during writing and it will again become a gel when it is drawn on the writing surface whereby the ink will not be absorbed into the paper.

5. A multiplex writing implement according to claim 1, wherein said barrel cylinder is composed of front and rear barrels and a middle barrel provided therebetween, and which further comprises:

return springs which are engaged with said middle barrel at one end thereof and urges corresponding writing elements rearwards;

sliding pieces which are attached to the rear ends of the writing elements and are urged rearwards by said return springs;

a cylindrical cam which has a slant cam surface at the front end thereof to push the rear end of any one of the sliding pieces so that one of said writing elements moves forwards, and further has an engaging portion which is engaged with said middle barrel so that the cam can be rotated; and an eraser delivering mechanism which is attached to the rear of said cylindrical cam.

6. A multiplex writing implement according to claim 1, wherein said barrel cylinder is composed of front and rear barrels, which are connected to one another and said rear barrel has a plurality of longitudinal slots which extend up to the rear end thereof, and which further comprises:

a plurality of clicking portions which each are linked with the corresponding writing elements and are projected out through the longitudinal slots and become engaged when the clicking portion is slid forward, so that one of the tip portions of the writing elements is selectively projected from the front opening of said front barrel; and a plurality of flexible joints each of which joins the rear end of the writing element with the front end of the clicking portion so that the connection can deflect approximately perpendicularly to the axial direction.

7. A multiplex writing implement according to claim 1, wherein said barrel cylinder is composed of front and rear barrels, and which further comprises:

a rotary shaft which is disposed in the bore of said rear barrel so as to be rotatable within a range of approximately 120° relative to said rear barrel and is provided with a pair of projections in the front part thereof;

an operating handle which is fixed to the rear end portion of said rotary shaft which is projected from the rear end of said rear barrel, said operating handle together with said rotary shaft being held just rotatably relative to said rear barrel; and a pair of sliding pieces which are disposed opposite to each other and of which each inner side is formed with a slant cam groove to be engaged with the projection of said rotary shaft so that the sliding pieces are guided by the bore of said rear barrel so as to be moved only back and forth, said multiplex writing implement being characterized in that the writing elements are provided in front of said sliding pieces so as to be linked with said sliding pieces, and when the rotary shaft rotates as said operating handle is rotated, said sliding pieces alternately move forwards and backwards so that the tip portions of the writing elements can be projected from or retracted into the front end opening of the front barrel.

8. A multiplex writing implement according to claim 1, which further comprises:

an operating handle which is disposed in the rear part of the barrel cylinder and is rotated so that the front tip portions of the writing elements are selectively projected from or retracted into the barrel front;

a clip which extends toward the barrel front from one peripheral part of said operating handle; and a plurality of raised portions which will become opposite to the front part of said clip are formed on the outer peripheral surface of the barrel cylinder at predetermined positions, wherein whenever either of the tip portions of the writing elements remains to be projected from the barrel front, the front part of said clip and said raised portion will be aligned to each other in the axial direction so that said clip will be impeded from being hooked in a breast pocket etc.

9. A multiplex writing implement according to claim 8, wherein whenever either of the tip portions of the writing elements remains projected from the barrel front, the front part of said clip is concealed by a depressed portion formed in said raised portion so that said clip will be impeded from being hooked in a breast pocket etc.

10. A multiplex writing implement according to claim 8, wherein said clip has a bead in the front part thereof, and whenever either of the tip portions of the writing elements remains projected from the barrel front, the bead of said clip and said raised portion engage one another so that the bead of said clip will not be separated from the peripheral surface of said barrel cylinder.

11. A multiplex writing implement according to claim 10, wherein said raised portion has an engaging portion in the front side thereof which is composed of projected and recessed portions while the bead of said clip has an engaging portion in the rear side thereof which is composed of projected and recessed portions, so that the projected portion of said raised potion will become engaged with and disengaged from the recessed portion of the bead as said clip is rotated.

12. A multiplex writing implement according to claim 10, wherein the bead of said clip has a necked portion while a depressed portion into which said bead is fitted is formed on the peripheral surface of said raised portion, and the opening of said depressed portion is formed with an edged portion which narrows the opening so that the edged portion will become engaged with and disengaged from the necked portion of the bead as the clip is rotated.

13. A multiplex writing implement according to claim 10, wherein the bead of said clip has a depressed portion which is opened facing inwards and a projected portion which narrows the opening is formed in the opening of the depressed portion while a plurality of raised portions each having a necked portion are formed on the outer peripheral surface of the barrel cylinder, so that the depressed portion of the bead will become engaged with and disengaged from the necked portion of the raised portion as said clip is rotated.

14. A multiplex writing implement according to claim 1, wherein two type of writing elements, that is, a mechanical pencil element and a ball-point pen element are incorporated, and at least the mechanical pencil element is held movably in the axial direction when the element is projected out.

15. A multiplex writing implement according to claim 1, wherein said barrel cylinder is composed of front and rear barrels, and which further comprises:

a rotary shaft which is disposed in the bore of said rear barrel so as to be rotatable within a range of 120° to 180° relative to said rear barrel and is provided with a cam groove formed on the peripheral surface of the shaft;

an operating handle which is fixed to the rear end portion of said rotary shaft which is projected from the rear end of said rear barrel, said operating handle together with said rotary shaft being held just rotatably relative to said rear barrel; and a pair of sliding pieces which are disposed opposite to each other and of which each inner side is formed with a projection to be engaged with the cam groove of said rotary shaft so that the sliding pieces are guided by the bore of said rear barrel so as to be moved only back and forth, said multiplex writing implement being characterized in that the writing elements are provided in front of said sliding pieces so as to be linked with said sliding pieces, and when the rotary shaft rotates as said operating handle is rotated, said sliding pieces alternately move forwards and backwards so that the tip portions of the writing elements can be projected from or retracted into the front end opening of the front barrel.

* * * * *